US010102991B2

(12) United States Patent
Kanematsu et al.

(10) Patent No.: US 10,102,991 B2
(45) Date of Patent: Oct. 16, 2018

(54) CONTACT APPARATUS

(71) Applicant: Panasonic Intellectual Property Management Co., Ltd., Osaka (JP)

(72) Inventors: Kenji Kanematsu, Osaka (JP); Shinya Kimoto, Osaka (JP); Riichi Uotome, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/915,503

(22) PCT Filed: Aug. 22, 2014

(86) PCT No.: PCT/JP2014/004318
§ 371 (c)(1),
(2) Date: Feb. 29, 2016

(87) PCT Pub. No.: WO2015/029400
PCT Pub. Date: Mar. 5, 2015

(65) Prior Publication Data

US 2016/0233039 A1 Aug. 11, 2016

(30) Foreign Application Priority Data

Aug. 29, 2013 (JP) ..... 2013-178585
Aug. 29, 2013 (JP) ..... 2013-178586
(Continued)

(51) Int. Cl.
*H01H 33/78* (2006.01)
*H01H 1/66* (2006.01)
(Continued)

(52) U.S. Cl.
CPC ..... *H01H 33/78* (2013.01); *H01H 1/66* (2013.01); *H01H 9/302* (2013.01); *H01H 9/34* (2013.01);
(Continued)

(58) Field of Classification Search
CPC ..... H01H 33/76; H01H 33/756; H01H 33/78; H01H 1/66; H01H 9/302; H01H 9/34;
(Continued)

(56) References Cited

U.S. PATENT DOCUMENTS 3,676,623 A * 7/1972 Hollister ..... H01H 1/58 200/293
4,733,032 A * 3/1988 Pardini ..... H01H 9/34 218/150
(Continued)

FOREIGN PATENT DOCUMENTS

EP 1313121 A1 5/2003
JP S41-011617 U1 5/1966
(Continued)

OTHER PUBLICATIONS

International Search Report and Written Opinion dated Nov. 18, 2014, issued in corresponding International Application No. PCT/JP2014/004318. (w/ partial English translation).

*Primary Examiner* — Renee Luebke
*Assistant Examiner* — William Bolton
(74) *Attorney, Agent, or Firm* — McDermott Will & Emery LLP

(57) ABSTRACT

The contact apparatus includes a fixed contact, a movable contact, and an arc extinguishing member. The movable contact is movable between a closed position where the movable contact is in contact with the fixed contact and an open position where the movable contact is separate from the fixed contact. The arc extinguishing member is for
(Continued)

discharging an arc extinguishing gas offering a capacity for extinguishment of an arc, into a space containing the fixed contact and the movable contact.

11 Claims, 30 Drawing Sheets

(30) Foreign Application Priority Data

| | | |
|---|---|---|
| Aug. 29, 2013 | (JP) | 2013-178587 |
| Aug. 29, 2013 | (JP) | 2013-178588 |
| Aug. 29, 2013 | (JP) | 2013-178589 |
| Aug. 29, 2013 | (JP) | 2013-178590 |

(51) Int. Cl.

| | |
|---|---|
| ***H01H 9/30*** | (2006.01) |
| ***H01H 9/34*** | (2006.01) |
| ***H01H 9/36*** | (2006.01) |
| ***H01H 50/00*** | (2006.01) |
| ***H01H 50/38*** | (2006.01) |
| ***H01H 50/54*** | (2006.01) |
| ***H01H 50/02*** | (2006.01) |

(52) U.S. Cl.
CPC ..... *H01H 9/36* (2013.01); *H01H 50/00* (2013.01); *H01H 50/38* (2013.01); *H01H 50/54* (2013.01); *H01H 50/546* (2013.01); *H01H 2050/025* (2013.01)

(58) Field of Classification Search
CPC ..... H01H 9/36; H01H 50/00; H01H 50/38; H01H 50/54; H01H 50/546; H01H 73/18
USPC ..... 218/51, 57, 59, 90, 81, 1, 118; 335/78, 335/201, 202; 281/90
See application file for complete search history.

(56) References Cited

U.S. PATENT DOCUMENTS

| | | | | |
|---|---|---|---|---|
| 4,780,579 | A * | 10/1988 | Asahi | H01H 9/342 218/1 |
| 4,845,460 | A * | 7/1989 | Manthe | H01H 9/0072 335/201 |
| 5,463,199 | A * | 10/1995 | Divincenzo | H01H 33/765 218/158 |
| 5,629,506 | A | 5/1997 | Harris et al. | |
| 6,218,636 | B1 * | 4/2001 | Blancfene | H01H 9/346 218/158 |
| 6,700,466 | B1 * | 3/2004 | Yamamoto | H01H 9/302 335/132 |
| 7,875,822 | B2 * | 1/2011 | Asokan | H01H 9/302 218/156 |
| 2012/0090149 | A1 | 4/2012 | Yeon | |
| 2013/0161289 | A1 * | 6/2013 | Horinouchi | H01H 33/703 218/47 |

FOREIGN PATENT DOCUMENTS

| | | | |
|---|---|---|---|
| JP | 58-133731 | A | 8/1983 |
| JP | 63-079701 | A | 4/1988 |
| JP | S63-102119 | A | 5/1988 |
| JP | S64-077811 | A | 3/1989 |
| JP | H01-140524 | A | 6/1989 |
| JP | H01-264901 | A | 10/1989 |
| JP | 04-124727 | U | 11/1992 |
| JP | H07-029472 | A | 1/1995 |
| JP | H08-064098 | A | 3/1996 |
| JP | 2000-303101 | A | 10/2000 |
| JP | 2001-214206 | A | 8/2001 |
| JP | 2001-303160 | A | 10/2001 |
| JP | 2002-251934 | A | 9/2002 |
| JP | 2004-164994 | A | 6/2004 |
| JP | 2005-353317 | A | 12/2005 |
| JP | 2007-287525 | A | 11/2007 |
| JP | 2011-150972 | A | 8/2011 |
| JP | 2012-089487 | A | 5/2012 |
| WO | 02/078032 | A1 | 10/2002 |
| WO | 2012/157057 | A1 | 11/2012 |

* cited by examiner

CONTACT APPARATUS

RELATED APPLICATIONS

This application is the U.S. National Phase under 35 U.S.C. § 371 of International Application No. PCT/JP2014/004318, filed on Aug. 22, 2014 which in turn claims the benefit of Japanese Application No. 2013-178585, filed on Aug. 29, 2013; Japanese Application No. 2013-178588, filed Aug. 29, 2013; Japanese Application No. 2013-178589, filed Aug. 29, 2013; Japanese Application No. 2013-178586, filed Aug. 29, 2013; Japanese Application No. 2013-178590, filed Aug. 29, 2013 and Japanese Application No. 2013-178587, filed Aug. 29, 2013, the disclosures of which are incorporated by reference herein.

TECHNICAL FIELD

The present invention is, generally directed to contact apparatuses, and in particular directed to a contact apparatus for making and breaking conduction between contacts.

BACKGROUND ART

In the past, there has been proposed a contact apparatus including a pair of fixed contacts, and a pair of movable contacts movable between their closed positions where the pair of movable contacts are in contact with the respective pair of fixed contacts, and their open positions where the pair of movable contacts are separate from the respective pair of fixed contacts. In this contact apparatus, the pair of fixed contacts are electrically connected or not electrically connected depending on movement of the movable contacts. Such contact apparatus is disclosed in Document 1 (JP 2007-287525 A), for example. In this contact apparatus, the pair of movable contacts is provided to a movable contact member. While the movable contacts are in their closed positions, the pair of fixed contacts are electrically connected (the conducting path therebetween is made) through the movable contacts and the movable contact member. While the movable contacts are in their open positions, the pair of fixed contacts are not electrically connected (the conducting path therebetween is broken).

However, in such a conventional contact apparatus, an arc may occur between a movable contact and a fixed contact when the movable contact moves away from the fixed contact. Therefore, quick extinguishment of such an arc is highly demanded.

SUMMARY OF INVENTION

In view of the above insufficiency, the objective of the present invention is to propose a contact apparatus capable of extinguishing an arc quickly in response to occurrence of an arc.

A contact apparatus of one aspect of the present invention includes a fixed contact, a movable contact, and an arc extinguishing member. The movable contact is movable between a closed position where the movable contact is in contact with the fixed contact and an open position where the movable contact is separate from the fixed contact. The arc extinguishing member is for discharging an arc extinguishing gas offering a capacity for extinguishment of an arc, into a space containing the fixed contact and the movable contact.

DESCRIPTION OF EMBODIMENTS

Figure 1:
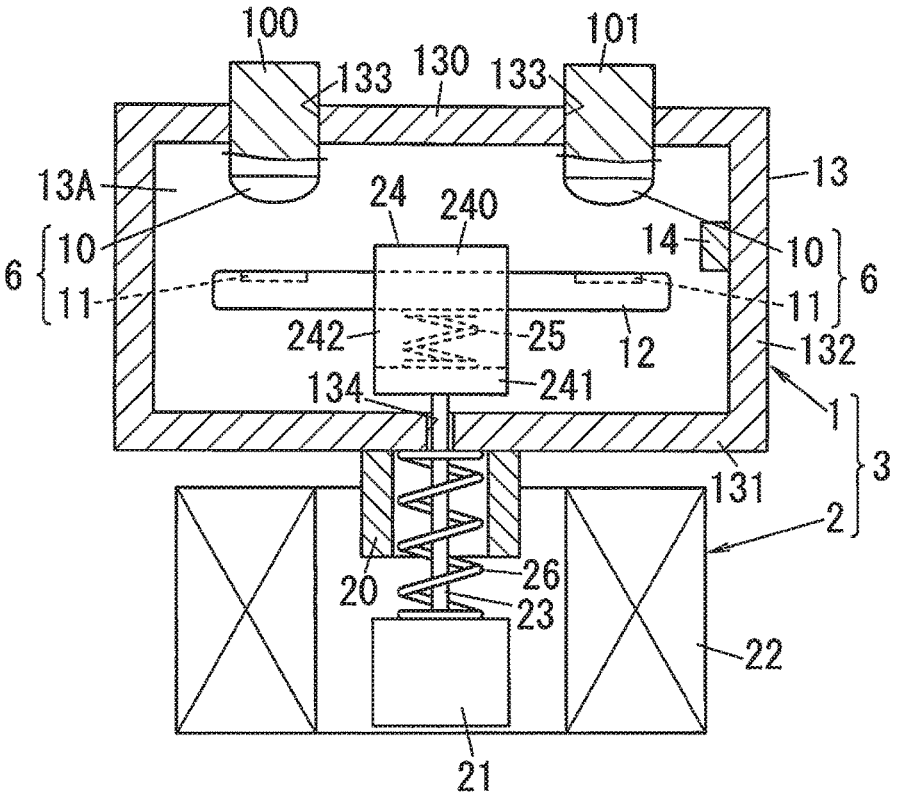
FIG. 1 is a schematic configuration diagram of a contact apparatus of one embodiment according to the present invention.

Hereinafter, the embodiment and modifications according to the present invention are described with reference to drawings.

Embodiment

Hereinafter, a contact apparatus 1 of one embodiment of the present invention is described with reference to drawings. Note that, the contact apparatuses 1 described below are only examples of the present invention. The scope of the present invention is not limited to including only the below embodiment, and the embodiment may be modified in various ways in view of design or the like, provided that it is still inside the scope of the technical concept of the present invention. Further, in the following description, upward, downward, left and right directions shown in FIG. 1 correspond to upward, downward, left and right directions of the contact apparatus 1. In other words, in the following description, the upward and downward direction of the contact apparatus is defined by an axial direction of a shaft 23 described later. The upward direction of the contact apparatus is defined by a direction from the shaft 23 to a holder 24 described later, and the downward direction of the contact apparatus is defined by a direction from the shaft 23 to a movable member 21 described later. In other expression, in the following, the upward and downward direction of the contact apparatus is defined by a direction in which a fixed contact 10 and a movable contact 11 face each other. The upward direction of the contact apparatus is defined as a direction from the movable contact 11 to the fixed contact 10, and the downward direction of the contact apparatus is defined as a direction from the fixed contact 10 to the movable contact 11. Note that, there is no intent to limit how to place the contact apparatus 1 by the definition of the above directions.

In examples according to the present embodiment, as shown in FIG. 1, the contact apparatus 1 constitutes an electromagnetic apparatus 2 and an electromagnetic relay 3. However, the contact apparatus 1 may constitute a breaker, a switch, or the like, instead of the electromagnetic relay 3. In the present embodiment, for example, the electromagnetic relay 3 is provided to an electric vehicle (EV). The electromagnetic relay 3 is used so that the contact apparatus 1 is electrically interposed in a path for supplying DC power from a driving battery to a load (e.g., an inverter).

FIG. 1 shows a schematic configuration diagram of the contact apparatus 1 of the present embodiment. The contact apparatus 1 of the present embodiment includes: a pair of fixed contacts 10, a pair of movable contacts 11, a pair of contact bases 100 and 101 individually supporting the fixed contacts 10, and a movable contact member 12 supporting the movable contacts 11. Further, in the contact apparatus 1 of the present embodiment, the fixed contacts 10 and the movable contacts 11 constitute contact units 6, and the contact apparatus 1 of the present embodiment includes a receptacle 13 accommodating the contact units 6 (the fixed contacts 10 and the movable contacts 11) and an arc extinguishing member 14 described later. Note that, FIG. 1 shows the electromagnetic relay 3 constituted by the contact apparatus 1 of the present embodiment and the electromagnetic apparatus 2 placed below the contact apparatus 1. However, the electromagnetic apparatus 2 is excluded from components of the contact apparatus 1. Further, the contact apparatus 1 is not limited to a component of the electromagnetic relay 3.

The contact apparatus 1 includes the pair of fixed contacts 10 and the pair of movable contacts 11. In a state where the contact apparatus 1 is closed, the pair of contact bases 100 and 101 are electrically connected (the conducting path therebetween is made) through the movable contact member 12. The contact apparatus 1 is connected to the battery and the load respectively at the pair of contact bases 100 and 101 so as to allow supply of DC power from the driving battery to the load through the movable contact member 12 in the closed state. Note that, it is only required that the contact apparatus 1 is connected in series with the load between output terminals of the battery, and therefore may be electrically connected between a negative electrode (minus electrode) of the battery and the load.

The pair of contact bases 100 and 101 are made (formed) of an electrically conductive material, and have a solid cylindrical shape having a lengthwise direction along the upward and downward direction. In other words, the pair of contact bases 100 and 101 are formed to have a solid cylindrical shape whose section is circular in a plane perpendicular to the upward and downward direction. The pair of contact bases 100 and 101 are arranged side by side in one direction (the left and right direction in FIG. 1) in a plane perpendicular to the upward and downward direction. Further, the pair of contact bases 100 and 101 are provided at their lower ends with the fixed contacts 10. The pair of contact bases 100 and 101 are bonded to the receptacle 13 so that the pair of contact bases 100 and 101 are inserted into (pass through) individually a pair of circular holes 133 formed in an upper wall 130 (described later) of the receptacle 13.

The movable contact member 12 is made of an electrically conductive material, and has a rectangular plate shape having a lengthwise direction along the left and right direction. The movable contact member 12 is placed below the pair of contact bases 100 and 101 so that opposite ends of the movable contact member 12 in the lengthwise direction face individually lower ends of the pair of contact bases 100 and 101. The movable contacts 11 are provided to parts of the movable contact member 12 which face the fixed contacts 10 provided to the contact bases 100 and 101, respectively.

The movable contact member 12 is held by the holder 24 described later, in the receptacle 13, and is moved in the upward and downward direction together with the holder 24 by the electromagnetic apparatus 2 placed below the receptacle 13. Accordingly, the movable contacts 11 provided to the movable contact member 12 are movable between the closed positions where the movable contacts 11 are in contact with the fixed contacts 10 corresponding to (facing) the movable contacts 11 and the open positions where the movable contacts 11 are in separate from the fixed contacts 10. While the movable contacts 11 are in the closed positions, which means a state in which the contact apparatus 1 is closed, the pair of contact bases 100 and 101 are electrically connected through the movable contacts 11 and the movable contact member 12. Accordingly, in the state where the contact apparatus 1 is closed, the conducting path between the pair of contact bases 100 and 101 is made, and this allows supply of DC power from the driving battery to the load. Further, while the movable contacts 11 are in the open positions, which means a state where the contact apparatus 1 is opened, the pair of contact bases 100 and 101 are not electrically connected.

The receptacle 13 has a box shape and is made of a heat resistant material such as ceramic including aluminum oxide (alumina), silicon carbide (SiC), aluminum nitride, and the like. The receptacle 13 includes the upper wall 130 and a lower wall 131 which face each other in the upward and downward direction, and further includes a side wall 132 interconnecting peripheries of the upper wall 130 and the lower wall 131. The receptacle 13 has a hermetically enclosed space in its inside, and accommodates the fixed contacts 10, the movable contacts 11, and the arc extinguishing member 14. Note that, the receptacle 13 is not limited to having such a hermetically enclosed space in its inside. Alternatively, the receptacle 13 may be constituted by a case (not shown), a yoke plate (not shown), and a connection member (not shown), for example. The case has a box shape with an open lower face, and is made of a heat resistant material such as ceramic. The yoke plate constitutes part of a yoke described later, and has a rectangular plate shape. The connection member is provided between a surrounding part of an opening of the case and a periphery of an upper face of the yoke plate. The connection member is bonded to each of the surrounding part of the opening of the case and the periphery of the upper face of the yoke plate. In this configuration, the yoke plate defines the lower wall 131 of the receptacle 13. Note that, the receptacle 13 is not limited to being constituted by the case, the yoke plate, and the connection member described above, but may have another configuration for accommodating the fixed contacts 10 and the movable contacts 11.

Note that, it is preferable that a gas with a capacity of extinguishment of an arc (arc extinguishing gas) mainly consisting of hydrogen is sealed in the receptacle 13. In this configuration, if an arc occurs when the movable contacts 11 are moved apart from the fixed contact 10 in the receptacle 13, such an arc is quickly cooled down by the arc extinguishing gas, and as a result the arc can be extinguished quickly. Note that, to seal the arc extinguishing gas in the receptacle 13 is optional.

Next, the electromagnetic apparatus 2 is described. The electromagnetic apparatus 2 includes, a fixed member 20, the movable member 21, a yoke (not shown), an excitation coil 22, the shaft 23, the holder 24, a contact pressure spring 25, and a return spring 26. Note that, the electromagnetic apparatus 2 may optionally include a coil bobbin (not shown) which is made of synthetic resin and holds the excitation coil 22.

The fixed member 20 is a fixed core (core) in a hollow cylindrical shape, and is fixed to the lower wall 131 of the receptacle 13 at its upper end. In other words, the fixed member 20 is a fixed core in a hollow cylindrical shape protruding downward from a center of a lower face of the lower wall 131 of the receptacle 13. The movable member 21 is a movable core (core) in a solid cylindrical shape. The movable member 21 is placed below the fixed member 20 so as to face a lower end face of the fixed member 20 at its upper end face. The movable member 21 is movable in the upward and downward direction between a first position in which the upper end face of the movable member 21 is in contact with the lower end face of the fixed member 20 and a second position in which the upper end face of the movable member 21 is separate from the lower end face of the fixed member 20.

The yoke surrounds the excitation coil 22, so as to form, together with the fixed member 20 and the movable member 21, a magnetic circuit allowing passage of magnetic flux caused when the excitation coil 22 is energized. To achieve this purpose, the yoke, the fixed member 20, and the movable member 21 are each made of a magnetic material. The yoke plate which is part of the yoke may optionally serve as the lower wall 131 of the receptacle 13, as described above.

The excitation coil 22 is situated in a space surrounded by the yoke. In other words, the excitation coil 22 is situated below the receptacle 13 so as to have a central axis direction along the upward and downward direction. Further, the fixed member 20 and the movable member 21 are situated inside the excitation coil 22. In the electromagnetic apparatus 2, when magnetic flux is induced in the excitation coil 22 when the excitation coil 22 is energized, the magnetic flux causes attraction so that the movable member 21 is moved upward. When energization of the excitation coil 22 is stopped, the return spring 26 moves the movable member 21 downward.

The shaft 23 is made of a nonmagnetic material, and is in a circular bar shape with a lengthwise direction along the upward and downward direction (i.e., extending in the upward and downward direction). The shaft 23 transfers a driving force generated by the electromagnetic apparatus 2 to the contact apparatus 1 situated over the electromagnetic apparatus 2. The shaft 23 is inserted into the through hole 134 formed at a center of the lower wall 131 of the receptacle 13, and passes through the fixed member 20 and the return spring 26 so as to be fixed to the movable member 21 at its lower end. The shaft 23 is fixed, at its upper end, to the holder 24 holding the movable contact member 12.

The holder 24 includes an upper plate 240 and a lower plate 241 situated in opposite sides of the movable contact member 12 in the upward and downward direction so as to face each other, and further includes one or more side plates 242 interconnecting peripheries of the upper plate 240 and the lower plate 241. The upper plate 240 and the lower plate 241 each are in a rectangular plate shape. Provided is a pair of side plates 242 individually interconnecting a pair of opposite sides of a lower face of the upper plate 240 and a pair of opposite sides of an upper face of the lower plate 241. The lower plate 241 is fixed to the upper end of the shaft 23 at its center. Accordingly, a driving force generated by the electromagnetic apparatus 2 is transferred to the holder 24 via the shaft 23. Thus, the holder 24 moves in the upward and downward direction with (according to) a movement of the movable member 21 in the upward and downward direction.

The contact pressure spring 25 is situated between the lower plate 241 of the holder 24 and the movable contact member 12, and may be a coil spring for biasing the movable contact member 12 upward. The return spring 26 is situated inside the fixed member 20, and may be a coil spring for biasing the movable member 21 downward.

Note that, the electromagnetic apparatus 2 may optionally include a hollow cylinder (not shown) for accommodating the fixed member 20 and the movable member 21. The hollow cylinder is made of nonmagnetic material and has a circular hollow cylindrical shape with an open top and a closed bottom. The hollow cylinder is fixed to the lower wall 131 of the receptacle 13 at its upper end (vicinity of an opening). The hollow cylinder limits a moving direction of the movable member 21 to the upward and downward direction, and defines the second position of the movable member 21. Additionally, the hollow cylinder may optionally seal the through hole 134 of the receptacle 13 when accommodating the fixed member 20 and the movable member 21. To use the receptacle 13 as an airtight receptacle, it would be desirable that the hollow cylinder is hermetically bonded to the lower face of the lower wall 131. Even if the through hole 134 is formed in the lower wall 131 of the receptacle 13, it is still possible to ensure airtightness of the hermetically enclosed space. In this sense, the hollow cylinder may be considered part of the receptacle 13. Alternatively, the hollow cylinder may not be part of the receptacle 13.

According to the aforementioned configuration, while the excitation coil 22 is not energized (time of no power supply), magnetic attraction is absent between the movable member 21 and the fixed member 20, and therefore the movable member 21 is kept in the second position by a spring force given by the return spring 26. In contrast, when the excitation coil 22 is energized, magnetic attraction is developed between the movable member 21 and the fixed member 20, and therefore, the movable member 21 is attracted upward against the spring force given by the return spring 26, and finally is moved to the first position. As apparent from the above, the electromagnetic apparatus 2 controls attraction acting on the movable member 21 depending on a change in an energization state of the excitation coil 22 to thereby move the movable member 21 in the upward and downward direction so as to produce the driving force for switching the state of the contact apparatus 1 between an open state and a closed state.

The following brief description is made to a basic operation of the electromagnetic relay 3 including the contact apparatus 1 of the present embodiment.

Initially, a state of the electromagnetic relay 3 while the excitation coil 22 is not energized is described. In this state, the movable member 21 of the electromagnetic apparatus 2 is in the second position. Thus, the holder 24 is drawn down by the electromagnetic apparatus 2 via the shaft 23. In this situation, the holder 24 presses the movable contact member 12 downward by its upper plate 240. Hence, the movable contact member 12 is restricted from moving upward by the upper plate 240, and thus the pair of movable contacts 11 are kept in the open positions where they are separated from the pair of fixed contacts 10. In this state, the contact apparatus 1 is opened, and the pair of contact bases 100 and 101 are not electrically interconnected (the conducting path therebetween is broken).

Next, a state of the electromagnetic relay 3 while the excitation coil 22 is energized is described. In this state, the movable member 21 of the electromagnetic apparatus 2 is in the first position. Thus, the holder 24 is drawn up by the electromagnetic apparatus 2 via the shaft 23. Thus, the upper plate 240 of the holder 24 is moved upward, and the movable contact member 12 is no longer restricted from moving upward by the upper plate 240. The movable contact member 12 is pressed upward by the lower plate 241 of the holder 24 via the contact pressure spring 25 (i.e., by the spring force of the contact pressure spring 25), and the pair of movable contacts 11 are moved to the closed positions where they are in contact with the pair of fixed contacts 10. In this state, the contact apparatus 1 is closed, and the pair of contact bases 100 and 101 are electrically interconnected (the conducting path therebetween is made). In this situation, the shaft 23 is pressed upward even after the pair of movable contacts 11 comes into contact with the pair of fixed contacts 10, in order to realize overtravel of the shaft 23. The movable contact member 12 is biased upward by the contact pressure spring 25, and thus it is possible to ensure contact pressure (touch pressure) of the pair of movable contacts 11 against the pair of fixed contacts 10.

When the movable contact 11 separates from the fixed contact 10, there is a probability of occurrence of an arc between the fixed contact 10 and the movable contact 11. In view of this, in the contact apparatus 1 of the present embodiment, the arc extinguishing member 14 for discharging the arc extinguishing gas offering a capacity for extinguishment of an arc is situated in a space 13A which is the same as the space where the fixed contact 10 and the movable contact 11 are present. In the contact apparatus 1 of the present embodiment, the arc extinguishing member 14 discharges the arc extinguishing gas when heated. In detail, as shown in FIG. 1, the arc extinguishing member 14 is situated to an inner face of the right wall of the receptacle 13 so as to be close to the fixed contact 10 and the movable contact 11 on the right side. The arc extinguishing member 14 is made of a hydrogen absorbing alloy which has absorbed hydrogen, for example, and therefore has a property of quickly desorbing absorbed hydrogen (the arc extinguishing gas) when heated.

When an arc occurs between the fixed contact 10 and the movable contact 11, heat from the arc is transferred to the arc extinguishing member 14 via a gas inside the receptacle 13, and thereby the arc extinguishing member 14 is heated, and accordingly the arc extinguishing member 14 discharges the arc extinguishing gas (hydrogen). This arc extinguishing gas rapidly cools down the arc and therefore enables quick extinguishment of an arc. Moreover, the arc extinguishing member 14 is situated close to the fixed contact 10 and the movable contact 11, and thus the arc extinguishing gas which is vigorously discharged from the arc extinguishing member 14 blows against the arc, and this may lead to facilitation of extinguishment of an arc. Note that, the arc extinguishing member 14 is not required to discharge the arc extinguishing gas only when an arc occurs. For example, the arc extinguishing member 14 may optionally still discharge the arc extinguishing gas even if an arc does not occur.

As described above, the contact apparatus 1 of the present embodiment would include at least one fixed contact 10, at least one movable contact 11, and the arc extinguishing member 14. The at least one movable contact 11 is movable between the closed position where the at least one movable contact 11 is in contact with the at least one fixed contact 10 and the open position where the at least one movable contact 11 is separate from the at least one fixed contact 10. The arc extinguishing member 14 is to discharge, when heated, the arc extinguishing gas (hydrogen) offering a capacity of extinguishment of an arc, into the space containing the at least one fixed contact 10 and the at least one movable contact 11.

Accordingly, if an arc occurs when the movable contact 11 separates from the fixed contact 10, the contact apparatus 1 of the present embodiment can extinguish such an arc quickly by the arc extinguishing member 14.

Note that, a component of the arc extinguishing gas discharged from the arc extinguishing member 14 may not be limited to hydrogen but may be nitrogen or the like. Further, material of the arc extinguishing member 14 may not be limited to a hydrogen absorbing alloy but may be material which discharges the arc extinguishing gas when heated. For example, the arc extinguishing member 14 may be made of a resin material such as a phenol resin, a metal material such as hydrogen absorbing metal and titanium hydride (TiH), or an inorganic material such as boric acid. Moreover, the arc extinguishing member 14 may not be limited so as to discharge the arc extinguishing gas when heated. In other words, the arc extinguishing member 14 may discharge the arc extinguishing gas even when not heated.

FIG. 1 shows the contact apparatus 1 including the single arc extinguishing member 14, but the contact apparatus may be modified to include two or more arc extinguishing members 14. For example, another arc extinguishing member 14 may be situated close to the fixed contact 10 and the movable contact 11 on the left side. Further, the arc extinguishing member 14 may not be limited so as to have a size shown in FIG. 1.

Additionally, improvement of airtightness of a space formed inside the receptacle 13 may cause an increase in a hydrogen concentration of the inside of the receptacle 13 when arcs occur. Therefore, the performance of extinguishment of an arc can be more improved. Moreover, to improve the performance of extinguishment of an arc, hydrogen may be sealed in the receptacle 13 in advance.

Figure 2:
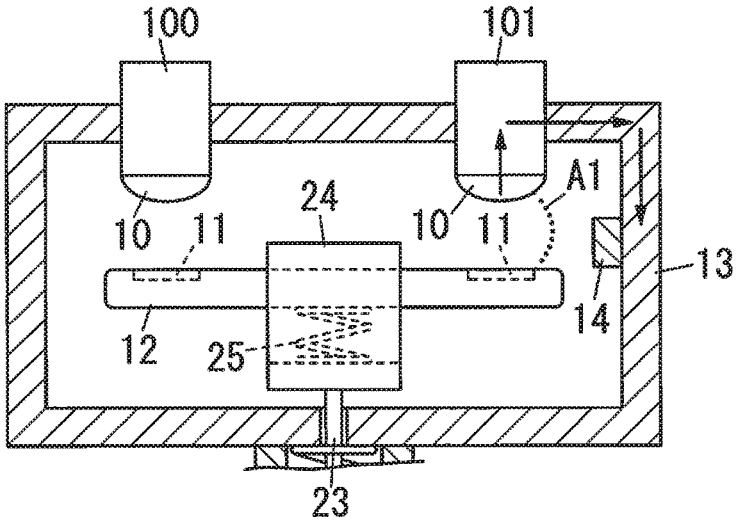
FIG. 2 is a schematic diagram of a path of transfer of heat in the contact apparatus of the embodiment.

FIG. 2 shows 'A1' which designates an arc occurring between the fixed contact 10 and the movable contact 11. When an arc occurs between the fixed contact 10 and the movable contact 11, the arc heats the fixed contact 10 and the contact base 101. The contact base 101 and the receptacle 13 are bonded to each other, and therefore, in the case of the receptacle 13 being made of a thermally conductive material, heat of the contact base 101 is transferred to the arc extinguishing member 14 through the receptacle 13, and thus the arc extinguishing member 14 is heated. As described above, the arc extinguishing member 14 can be heated through a structure constituted by the fixed contact 10, the contact base 101, and the receptacle 13 which are necessary for the contact apparatus 1, without providing any additional member. In other words, the arc extinguishing member 14 is heated through a structure having thermally conductivity. In particular, the contact apparatus 1 of the present embodiment includes the receptacle 13 which encloses the fixed contact 10, the movable contact 11, and the arc extinguishing member 14 and is provided at its inner face with the arc extinguishing member 14. Further, the structure includes the receptacle 13. Therefore, the arc extinguishing member 14 may be heated through not only a gas inside the receptacle 13 but also a structure with thermally conductivity (the fixed contact 10, the contact base 101, and the receptacle 13). Accordingly, the arc extinguishing member 14 is heated more quickly, and thus discharges the arc extinguishing gas, and this may lead to quicker extinguishment of an arc. Note that, the structure may be constituted by at least one of the fixed contact 10, the contact base 101, and the receptacle 13. Further, to improve an efficiency of transfer of heat to the arc extinguishing member 14, it is preferable that the fixed contact 10, the contact base 101, and the receptacle 13 may be made of material with high thermal conductivity.

Figure 3:
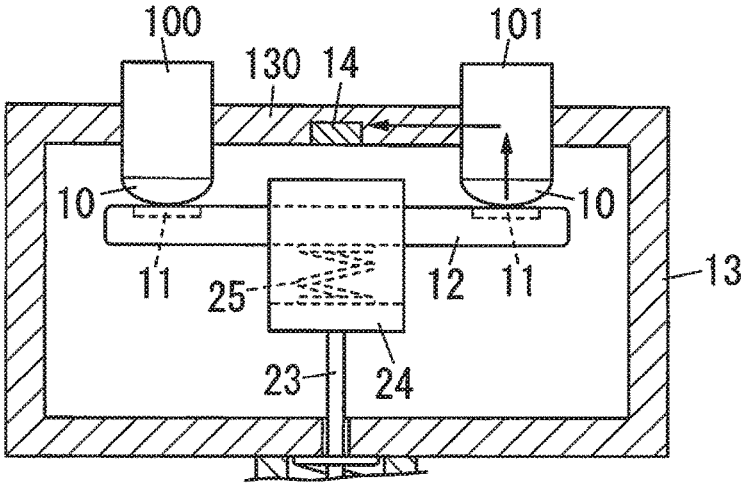
FIG. 3 is a schematic diagram of a path of transfer of heat in a contact apparatus of the embodiment.

While the movable contact member 12 is in the closed position, a current flows between the pair of contact bases 100 and 101 through the fixed contact 10, the movable contact 11, and the movable contact member 12, and this may lead to generation of Joule heat. This Joule heat would be transferred to the arc extinguishing member 14 through the receptacle 13, and thus the arc extinguishing member 14 can be heated in advance (heated). In summary, the arc extinguishing member 14 is heated in advance by the Joule heat generated by a current flowing while the movable contact 11 is in the closed position. In this configuration, the arc extinguishing member 14 is preliminarily heated while the conducting path is made (during the closed state), and therefore the arc extinguishing gas can be discharged quickly in response to occurrence of an arc and thus it is possible to extinguish arcs more quickly. Further, the arc extinguishing member 14 is not limited so as to be placed in the above location, but the arc extinguishing member 14 may be, as shown in FIG. 3, embedded in the upper wall 130 of the receptacle 13 so as to be placed between the pair of the contact bases 100 and 101. In this arrangement, the Joule heat would be transferred to the arc extinguishing member 14 from the pair of contact bases 100 and 101 efficiently, and this may lead to an increase in effect of preliminarily heating. Alternatively, the arc extinguishing member 14 may be provided between the pair of movable contacts 11 on the movable contact member 12, and also this may lead to efficient transfer of Joule heat to the arc extinguishing member 14. In these cases, it is possible to preliminarily heat the arc extinguishing member 14 with the Joule heat generated while the conducting path is made, and therefore it is not necessarily to provide the arc extinguishing member 14 in a vicinity of a place where arcs would occur. Consequently, this may lead to improvement of a degree of arrangement of the arc extinguishing member 14.

Note that, the contact apparatus 1 of the present embodiment constitutes the electromagnetic relay 3 in combination with the electromagnetic apparatus 2 which is a plunger type to linearly reciprocate the movable member 21. Alternatively, the contact apparatus 1 of the present embodiment may constitute an electromagnetic relay 5 in combination with the electromagnetic apparatus 4 of a hinge type. The electromagnetic relay 5 is briefly described with reference to FIG. 4A and FIG. 4B.

Figure 4A:
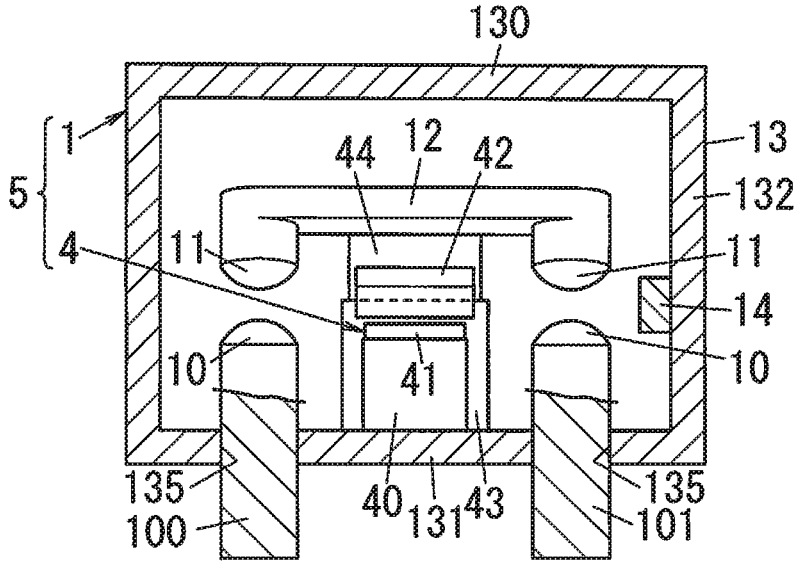
FIG. 4A and FIG. 4B are schematic configuration diagrams of an electromagnetic relay including the contact apparatus of the embodiment and a hinged electromagnetic apparatus.
Figure 4B:
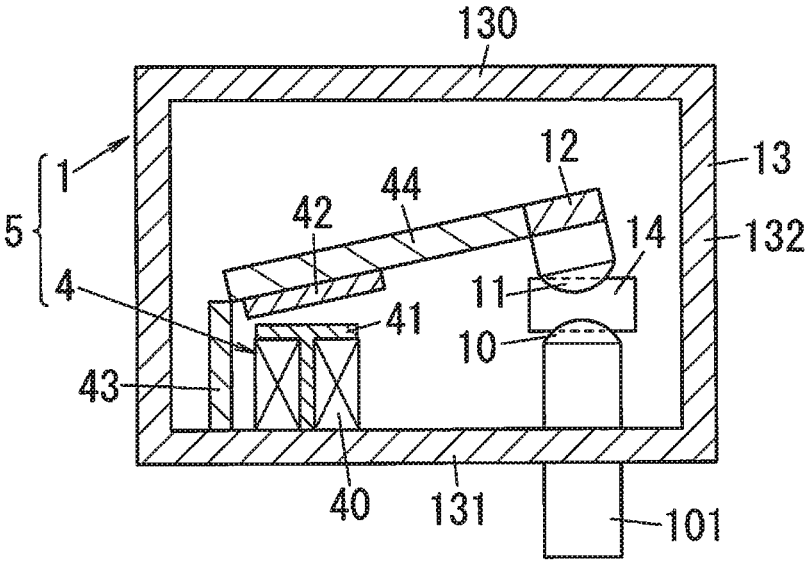

As shown in FIG. 4A and FIG. 4B, the electromagnetic apparatus 4 includes an excitation coil 40, a fixed member 41, a movable member 42, a support 43, and an armature 44, and is provided (situated) inside the receptacle 13. The fixed member 41 is a fixed iron core in a circular cylindrical shape. The fixed member 41 has its upper end part which is larger in a dimension in a diameter direction than a part other than the upper end part. The fixed member 41 is situated inside the excitation coil 40, and faces the movable member 42 in the upward and downward direction. The movable member 42 is made of a magnetic material in a rectangular plate shape, and is provided to the movable contact member 12 so as to face the upper end part of the fixed member 41. The support 43 supports one end of the armature 44 in a lengthwise direction.

The armature 44 is in a rectangular shape and is provided at its lower face with the movable member 42.

The armature 44 is supported on the support 43 fixed to the receptacle 13 at its base end, and is provided with the movable contact member 12 at its top end. In other words, the armature 44 is a long narrow plate shape, and interconnects the upper end part of the support 43 and a central part of the movable contact member 12 in a lengthwise direction. The armature 44 is designed to be rotatable so that the top end moves in the upward and downward direction while the base end acts as a fulcrum point. Note that, the armature 44 is provided with a return spring (not shown) for biasing upward the top end of the armature 44 (i.e., biasing the movable contact member 12 from the closed position to the open position.

The movable contact member 12 is provided to the top end of the armature 44. In other words, the movable contact member 12 is directly coupled to the top end of the armature 44. The movable contact member 12 moves, with rotation of the armature 44, between a first position (closed position) in which the movable contacts 11 are in contact with the respective fixed contacts 10 and a second position (open position) in which the movable contacts 11 are separate from the respective fixed contacts 10. Further, the pair of contact bases 100 and 101 are bonded to the receptacle 13 so as to pass through circular holes 135 formed in the lower wall 131 of the receptacle 13, and are provided at their upper end with the fixed contacts 10.

When the excitation coil 40 is energized, magnetic flux developed by the excitation coil 40 attracts the movable member 42 to the fixed member 41, and therefore the movable contact member 12 is moved to the first position. Accordingly, the pair of contact bases 100 and 101 are electrically interconnected by the movable contact member 12, and the conducting path between the pair of contact bases 100 and 101 is made. In summary, the contact apparatus 1 is closed. When energization to the excitation coil 40 is stopped, the movable contact member 12 is moved (returned) to the second position by the spring force given by the return spring. Accordingly, the pair of contact bases 100 and 101 are not electrically interconnected (the conducting path therebetween is broken). In summary, the contact apparatus is opened.

Also in this electromagnetic relay 5, as shown in FIG. 4A and FIG. 4B, it is preferable that the arc extinguishing member 14 be provided to an inner wall of the receptacle 13 so as to be close to the fixed contact 10 and the movable contact 11. Since the arc extinguishing member 14 is provided in the above manner, it is possible to quickly extinguish arcs occurring between the fixed contacts 10 and the movable contacts 11.

(Modification 1)

Figure 5A:
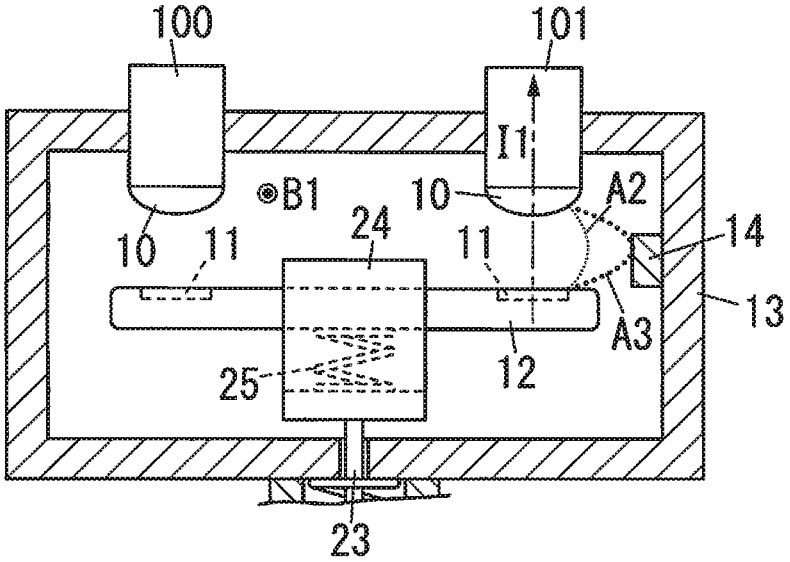
FIG. 5A and FIG. 5B are schematic configuration diagrams of a contact apparatus of Modification 1.
Figure 5B:
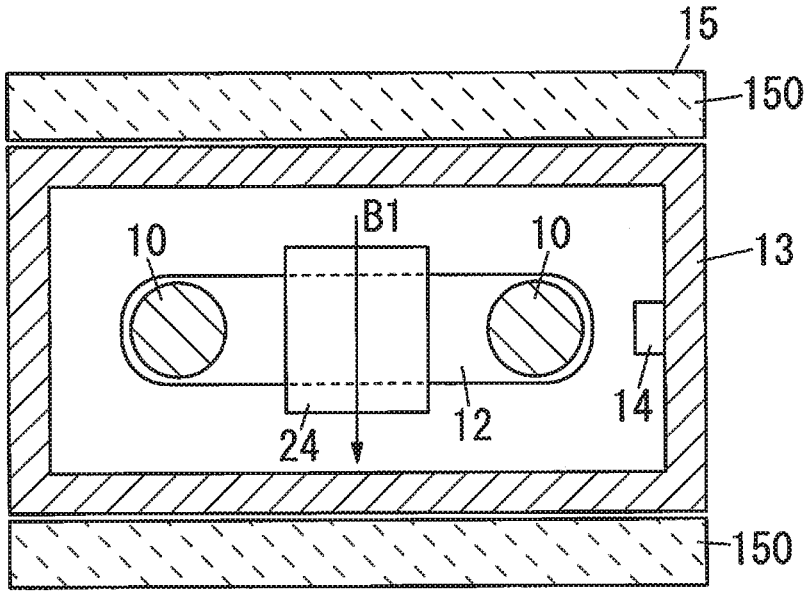

FIG. 5A and FIG. 5B are schematic configuration diagrams of the contact apparatus 1 of Modification 1 of the present embodiment. The contact apparatus 1 of the present modification includes a magnetic field generator 15 for causing a magnetic field inside a space (the space 13A (shown in FIG. 1) inside the receptacle 13) including the fixed contact 10 and the movable contact 11, in addition to the components of the contact apparatus 1 of the embodiment. Other components of the present modification are the same as those of the embodiment, and the same components as the embodiment are designated by the same reference signs to avoid redundant explanations. Note that, FIG. 5B is a section of the contact apparatus 1 viewed from the upper side, and in the following explanation, an upward and downward direction of FIG. 5B corresponds to a forward and rearward direction of the modification.

The magnetic field generator 15 is constituted by a pair of magnets 150, which are situated so that the receptacle 13 is present between the magnets 150 in the forward and rearward direction. The magnetic field generator 15 generates a magnetic field B1 which extends from a front side to a rear side of a space inside the receptacle 13 (from a far side to a near side with regard to the sheet of FIG. 5A).

For example, when an arc occurs between the movable contact 11 and the fixed contact 10 on the right side, a current I1 may flow from the movable contact 11 to the fixed contact 10 through the arc. In this situation, the magnetic field B1 is applied to the arc and then a Lorentz force is caused, and such a Lorentz force extends the arc to the right side. Note that, In FIG. 5A, an arc which is under application of the magnetic field B1 is designated by "A3", and an arc which is not under application of the magnetic field B1 is designated by "A2". As apparent from the above, generating the magnetic field B1 to extend the arc can lead to extinguishment of the arc. Further, as shown in FIG. 5A and FIG. 5B, the arc extinguishing member 14 is situated on a side to which an arc is extended by the magnetic field B1. Therefore, even if the arc still exists after being extended, the arc will come into contact with the arc extinguishing member 14. As a result, the arc extinguishing member 14 is heated rapidly, and thereby the arc extinguishing gas is discharged rapidly. This leads to extinguishment of the arc. Apparently, the contact apparatus 1 of the present modification includes the magnetic field generator 15 and thereby the performance of extinguishment of an arc can be improved.

Note that, the magnetic field generator 15 may be situated inside the receptacle 13. The magnetic field generator 15 is not limited to being constituted by the magnets 150 but may be made of other magnetic material. Further in the present modification, the magnetic field generator 15 is provided as a separate part, but may be realized by the other component. For example, the receptacle 13 and the arc extinguishing member 14 may be made of a magnetic material.

Note that, other components and functions are the same as those of the embodiment.

(Modification 2)

Figure 6A:
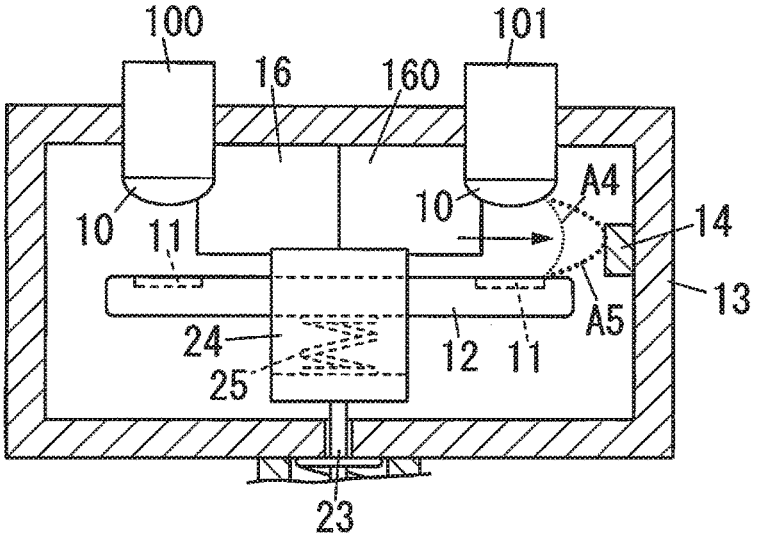
FIG. 6A and FIG. 6B are schematic configuration diagrams of a contact apparatus of Modification 2.
Figure 6B:
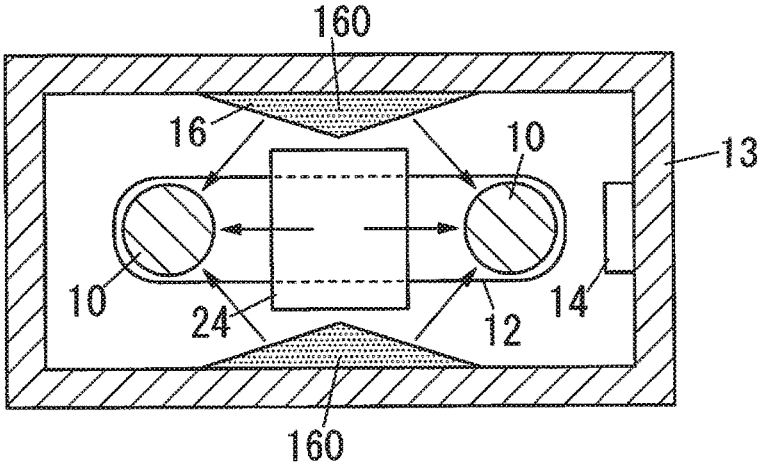

FIG. 6A and FIG. 6B are schematic configuration diagrams of the contact apparatus 1 of Modification 2 of the present embodiment. The contact apparatus 1 of the present modification includes a gas flow generator 16 for causing a flow of gas inside a space (the space 13A inside the receptacle 13) including the fixed contact 10 and the movable contact 11, in addition to the components of the contact apparatus 1 of the embodiment. Other components of the present modification are the same as those of the embodiment, and the same components as the embodiment are designated by the same reference signs to avoid redundant explanations. Note that, FIG. 6B is a section of the contact apparatus 1 viewed from the upper side, and in the following explanation, an upward and downward direction of FIG. 6B corresponds to a forward and rearward direction of the modification.

The gas flow generator 16 is constituted by protrusions 160 protruding inward from centers in the left and right direction of a front wall and a rear wall of the receptacle 13. The protrusions 160 each have a section which is triangular when viewed from the upper side, and continuously extend downward from upper ends of the front end and the rear wall of the receptacle 13. Due to the protrusions 160, the dimension in the forward and rearward direction of the space inside the receptacle 13 is the narrowest at the center in the left and right direction and becomes greater towards the opposite left and right ends than at the center in the left and right direction. Note that, the shape of the protrusion 160 is not limited so that a section viewed from the upper side is triangular, but may be such a shape that the dimension in the forward and rearward direction of the space inside the receptacle 13 is the narrowest at the center in the left and right direction. For example, the protrusion 160 may have a section which is semicircular when viewed from the upper side. Optionally, the protrusion 160 may be formed integrally with the receptacle 13.

When an arc occurs between the fixed contact 10 and the movable contact 11, heat of the arc causes an increase in a pressure inside the receptacle 13. In this situation, a pressure inside the receptacle 13 becomes highest at the center in the left and right direction which is narrowest in the forward and rearward direction, and therefore flows of gas from the center in the left and right direction to opposite ends in the left and right direction may occur. The flows of gas blow against the arc. Note that, in FIG. 6A, an arc blown by the flow of gas is designated by 'A5', and an arc not blown by the flow of gas is designated by 'A4'. When the arc is blown by the flow of gas, the arc can be extended and thereby extinguished. As shown in FIG. 6A and FIG. 6B, when the arc extinguishing member 14 is present on a downstream side of the flow of gas, heat of the arc is efficiently transferred to the arc extinguishing member 14, and thus the arc extinguishing member 14 can be heated efficiently. When the arc is blown by the flow of gas and thereby comes into contact with the arc extinguishing member 14, the arc extinguishing member 14 is heated rapidly. As a result, the arc extinguishing gas is discharged rapidly from the arc extinguishing member 14, and thus the arc can be extinguished. Apparently, the contact apparatus 1 of the present modification includes the gas flow generator 16, and thereby the performance of extinguishment of an arc can be improved.

Note that, the flow of gas depends on a position, a size, and the like of the protrusion 160, and therefore it is possible to independently determine the position of the arc extinguishing member 14 and the timing at which the flow of gas comes into contact with an arc. For example, it is possible to cause a flow of gas to generate the arc extinguishing gas only when an arc occurs.

Figure 7A:
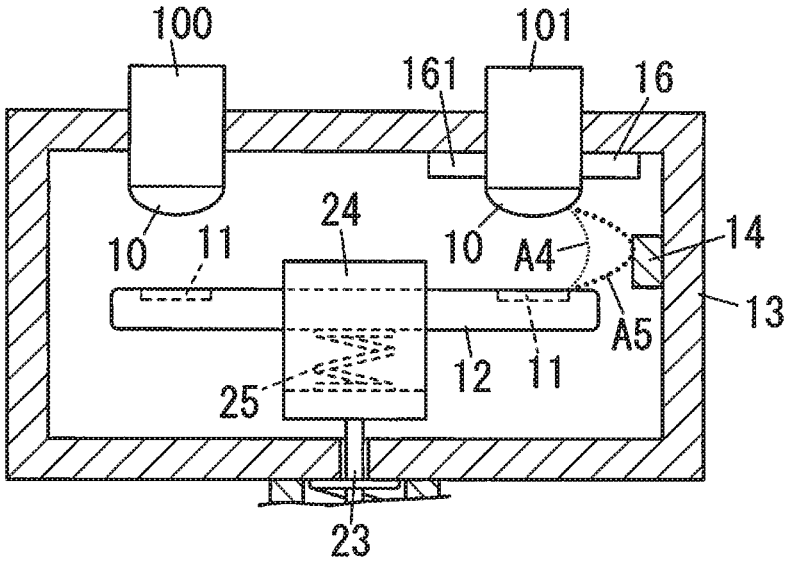
FIG. 7A and FIG. 7B are schematic configuration diagrams of a contact apparatus of a modified structure of Modification 2.
Figure 7B:
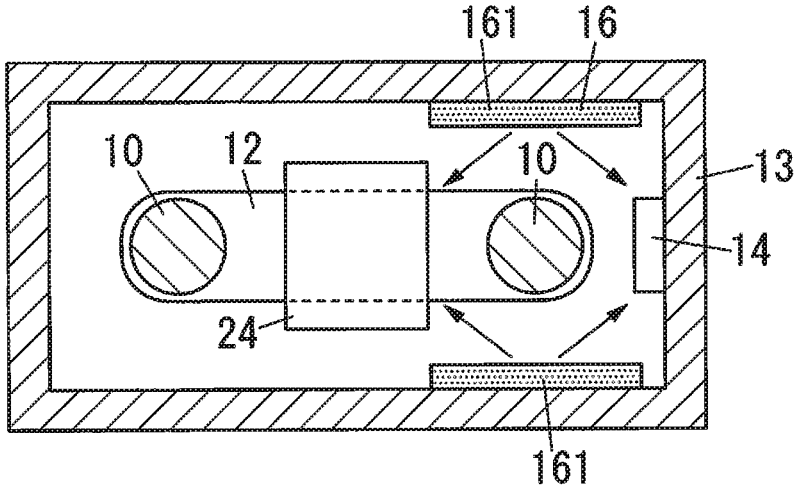

Note that, how the gas flow generator 16 causes a flow of gas is not limited to the aforementioned manner. For example, the gas flow generator 16 may be constituted by gas generation materials 161 which have a property of discharging a gas when heated. In summary, the gas flow generator 16 may be designed to discharge a gas to cause a flow of gas when heated. FIG. 7A and FIG. 7B are schematic configuration diagrams of the contact apparatus 1 including the gas generation material 161. Note that, FIG. 7B is a section of the contact apparatus 1 viewed from the upper side, and in the following explanation, an upward and downward direction of FIG. 7B corresponds to a forward and rearward direction of the modification.

The gas generation materials 161 are situated on the upper ends of the front wall and the rear wall of the receptacle 13 so as to face each other in the forward and rearward direction of the contact base 101. The gas generation material 161 discharges a gas when heated, thereby causing a flow of gas. In the present modification, the gas generation material 161 is made of boric acid, and therefore discharges water vapor when heated. Note that, the material of the gas generation material 161 is not limited to boric acid, but may be another material.

When an arc occurs between the fixed contact 10 and the movable contact 11, the gas generation materials 161 are heated by the arc, and thereby discharge gases to cause flows of gas. The flows of gas blow against the arc, and thereby the arc can be extended and then extinguished. As shown in FIG. 7A and FIG. 7B, when the arc extinguishing member 14 is present on a downstream side of the flow of gas, heat of the arc is efficiently transferred to the arc extinguishing member 14, and thus the arc extinguishing member 14 can be heated efficiently. When the arc is blown by the flow of gas and thereby comes into contact with the arc extinguishing member 14, the arc extinguishing member 14 is heated rapidly. As a result, the arc extinguishing gas is discharged rapidly from the arc extinguishing member 14, and thus the arc can be extinguished.

Note that, the flow of gas depends on a position, a material, a size, and the like of the gas generation material 161, and therefore it is possible to independently determine the position of the arc extinguishing member 14 and the timing at which the flow of gas comes into contact with an arc. For example, it is possible to cause a flow of gas to generate the arc extinguishing gas only when an arc occurs.

Note that, it is preferable that, when an arc occurs, the gas generation material 161 discharge a gas earlier than the arc extinguishing member 14 discharges the arc extinguishing gas. Additionally, a gas to be discharged from the gas generation material 161 preferably has a property of extinguishment of an arc. Moreover, it is preferable that the gas generation material 161 discharges few amount of a gas in a normal state where an arc has not occurred yet.

Note that, other components and functions are the same as those of the embodiment. Optionally, the configuration of the present modification may be combined with the configuration of Modification 1.

(Modification 3)

The contact apparatus 1 of Modification 3 of the present embodiment includes a highly thermally conductive gas which is higher in thermal conductivity than air is sealed in the receptacle 13, in addition to the components of the contact apparatus 1 of the present embodiment. In more detail, the contact apparatus 1 of the present modification includes the receptacle 13 surrounding the fixed contact 10, the movable contact 11, and the arc extinguishing member 14. The highly thermally conductive gas higher in thermal conductivity than air is included in an inside space (the space 13A) of the receptacle 13. Note that, other components of the present modification are the same as those of the embodiment, and the same components as the embodiment are designated by the same reference signs to avoid redundant explanations.

The highly thermally conductive gas is a gas has thermal conductivity higher than that of air. In the present modification, the highly thermally conductive gas is hydrogen.

When an arc occurs, heat of the arc is transferred to the arc extinguishing member 14 through the highly thermally conductive gas. Therefore, an efficiency of transfer of heat to the arc extinguishing member 14 can be improved. Thus, the arc extinguishing member 14 is heated more rapidly, and then discharges the arc extinguishing gas. This can lead to quick extinguishment of an arc. Further, in the present modification, hydrogen serving as the highly thermally conductive gas is sealed in the receptacle 13, and hence an effect of extinguishment of an arc derived from hydrogen can be expected as described above.

Apparently, in the contact apparatus 1 of the present modification, the highly thermally conductive gas is sealed in the receptacle 13, and therefore the performance of extinguishment of an arc can be improved. With regard to how to heat the arc extinguishing member 14, the arc extinguishing member 14 is mainly heated through the highly thermally conductive gas in the receptacle 13, rather than an arc comes into contact with the arc extinguishing member 14. Therefore, it is possible to prevent transfer of an arc to the arc extinguishing member 14, and thus damage of the arc extinguishing member 14 can be suppressed.

Note that, the highly thermally conductive gas is not limited to hydrogen but may be a nitrogen gas or a mixed gas obtained by mixing different gasses. The highly thermally conductive gas is not limited to a gas inherently having highly thermal conductivity, but may be a gas made to have highly thermal conductivity as a result of an increase in an inner pressure of the receptacle 13.

Note that, other components and functions are the same as those of the embodiment. Optionally, the configuration of the present modification may be combined with at least one of the configurations of Modifications 1 and 2.

(Modification 4)

Figure 8:
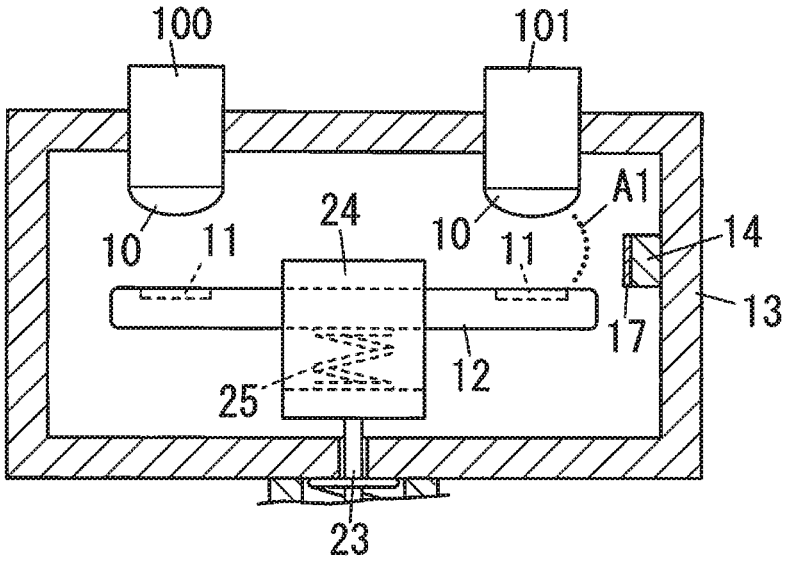
FIG. 8 is schematic configuration diagrams of a contact apparatus of Modification 4.

FIG. 8 is a schematic configuration diagram of the contact apparatus 1 of Modification 4 of the present embodiment. The contact apparatus 1 of the present modification includes a radiative heat absorption member 17 having relatively high absorptance of radiative heat, in addition to the components of the contact apparatus 1 of the embodiment. Other components of the present modification are the same as those of the embodiment, and the same components as the embodiment are designated by the same reference signs to avoid redundant explanations.

The radiative heat absorption member 17 is made of a material higher in absorptance of radiative heat than the arc extinguishing member 14, and is a black object like a black body in the present modification. The radiative heat absorption member 17 is provided on a surface of the arc extinguishing member 14. In summary, in the contact apparatus 1 of the present modification, the radiative heat absorption member 17 which is higher in absorptance of radiative heat than the arc extinguishing member 14 is provided to the arc extinguishing member 14.

When an arc occurs, the radiative heat absorption member 17 absorbs radiative heat from the arc efficiently, and transfers (moves) the heat to the arc extinguishing member 14. Accordingly, the arc extinguishing member 14 is heated more rapidly to thereby discharge the arc extinguishing gas, and thus this leads to quick extinguishment of an arc. Obviously, the contact apparatus 1 of the present modification includes the radiative heat absorption member 17, and this can lead to improvement of the performance of extinguishment of an arc.

Note that, to allow the radiative heat absorption member 17 to absorb a more amount of radiative heat, the radiative heat absorption member 17 is preferably situated in a position which is closer to the fixed contact 10 and the movable contact 11 than the arc extinguishing member 14, that is, in a vicinity of an arc to occur.

Note that, the radiative heat absorption member 17 is not limited to the black object, but may be a coating of black paint on the surface of the arc extinguishing member 14. It is sufficient that the radiative heat absorption member 17 is made of a material higher in absorptance of radiative heat than the arc extinguishing member 14, and therefore a color, a shape, and a quality of material of the radiative heat absorption member 17 are not limited.

Note that, other components and functions are the same as those of the embodiment. Optionally, the configuration of the present modification may be combined with at least one of the configurations of Modifications 1 to 3.

(Modification 5)

Figure 9:
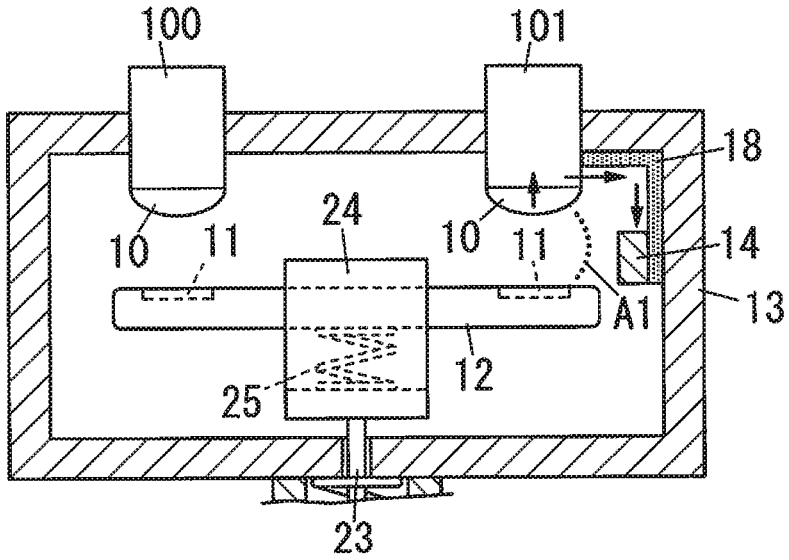
FIG. 9 is schematic configuration diagram of a contact apparatus of Modification 5.

FIG. 9 is a schematic configuration diagram of the contact apparatus 1 of Modification 5 of the present embodiment. The contact apparatus 1 of the present modification includes a thermally conductive member 18 for transfer heat of the fixed contact 10 to the arc extinguishing member 14, in addition to the components of the contact apparatus 1 of the embodiment. Other components of the present modification are the same as those of the embodiment, and the same components as the embodiment are designated by the same reference signs to avoid redundant explanations.

The thermally conductive member 18 is made of a material having relatively high thermal conductivity. In the present modification, the thermally conductive member 18 is made of copper (Cu). The thermally conductive member 18 extends along inner faces of the upper wall 130 and the right wall of the receptacle 13 so as to have one end in contact with the contact base 101 and the other end having a left face on which the arc extinguishing member 14 is provided. In short, the contact apparatus 1 of the present modification, the arc extinguishing member 14 is heated through a structural object having thermal conductivity. Further, the contact apparatus 1 of the present modification includes the receptacle 13 which surrounds the fixed contact 10, the movable contact 11, and the arc extinguishing member 14 and has the internal face where the arc extinguishing member 14 is provided. The structural object includes the thermally conductive member 18 which is provided to the receptacle 13 so as to transfer heat of the fixed contact 10 to the arc extinguishing member 14. Note that, the thermally conductive member 18 may interconnect the fixed contact 10 and the arc extinguishing member 14.

When an arc occurs, the fixed contact 10 is heated by the arc. In this case, heat of the fixed contact 10 is transferred to the arc extinguishing member 14 through a structural object constituted by the contact base 101 and the thermally conductive member 18. Accordingly, the arc extinguishing member 14 is heated more rapidly to thereby discharge the arc extinguishing gas, and this can lead to quick extinguishment of an arc. Apparently, the contact apparatus 1 of the present modification includes the thermally conductive member 18, and thus the performance of extinguishment of an arc can be improved.

Note that, a material of the thermally conductive member 18 is not limited to copper, but may be metal such as highly thermally conductive stainless steel (SUS), ceramics, silicon carbide (SiC), aluminum oxide (alumina), aluminum nitride, or the like. Optionally, the thermally conductive member 18 may be made of not only a single material but also a mixture containing two or more materials.

Note that, an amount of heat to be transferred to the arc extinguishing member 14 can be controlled by selecting the thermal conductivity by changing a material and a structure of the thermally conductive member 18.

Figure 10:
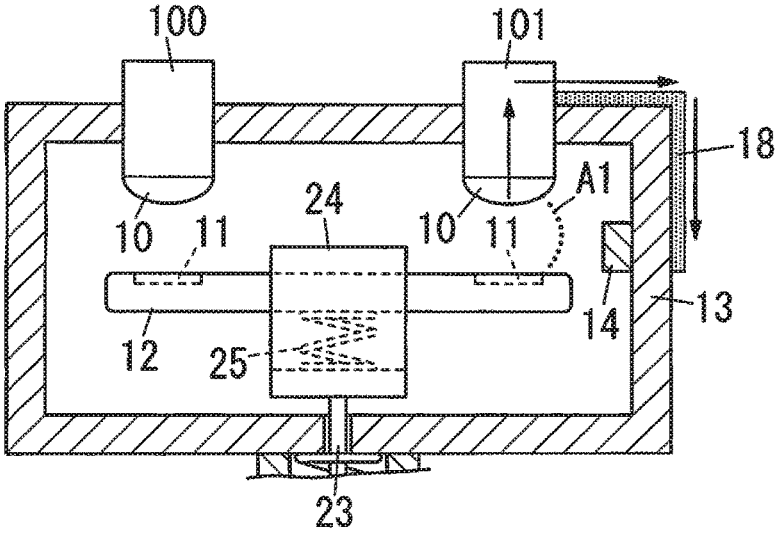
FIG. 10 is schematic configuration diagram of a contact apparatus of a modified structure of Modification 5.

Note that, in the present modification, the thermally conductive member 18 is provided to the internal face of the receptacle 13. Alternatively, as shown in FIG. 10, the thermally conductive member 18 may be provided to extend along an external face of the receptacle 13. In this case, the thermally conductive member 18 has one end in contact with part of the contact base 101 outside the receptacle 13 and the other end opposite the arc extinguishing member 14 with the right wall of the receptacle 13 in-between. Heat of the fixed contact 10 is transferred to the arc extinguishing member 14 through a structural object constituted by the contact base 101, the thermally conductive member 18, and the receptacle 13.

Figure 11A:
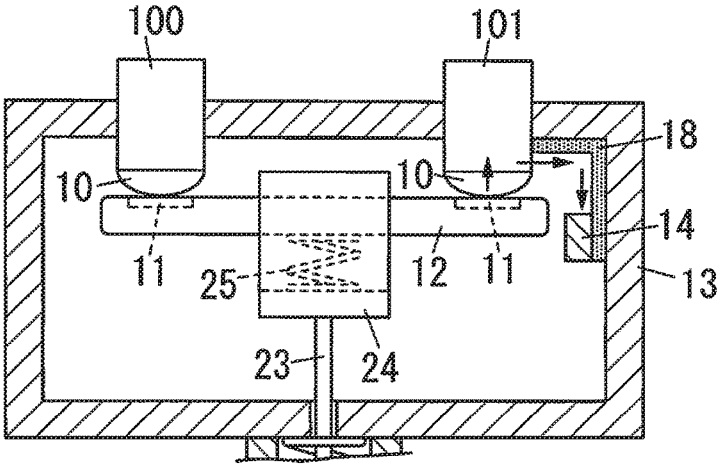
FIG. 11A and FIG. 11B are schematic diagrams of a path of transfer of heat in the contact apparatus of the modified structure of Modification 5.
Figure 11B:
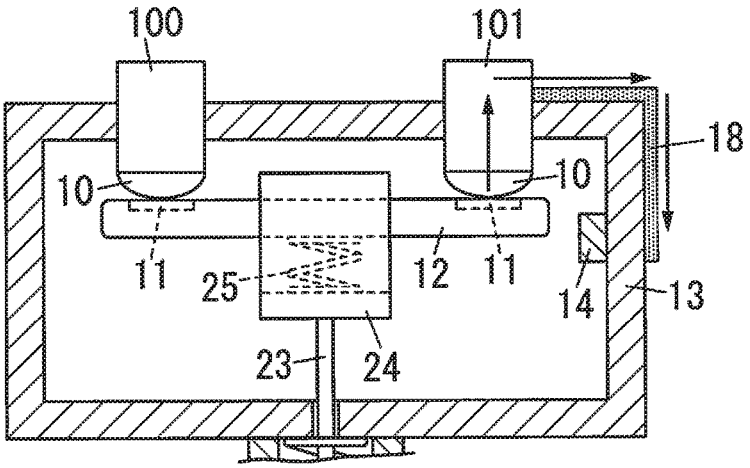

Further, the thermally conductive member 18 transfers heat of the fixed contact 10 to the arc extinguishing member 14. Therefore, as shown in FIG. 11A and FIG. 11B, Joule heat caused by energization would be transferred to the arc extinguishing member 14. This can lead to more improvement of an effect of preliminarily heating the arc extinguishing member 14.

Note that, other components and functions are the same as those of the embodiment. Optionally, the configuration of the present modification may be combined with at least one of the configurations of Modifications 1 to 4.

(Modification 6)

Figure 12:
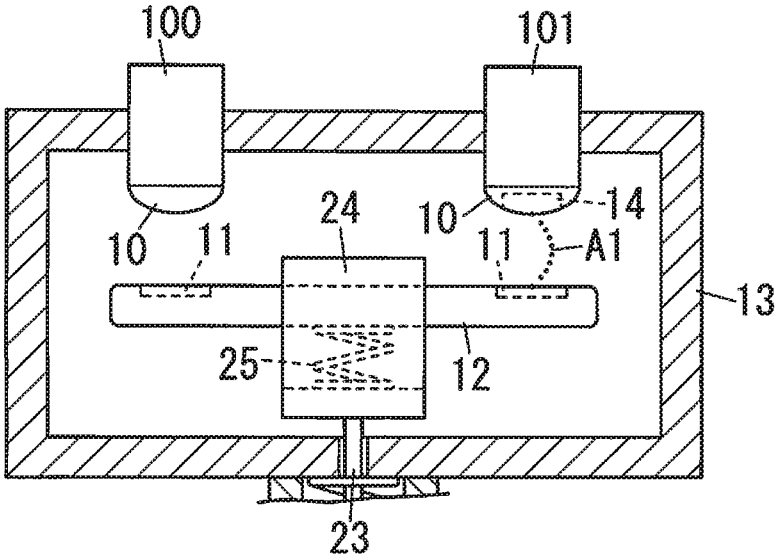
FIG. 12 is schematic configuration diagram of a contact apparatus of Modification 6.

FIG. 12 is a schematic configuration diagram of the contact apparatus 1 of Modification 6 of the present embodiment. In the contact apparatus 1 of the present embodiment, the arc extinguishing member 14 is provided to the fixed contact 10. Other components of the present modification are the same as those of the embodiment, and the same components as the embodiment are designated by the same reference signs to avoid redundant explanations.

The arc extinguishing member 14 is incorporated into the fixed contact 10 (structural object) so as not to prevent contact between the fixed contact 10 and the movable contact 11.

When an arc occurs, the arc extinguishing member 14 is heated by the arc together with the fixed contact 10. Thus, the arc extinguishing member 14 is drastically heated at almost the same time of occurrence of the arc, and thereby discharges the arc extinguishing gas. Therefore, it is possible to extinguish arcs more quickly.

Figure 13A:
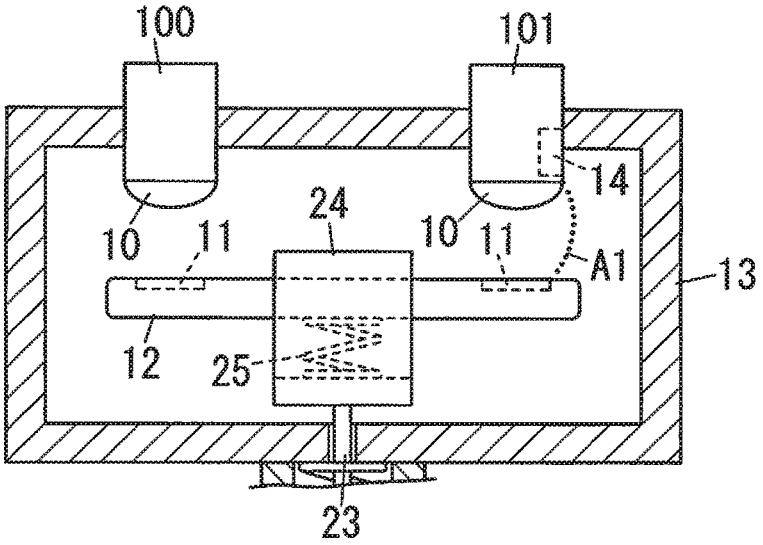
FIG. 13A and FIG. 13B are schematic configuration diagrams of a contact apparatus of a modified structure of Modification 6.
Figure 13B:
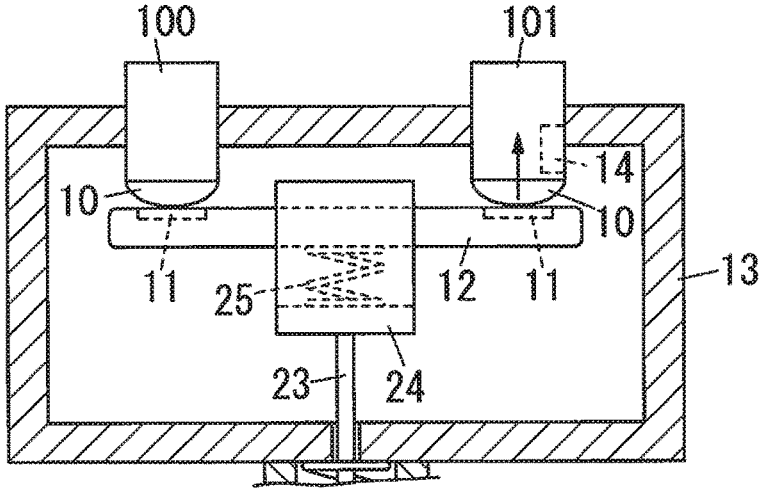

Note that, a location where the arc extinguishing member 14 is provided is not limited to the above. For example, as shown in FIG. 13A, the arc extinguishing member 14 may be incorporated into the contact base 101 electrically connected to the fixed contact 10. Also in this case, the arc extinguishing member 14 is heated at almost the same time of occurrence of the arc, and thereby discharges the arc extinguishing gas. Therefore, it is possible to extinguish arcs more quickly. Additionally, as shown in FIG. 13B, Joule heat caused by energization would be transferred to the arc extinguishing member 14. This can lead to more improvement of an effect of preliminarily heating the arc extinguishing member 14.

Figure 14A:
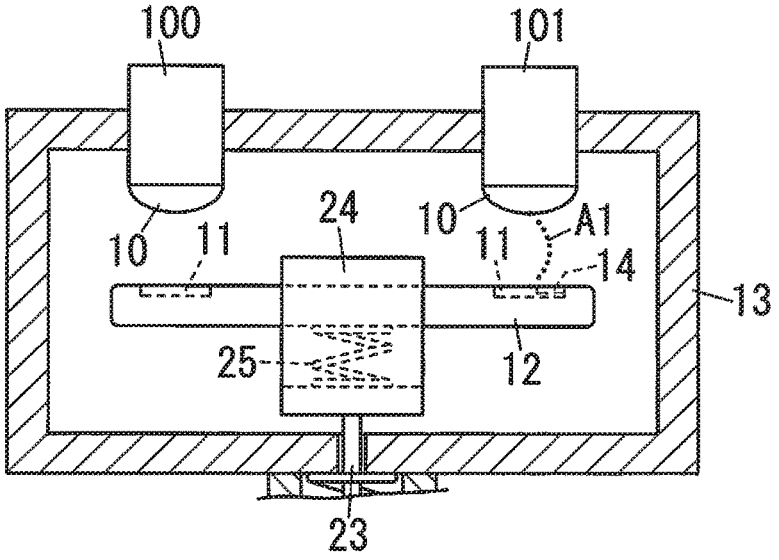
FIG. 14A and FIG. 14B are schematic configuration diagrams of a contact apparatus of another modified structure of Modification 6.

Alternatively, the arc extinguishing member 14 may be provided to be connected to the movable contact member 12. As shown in FIG. 14A, the arc extinguishing member 14 is provided to the movable contact 11. Also in this case, the arc extinguishing member 14 is heated at almost the same time of occurrence of the arc, and thereby discharges the arc extinguishing gas. Therefore, it is possible to extinguish arcs more quickly. Note that, the arc extinguishing member 14 may be provided to the movable contact member 12.

Figure 14B:
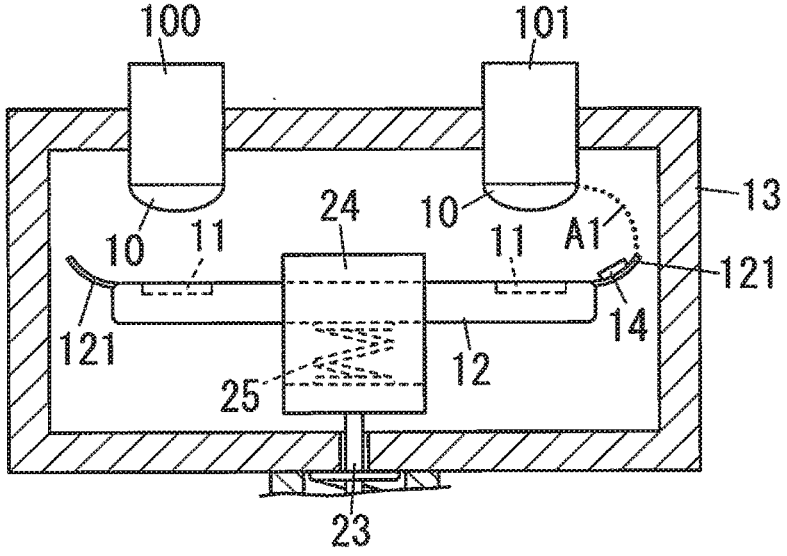

Alternatively, as shown in FIG. 14B, arc horns 121 may be provided to the movable contact member 12. The arc horns 121 are electrically connected to the movable contact 11, and are for attracting arcs to prevent damage of the movable contact 11 which would be otherwise caused by such arcs. In this case, the arc extinguishing member 14 may be provided to at least one of the arc horns 121. According to this configuration, like the above examples, the arc extinguishing member 14 is heated at almost the same time of occurrence of the arc, and thereby discharges the arc extinguishing gas. Therefore, it is possible to extinguish arcs more quickly.

As described above, in the contact apparatus 1 of the present modification, the arc extinguishing member 14 is provided to a structural object constituted by the fixed contact 10, the movable contact 11, and a member (the contact base 101 or the arc horn 121) electrically connected to the fixed contact 10 or the movable contact 11. Thus, the arc extinguishing member 14 is provided to a member where an arc is likely to occur. Hence, when an arc occurs, the arc extinguishing member 14 is heated at almost the same time of occurrence of the arc, and thereby discharges the arc extinguishing gas. Therefore, it is possible to extinguish the arc A1 more quickly, and this can lead to improvement of the performance of extinguishment of an arc.

Note that, other components and functions are the same as those of the embodiment. Optionally, the configuration of the present modification may be combined with at least one of the configurations of Modifications 1 to 5.

(Modification 7)

Figure 15:
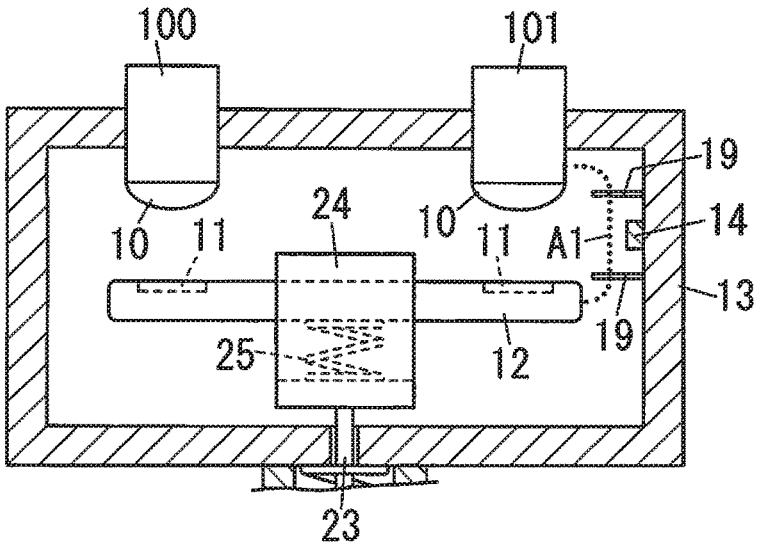
FIG. 15 is schematic configuration diagram of a contact apparatus of Modification 7.

FIG. 15 is a schematic configuration diagram of the contact apparatus 1 of Modification 7 of the present embodiment. The contact apparatus 1 of the present modification includes a pair of electrically conductive members 19, in addition to the components of the contact apparatus 1 of the embodiment. Other components of the present modification are the same as those of the embodiment, and the same components as the embodiment are designated by the same reference signs to avoid redundant explanations.

The electrically conductive member 19 is made of a material with high electric conductivity. In the present modification, the electrically conductive member 19 is made of copper (Cu). Note that, a material of the electrically conductive member 19 is not limited to copper, but may be a metal material with high electric conductivity such as stainless steel (SUS), an oxide such as an oxide of zirconium (Zr), or an inorganic material such as carbon and silicon carbide (SiC).

The electrically conductive member 19 is in a plate shape whose thickness direction corresponds to the upward and downward direction. The electrically conductive members 19 are electrically insulated from the fixed contact 10 and the movable contact 11, and are provided to an inner face of a right wall of the receptacle 13 to be close to the fixed contact 10 and the movable contact 11. In more detail, the electrically conductive members 19 are positioned over and below the arc extinguishing member 14 within a region between the fixed contact 10 and the movable contact 11 in the open position in the upward and downward direction, so as to protrude left from the inner face of the right wall of the receptacle 13.

When an arc occurs, the arc is attracted by the electrically conductive member 19 with high electric conductivity, and the arc is transferred to the pair of electrically conductive member 19. Transfer of the arc to the electrically conductive member 19 can lead to a decrease in a voltage of the arc, and therefore damage of the fixed contact 10 and the movable contact 11 due to the arc can be suppressed.

Further, the electrically conductive members 19 can move the arc to a predetermined position. In the present modification, the arc extinguishing member 14 is positioned between the pair of electrically conductive members 19. In summary, the contact apparatus 1 of the present modification includes the pair of electrically conductive member 19 which are electric conductive, and positioned in a region between the fixed contact 10 and the movable contact 11 in the open position in a moving direction of the movable contact 11, and electrically insulated from the fixed contact 10 and the movable contact 11. The arc extinguishing member 14 is present between the pair of electrically conductive members 19. Therefore, an arc occurs near the arc extinguishing member 14, and thus the arc extinguishing member 14 can be heated by the arc rapidly to discharge the arc extinguishing gas. Hence, the arc can be extinguished quickly, and accordingly the performance of extinguishment of an arc can be improved. Note that, to transfer the arc to the electrically conductive member 19, it is preferable that the electrically conductive member 19 be perpendicular to a direction in which the arc is to be extended. Optionally, the number of electrically conductive members 19 is not limited to two but may be three or more.

Figure 16:
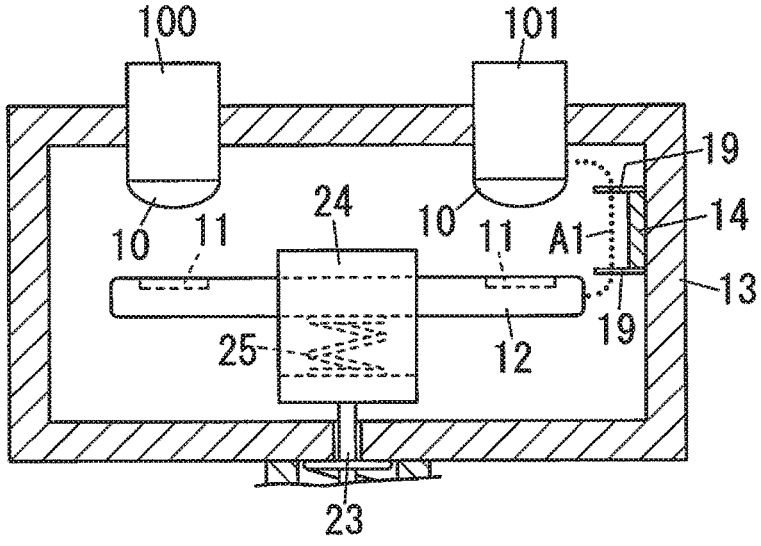
FIG. 16 is schematic configuration diagram of a contact apparatus of a modified structure of Modification 7.

Alternatively, as shown in FIG. 16, the electrically conductive member 19 may be in contact with the arc extinguishing member 14.

The pair of electrically conductive members 19 are arranged facing upper and lower ends of the arc extinguishing member 14 so as to hold the arc extinguishing member 14 therebetween in the upward and downward direction, and each are in contact with the arc extinguishing member 14. When an arc occurs, the arc is attracted by the electrically conductive member 19, and the arc is transferred to the electrically conductive members 19. In this regard, heat of the electrically conductive members 19 heated by the arc is transferred to the arc extinguishing member 14. Thus, the arc extinguishing member 14 is also heated through the electrically conductive members 19, and therefore, the arc can be extinguished quickly, and accordingly the performance of extinguishment of an arc can be improved.

Figure 17:
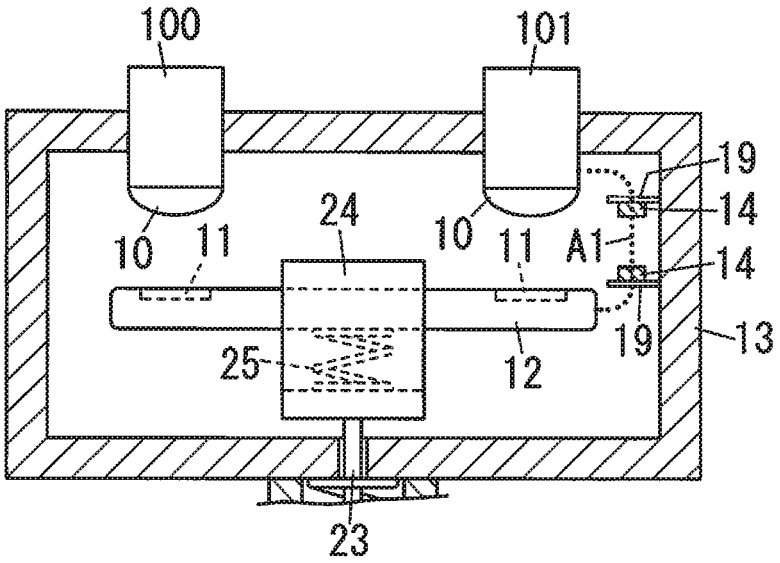
FIG. 17 is schematic configuration diagram of a contact apparatus of another modified structure of Modification 7.

Alternatively, as shown in FIG. 17, the arc extinguishing member 14 may be provided to the electrically conductive member 19. In other words, in the contact apparatus 1 of the present modification, the arc extinguishing member 14 is heated through a structural object with thermal conductivity. Further, in the contact apparatus 1 of the present modification, the arc extinguishing member 14 may be provided to the structural object. The structural object may be constituted by the pair of electrically conductive members 19 which are electric conductive, and positioned in a region between the fixed contact 10 and the movable contact 11 in the open position in the moving direction of the movable contact 11, and electrically insulated from the fixed contact 10 and the movable contact 11.

The arc extinguishing member 14 is formed as a thin film on the surface of the electrically conductive member 19 by deposition, plating, sputtering, or the like. Note that, the arc extinguishing member 14 may be fixed on the surface of the electrically conductive member 19 with electrically conductive adhesive or by swaging, for example, or may be formed integrally with the electrically conductive member 19.

The arc extinguishing member 14 is provided to the surface of the electrically conductive member 19, and therefore an arc is attracted by the electrically conductive member 19, and accordingly the arc is transferred to the electrically conductive member 19, and consequently the arc is made to be in contact with the arc extinguishing member 14. As a result, the arc extinguishing member 14 can be heated quickly to rapidly discharge the arc extinguishing gas, and therefore the arc can be extinguished more quickly. Note that, to more improve the performance of extinguishment of an arc, it is preferable that the arc extinguishing member 14 be provide to part of the electrically conductive member 19 at which an arc may occur.

Figure 18:
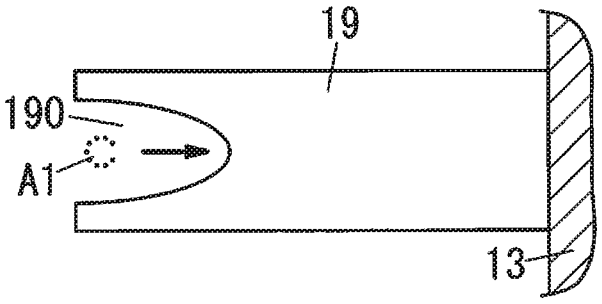
FIG. 18 is a top view of an electrically conductive member.

Alternatively, the electrically conductive member 19 may include a recess 190 in one end face (left face). FIG. 18 is a top view of the electrically conductive member 19. As shown in FIG. 18, the recess 190 is formed to have a bottom on an opposite side (right side) of the left face of the electrically conductive member 19 from the fixed contact 10 and the movable contact 11.

In summary, the contact apparatus 1 of the present modification includes the receptacle 13 surrounding the fixed contact 10, the movable contact 11, and the arc extinguishing member 14. The electrically conductive member 19 may protrude in a direction perpendicular to the moving direction of the movable contact 11 from the internal face of the receptacle 13 and may include the recess 190 in one end face, the recess 190 having a bottom on an opposite side of the end face from the fixed contact 10 and the movable contact 11. According to this configuration, when an arc occurs, the arc is attracted to an inside of the recess 190 by Lorentz force derived from a magnetic field caused by the arc. Therefore, the arc can be transferred to the electrically conductive member 19 with higher probability.

Optionally, a highly electrically conductive member which is higher in electric conductivity than the electrically conductive member 19 may be provided to the surface of the electrically conductive member 19 by forming a thin film thereof by deposition, plating, or sputtering, or by directly fixing with adhesive or by swaging, or by forming integrally, for example. In summary, a highly electrically conductive member which is higher in electric conductivity than the electrically conductive member 19 may be provided to the surface of the electrically conductive member 19. Also in a case where the highly electrically conductive member is provided to the electrically conductive member 19, an arc can be easily guided to the electrically conductive member 19, and therefore, the arc can be transferred to the electrically conductive member 19 with higher probability.

Note that, other components and functions are the same as those of the embodiment. Optionally, the configuration of the present modification may be combined with at least one of the configurations of Modifications 1 to 6.

(Modification 8)

Hereinafter, the contact apparatus 1 of Modification 8 of the present embodiment is described. Initially, the explanation is given to the background art for the contact apparatus 1 of the present modification.

In the past, there has been known an electromagnetic switch including a fixed contact, a movable contact, and an actuator for operating a movable contact to open and close a contact unit in accordance with an electric signal. In this electromagnetic switch, when the movable contact is separated from the fixed contact instantly, that is, when the contact unit is opened, an arc is likely to occur. As a method for extinguishing such an arc quickly, there has been known a method of producing a hermetically enclosed contact unit in which a space where a contact unit is placed is made to be a hermetically enclosed space and the hermetically enclosed space is filled with an arc extinguishing gas. For example, such a method is disclosed in Document 2 (JP 2012-089487 A).

In the conventional example disclosed in Document 2, a housing, a connector, a plate, and a plunger cap are hermetically bonded together so that an arc extinguishing unit including the fixed contact and the movable contact as well as a fixed core and a movable core are accommodated in the hermetically enclosed space. Thus, the housing forms the hermetically enclosed space to accommodate the fixed contact and the movable contact. The hermetically enclosed space is filled with an insulating gas (a gas with a capacity of extinguishment of an arc) mainly consisting of hydrogen.

In the conventional example, the fixed contact and the movable contact are arranged in a hermetically enclosed space filled with the gas with a capacity of extinguishment of an arc, and therefore, a possible arc can be extinguished. However, the conventional example is considered to have the following problem: in the conventional example, depending on a condition of energization, it is likely to take a certain time to extinguish an arc.

In view of the above insufficiency, the objective of the present modification is to propose a contact apparatus capable of extinguishing an arc quickly.

Hereinafter, the contact apparatus 1 of the present modification is described with reference to corresponding drawings. Note that, components common to the modification and the embodiment are designated by common reference signs to omit redundant explanations. In the contact apparatus 1 of the present modification, in a similar manner to the embodiment, the arc extinguishing member 14 is provided to the side wall 132 of the receptacle 13 so as to be close to the fixed contact 10 and the movable contact 11 (shown in FIG. 1). In other words, in the contact apparatus 1 of the present modification, the arc extinguishing member 14 is provided in a space same as a space where the fixed contact 10 and the movable contact 11 exist. The arc extinguishing member 14 includes hydrogen absorbing metal with a property of absorbing and desorbing hydrogen. The hydrogen absorbing metal may include metal with a relatively high affinity for hydrogen such as titanium (Ti), for example. The hydrogen absorbing metal may be selected from hydrogen absorbing alloys (hydrogen storage alloys) (described in JIS H 7003). The hydrogen absorbing alloy may be an alloy of metal with a high affinity for hydrogen and metal with a low affinity for hydrogen. The hydrogen absorbing alloy may include iron (Fe)-titanium (Ti) alloys and lanthanum (La)-nickel (Ni) alloys. Additionally, hydrogen absorbing metal may include metal hydride (MH) such as titanium hydride obtained by reaction of titanium and hydrogen.

The hydrogen absorbing metal included in the arc extinguishing member 14 may desorb hydrogen, and thereby extinguishes an arc occurring when the movable contact 11 is separated from the fixed contact 10. Hydrogen is a higher one in thermal conductivity of gases with a capacity of extinguishment of an arc (arc extinguishing gas), and hence is suitable for cooling arcs quickly to extinguish them. Additionally, hydrogen is desorbed from the hydrogen absorbing metal, and hence it is possible to obtain an effect of extinguishing arcs by blowing off. Further, when an inside of the receptacle 13 is a hermetically enclosed space filled with the arc extinguishing gas mainly consisting of hydrogen, an internal pressure of the receptacle 13 is increased as a result of desorption of hydrogen from the hydrogen absorbing metal, and thereby a density of hydrogen is increased, and hence arcs can be extinguished more quickly.

The arc extinguishing member 14 may consist of hydrogen absorbing metal, or may be a mixture of hydrogen absorbing metal and a material different from hydrogen absorbing metal. Note that, a shape of the arc extinguishing member 14 is not limited to a plate shape shown in FIG. 1, but may be another shape. The arc extinguishing member 14 may be molded by metal injection molding (MIM) from a material obtained by mixing powder of hydrogen absorbing metal or the like with a binder such as wax and thermoplastic resin. The arc extinguishing member 14 can be obtained by another method.

As described above, in the contact apparatus 1 of the present modification, the arc extinguishing member 14 including hydrogen absorbing metal to desorb hydrogen is provided in a space same as a space where the fixed contact 10 and the movable contact 11 exist. Therefore, according to the contact apparatus 1 of the present modification, an arc is cooled by hydrogen desorbed from the hydrogen absorbing metal rapidly, and thus the arc can be extinguished quickly. Further, according to the contact apparatus 1 of the present modification, an arc can be extinguished quickly even if a hermetically enclosed space is not filled with a gas with a capacity of extinguishment of an arc such as hydrogen.

Note that, when a hydrogen absorbing alloy is used for the arc extinguishing member 14, to allow hydrogen absorbing metal to desorb hydrogen, it is preferable to preliminarily cause hydrogen absorbing metal to absorb hydrogen in hydrogen absorbing metal before the arc extinguishing member 14 is provided inside the receptacle 13. Note that, with regard to a structure where hydrogen in sealed in the receptacle 13, a process of preliminarily causing hydrogen absorbing metal to absorb hydrogen can be omitted. This is because hydrogen absorbing metal absorbs hydrogen present inside the receptacle 13. Note that, with regard to the structure where hydrogen in sealed in the receptacle 13, the process of preliminarily causing hydrogen absorbing metal to absorb hydrogen may be performed. Further, in the contact apparatus 1 of the present modification, as shown in FIG. 1, the arc extinguishing member 14 is provided to the side wall 132 of the receptacle 13, but a location of the arc extinguishing member 14 may not be limited to this.

Note that, it is preferable that the arc extinguishing member 14 has a function of discharging hydrogen from hydrogen absorbing metal when heated. To realize this function, the arc extinguishing member 14 is preferred to include metal facilitating desorption of hydrogen such as chromium (Cr), manganese (Mn), iron (Fe), cobalt (Co), and nickel (Ni), for example. When the arc extinguishing member 14 includes one or more of these metals, a temperature at which hydrogen absorbing metal starts to desorb hydrogen can be lowered. According to this configuration, heat caused by energization of the excitation coil 22 or heat of an arc may cause desorption of hydrogen from hydrogen absorbing metal, and therefore an arc can be extinguished quickly. Further, according to this configuration, a reaction of desorbing hydrogen from hydrogen absorbing metal may proceed faster, and thus a reaction of absorbing hydrogen by hydrogen absorbing metal may proceed faster. Therefore, this configuration, hydrogen absorbing metal easily absorbs hydrogen, and therefore it is easy to mass-produce the arc extinguishing member 14 with hydrogen absorbing metal preliminarily absorbing hydrogen. Additionally, this configuration allows reactions of absorbing and desorbing of hydrogen by hydrogen absorbing metal to proceed faster, and is suitable for repetitive use.

Note that, it is preferable that the arc extinguishing member 14 be designed so that hydrogen absorbing metal starts to desorb hydrogen within time shorter than milliseconds in response to heat caused by energization or heat of an arc. According to this designing, hydrogen is quickly desorbed from hydrogen absorbing metal when heated, and thus an arc can be extinguished more quickly.

The arc extinguishing member 14 preferably may allow hydrogen absorbing metal to desorb hydrogen when an ambient temperature of the fixed contact 10 and the movable contact 11 while the contact apparatus 1 is opened (the movable contact 11 is separate from the fixed contact 10) exceeds a certain temperature. To realize this configuration, the arc extinguishing member 14 preferably may include an element with a relatively high affinity for hydrogen, such as lanthanum (La), titanium (Ti), magnesium (Mg), zirconium (Zr), vanadium (V), and calcium (Ca), for example. Additionally, the arc extinguishing member 14 preferably may include metal facilitating desorption of hydrogen, such as chromium (Cr), manganese (Mn), iron (Fe), cobalt (Co), and nickel (Ni), for example. The ambient temperature of the fixed contact 10 and the movable contact 11 does not exceed the certain temperature in a normal state (the contact apparatus 1 is not operated), and therefore according to this configuration it is possible to prevent hydrogen absorbing metal from repeating unprofitable absorption and desorption. Hence, this configuration can suppress deterioration of the arc extinguishing member 14, and thus long term use of the arc extinguishing member 14 can be ensured. Note that, the electromagnetic relay 3 including the contact apparatus 1 of the present modification may be used in an automobile, and a temperature of an inside of the automobile is expected to increase to about 100° C. In consideration of use in automobiles, it is preferable that the arc extinguishing member 14 allow hydrogen absorbing metal to desorb hydrogen when the ambient temperature of the fixed contact 10 and the movable contact 11 exceeds about 100° C.

Figure 19:
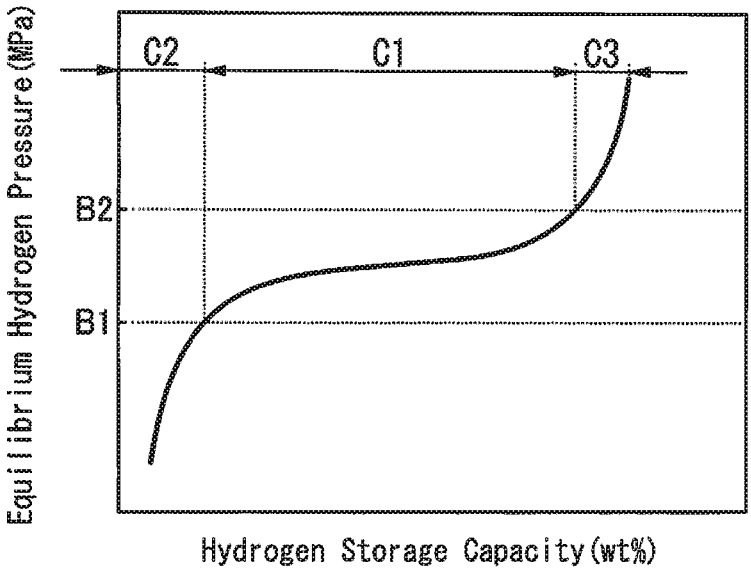
FIG. 19 is a graph showing an example of a PCT line of hydrogen absorbing metal used in a contact apparatus of Modification 8.

The following explanation is made to a relationship between an equilibrium hydrogen pressure and a hydrogen storage capacity of hydrogen absorbing metal included in the arc extinguishing member 14. FIG. 19 is one example of a pressure composition isotherm (so-called PCT line, shown in JIS H 7201) of hydrogen absorbing metal. The pressure composition isotherm indicates a correlation between an equilibrium hydrogen pressure and a hydrogen storage capacity at a temperature. The equilibrium hydrogen pressure means a hydrogen pressure in an equilibrium state at a desired temperature in a case where hysteresis can be ignored. The hydrogen storage capacity means a ratio of an amount of hydrogen in a unit amount of an alloy (hydrogen absorbing metal) fully hydrogenated. FIG. 19 shows a vertical axis indicating the equilibrium hydrogen pressure (MPa) and a horizontal axis indicating the hydrogen storage capacity (percentage by weight (wt %). For example, when a maximum of a hydrogen storage capacity of hydrogen absorbing metal is 3 wt %, hydrogen absorbing metal of mass 1 kg can absorb up to 30 g hydrogen. An increase in a temperature of hydrogen absorbing metal causes upward translation of the isotherm shown in FIG. 19, and a decrease in a temperature of hydrogen absorbing metal causes downward translation of the isotherm shown in FIG. 19.

In a predetermined first range C1 (the equilibrium hydrogen pressure is in a range of 'B1' to 'B2' [MPa]) of the hydrogen storage capacity in the pressure composition isotherm shown in FIG. 19, a change in the equilibrium hydrogen pressure caused by a change in the hydrogen storage capacity is relatively small. In contrast, in a second range C2 (a range of equilibrium hydrogen pressures equal to or lower than 'B1' [MPa]) in which hydrogen storage capacities are equal to or lower than a lower limit of the first range C1 in the pressure composition isotherm shown in FIG. 19, a change in the equilibrium hydrogen pressure caused by a change in the hydrogen storage capacity is larger than that in the first range C1. Further, in a third range C3 (a range of equilibrium hydrogen pressures equal to or higher than 'B2' [MPa]) in which hydrogen storage capacities are equal to or larger than an upper limit of the first range C1 in the pressure composition isotherm shown in FIG. 19, a change in the equilibrium hydrogen pressure caused by a change in the hydrogen storage capacity is larger than that in the first range C1. Obviously, in the first range C1, even if a change in the equilibrium hydrogen pressure is small, hydrogen absorbing metal can absorb and desorb hydrogen.

In view of this, it is preferable to use hydrogen absorbing metal have the first range C1 (so-called plateau region) in the pressure composition isotherm. In other words, it is preferable that the arc extinguishing member 14 be made so that a gradient in the first range C1 is smaller than gradients in the second range C2 and the third range C3 with regard to the pressure composition isotherm of the hydrogen absorbing metal. According to this, the hydrogen absorbing metal desorbs hydrogen at a specific temperature, and this will offer an advantage of not requiring much consideration for the arc extinguishing member 14 in designing the contact apparatus 1. For example, when a temperature reaches the specific temperature, the hydrogen absorbing metal desorbs hydrogen quickly, and hence it is easy to make a design for causing the hydrogen absorbing metal to desorb hydrogen in response to heat of an arc. Note that, it is preferable that the hydrogen absorbing metal have such a property that at a desired temperature the hydrogen storage capacity changes by 50% or greater of the maximum hydrogen storage capacity when the equilibrium hydrogen pressure changes by 1/50 or 50 times thereof. It is more preferable that the hydrogen absorbing metal have such a property that at a desired temperature the hydrogen storage capacity changes by 50% or greater of the maximum hydrogen storage capacity when the equilibrium hydrogen pressure changes by 1/5 or 5 times thereof.

As already described above, the arc extinguishing member 14 can be prepared by metal injection molding, for example. In preparing the arc extinguishing member 14 by such molding, hydrogen absorbing metal, and material other than the hydrogen absorbing metal, of the arc extinguishing member 14 are constituted by multiple particles. Increases in the sizes (particle sizes) of the multiple particles may lead to a decrease in a surface area, and thus reactions of absorbing and desorbing hydrogen by hydrogen absorbing metal tend to be slower. In contrast, decreases in the sizes (particle sizes) of the multiple particles may lead to an increase in the surface area, but handling becomes difficult. In view of this, preferably, an average of the sizes of the multiple particles constituting the arc extinguishing member 14 may be in a range of 1 μm to 1 mm. In this range, the arc extinguishing member 14 shows properties excellent in easiness of handleability and speeds of absorption and desorption of hydrogen. Note that, it is more preferable that the average of the sizes of the multiple particles constituting the arc extinguishing member 14 be in a range of 10 μm to 100 μm. In this range, variation of the size of the multiple particles becomes smaller.

Further, the arc extinguishing member 14 is prepared such that at least one of generated amounts of metal and a metal ion is smaller than a predetermined value. In more detail, it is preferable that the arc extinguishing member 14 be prepared not to include alkali metal such as lithium (Li). Further, according to this configuration, generated amounts of metal and/or a metal ion which prevent extinguishment of an arc are relatively small, and therefore it is possible to suppress occurrence of a phenomenon (short-circuiting through arcs) in which insulation breakdown between the fixed contact 10 and the movable contact 11 is maintained.

It is preferable that the arc extinguishing member 14 may be mainly made of an element having an ionization tendency equal to or smaller than an ionization tendency of magnesium (Mg). According to this configuration, the arc extinguishing member 14 becomes unsusceptible to oxidation, and thus the hydrogen absorbing metal easily desorbs hydrogen and thereby an arc can be extinguished quickly. Further in this configuration, a reaction of absorbing hydrogen by hydrogen absorbing metal becomes faster. Therefore, time necessary for the hydrogen absorbing metal to absorb hydrogen becomes shorter, and it becomes easy to mass-produce the arc extinguishing member 14 storing hydrogen. Additionally, according to this configuration, the hydrogen absorbing metal is unsusceptible to oxidation even if repeating absorption and desorption, and therefore long term use can be ensured.

Note that, an oxidized film may be formed on the surface of the arc extinguishing member 14. In view of this, it is preferable to remove at least part of the oxidized film on the surface of the arc extinguishing member 14. The oxidized film on the surface of the arc extinguishing member 14 can be removed by a chemical method such as immersing in an acidic solution or an alkaline solution or a physical method such as polishing the surface, for example. According to this configuration, as with the above, oxidation of the arc extinguishing member 14 can be suppressed, and it is possible to offer an effect of quick extinguishment of an arc, an effect of easily mass-production of the arc extinguishing member 14, and an effect of ensuring long term use of the arc extinguishing member 14. Further, according to this configuration, even if the arc extinguishing member 14 is made of an element with an ionization tendency larger than an ionization tendency of magnesium, the arc extinguishing member 14 can be unsusceptible to oxidation.

Preferably, the arc extinguishing member 14 may be under an atmosphere of at least one gas of hydrogen, nitrogen, an inactive gas, and a gas with a capacity of extinguishment of an arc (arc extinguishing gas). For example, preferably, the inside space of the receptacle 13, which includes the arc extinguishing member 14, may be made to be a hermetically enclosed space, and the receptacle 13 may be filled with at least one gas of hydrogen, nitrogen, an inactive gas, and a gas with a capacity of extinguishment of an arc (arc extinguishing gas). The inactive gas may be exemplified by a noble gas such as argon, for example. The inactive gas other than a noble gas may be available. According to this configuration, a ratio of oxygen in an atmosphere surrounding the arc extinguishing member 14 can be decreased, and therefore as with the above oxidation of the arc extinguishing member 14 can be suppressed. Consequently, according to this configuration, as with the above, it is possible to offer an effect of quick extinguishment of an arc, an effect of easily mass-production of the arc extinguishing member 14, and an effect of ensuring long term use of the arc extinguishing member 14. Note that, it is preferable that a volume ratio of oxygen to the inside space of the receptacle 13 be small as possible. In view of practical use, it is preferable that the volume ratio be equal to or smaller than 5%.

Figure 20:
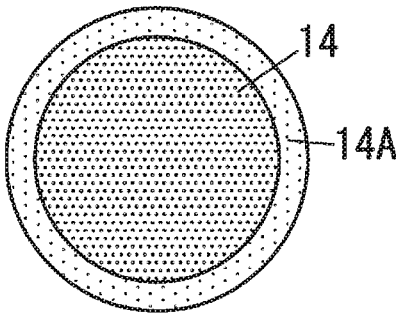
FIG. 20 is a diagram of a configuration of an arc extinguishing member of the contact apparatus of Modification 8.

Note that, it is preferable that the surface of the arc extinguishing member 14 be covered with a layer 14A of material different from the hydrogen absorbing metal, as shown in FIG. 20. A method for forming the layer 14A may be plating or sputtering, for example. The layer 14A may be formed by another method. In this configuration, the arc extinguishing member 14 is protected by the layer 14A and therefore oxidation of the arc extinguishing member 14 can be suppressed as with the above. Consequently, according to this configuration, as with the above, it is possible to offer an effect of quick extinguishment of an arc, an effect of easily mass-production of the arc extinguishing member 14, and an effect of ensuring long term use of the arc extinguishing member 14. Further, in this configuration, when the arc extinguishing member 14 is constituted by multiple particles, bond between the multiple particles is strong, and thus formation of the arc extinguishing member 14 can be facilitated. Note that, in FIG. 20, the layer 14A covers the entire surface of the arc extinguishing member 14, but the layer 14A may cover at least part of the surface of the arc extinguishing member 14. Note that, the thickness of the layer 14A may not be limited but may be preferably in a range of about 0.1 μm to 100 μm.

In this regard, preferably, the layer 14A may include a heat transfer substance which is higher in thermal conductivity than hydrogen absorbing metal. In other words, the contact apparatus 1 of the present modification may preferably include the layer 14A covering at least part of the surface of the arc extinguishing member 14. And, the layer 14A may preferably include a heat transfer substance higher in thermal conductivity than hydrogen absorbing metal. According to this configuration, in contrast to use of only hydrogen absorbing metal with relatively low thermal conductivity, an efficiency of heat transfer to the arc extinguishing member 14 can be improved. Further, the layer 14A may preferably include a catalyst substance acting as a catalyst for a reaction of desorption of hydrogen. In other words, the contact apparatus 1 of the present modification may preferably include the layer 14A covering at least part of the surface of the arc extinguishing member 14. And, the layer 14A may preferably include a catalyst substance acting as a catalyst for a reaction of desorption of hydrogen. According to this configuration, the catalyst activates the reaction of desorption of hydrogen by hydrogen absorbing metal. The hydrogen absorbing metal quickly desorbs hydrogen, and hence arcs can be extinguished more quickly.

The heat transfer substance and the catalyst substance may be exemplified by metal such as copper (Cu), nickel (Ni), palladium (Pd), gold (Au), silver (Ag), chromium (Cr), aluminum (Al), and zinc (Zn). Additionally, the heat transfer substance and the catalyst substance may be exemplified by resin such as epoxy resin and ceramic such as alumina. The layer 14A may be made of only one of these materials or a mixture of two or more of these materials.

Further, preferably, the arc extinguishing member 14 may include a heat transfer material which is higher in thermal conductivity than hydrogen absorbing metal. According to this configuration, the thermal conductivity of the arc extinguishing member 14 can be increased. Further, the arc extinguishing member 14 may preferably include a catalyst material acting as a catalyst for a reaction of desorption of hydrogen. According to this configuration, as with the above, the arc extinguishing member 14 quickly discharges hydrogen, and hence arcs can be extinguished more quickly.

Further, the arc extinguishing member 14 may preferably include a resistive material higher in electric resistivity than hydrogen absorbing metal. According to this configuration, the electric resistance of the arc extinguishing member 14 is increased, and thus transfer of an arc can be suppressed.

The heat transfer material and the catalyst material may be exemplified by metal such as copper (Cu), nickel (Ni), chromium (Cr), aluminum (Al), and zinc (Zn). Additionally, the heat transfer material and the catalyst material may be exemplified by resin such as epoxy resin and ceramic such as alumina and silicon carbide (SiC). Further, the resistive material may be exemplified by resin such as epoxy resin, oxide such as alumina, and silicon carbide (SiC). Only one of these materials or a mixture of two or more of these materials may be mixed in the arc extinguishing member 14. Optionally, the layer 14A may be formed on the surface of the arc extinguishing member 14 including one or more of these materials.

Figure 21A:
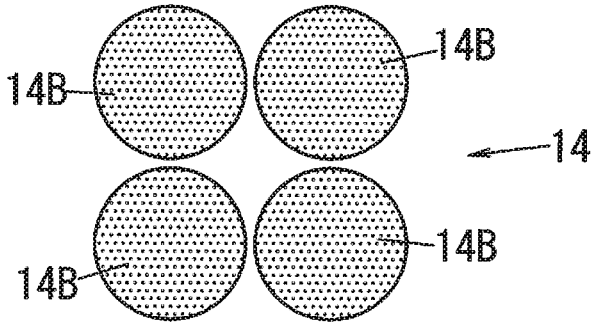
FIG. 21A is a diagram of an arc extinguishing member before sintering.
Figure 21B:
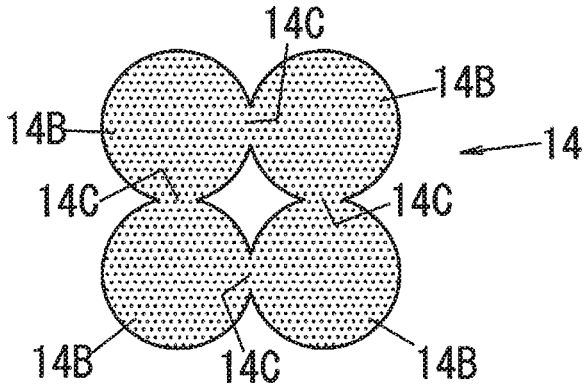
FIG. 21B is a diagram of an arc extinguishing member after sintering.

Optionally, the arc extinguishing member 14 may be subjected to treatment (so-called sintering) of heating at a temperature equal to or lower than a melting point of hydrogen absorbing metal. By subjecting the arc extinguishing member 14 to the treatment of heating, the shape of the arc extinguishing member 14 can be easily maintained for a long time. Note that, shaping of the arc extinguishing member 14 may be done prior to the treatment of heating. Further, the treatment of heating may be preferably made to proceed under an atmosphere of an inactive gas. Further, as shown in FIG. 21A and FIG. 21B, the treatment of heating may cause formation of cross-links 14C between particles 14B constituting the arc extinguishing member 14.

(Modification 9)

Hereinafter, the contact apparatus 1 of Modification 9 of the present embodiment is described. Initially, the explanation is given to the background art for the contact apparatus 1 of the present modification.

In the past, there has been provided a contact apparatus for quickly extinguishing arcs which would occur when the contact apparatus is opened. In such a contact apparatus, a space where a fixed contact and a movable contact are placed is made to be a hermetically enclosed space and the hermetically enclosed space is filled with an arc extinguishment gas (an insulating gas) (e.g., described in Document 2).

In the contact apparatus disclosed in Document 2, a housing, a connector, a plate, and a plunger cap are hermetically bonded together so as to form the hermetically enclosed space for accommodating the fixed contact and the movable contact. In other words, in the contact apparatus, the space enclosed by the housing, the connector, the plate, and the plunger cap is made to be the hermetically enclosed space, and the hermetically enclosed space is filled with the arc extinguishment gas mainly consisting of hydrogen.

However, the above contact apparatus with a structure where the hermetically enclosed space is filled with the arc extinguishment gas is considered to have the following problem: depending on a condition of energization, it is likely to take a certain time to extinguish an arc.

In view of the above insufficiency, the objective of the present modification is to provide a contact apparatus capable of extinguishing an arc quickly.

Hereinafter, the contact apparatus 1 of the present modification is described with reference to corresponding drawings. Note that, components common to the modification and the embodiment are designated by common reference signs to omit redundant explanations. The contact apparatus 1 of the present modification includes an arc extinguisher 140.

Figure 22:
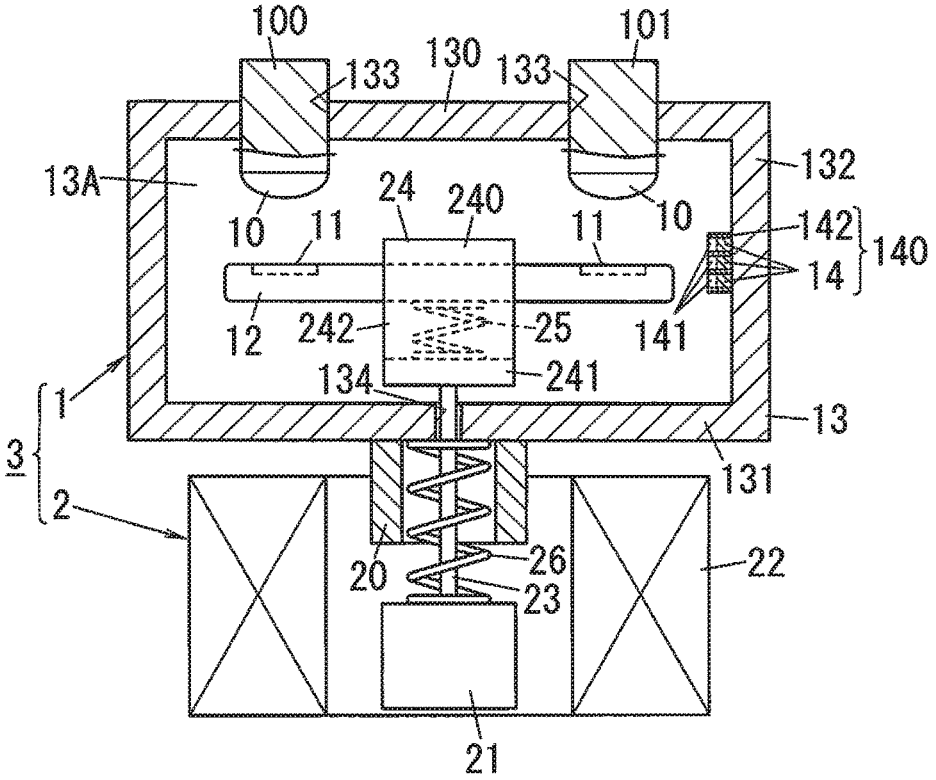
FIG. 22 is a cutaway diagram of an electromagnetic relay including a contact apparatus of Modification 9.

As shown in FIG. 22, the arc extinguisher 140 is situated in the space 13A including the fixed contact 10 and the movable contact 11, which means the space 13A inside the receptacle 13, and includes the arc extinguishing member 14 for discharging the arc extinguishment gas (arc extinguishing gas) mainly consisting of hydrogen when heated. Therefore, when the arc extinguishing member 14 is heated, the arc extinguisher 140 discharges the arc extinguishing gas (arc extinguishment gas) from the arc extinguishing member 14 to cool arcs, thereby extinguishing the arcs quickly. Note that, heating of the arc extinguishing member 14 may be caused by an increase in a temperature of the space 13A resulting from arcs occurring when the contact apparatus 1 is opened and Joule heat caused by energization, for example.

The arc extinguishment gas to be discharged from the arc extinguishing member 14 may not be limited to a gas mainly consisting of hydrogen but may be a gas mainly consisting of nitrogen or the like. However, hydrogen is higher in thermal conductivity than nitrogen or the like, and thus is suitable for cooling arcs. Hence, the arc extinguishment gas preferably mainly consists of hydrogen. Note that, the arc extinguisher 140 extinguishes arcs quickly by cooling arcs with the arc extinguishment gas as well as blowing off arcs with the arc extinguishment gas to be discharged from the arc extinguishing member 14.

The arc extinguishing member 14 may be made of a resin material, a metal material or other inorganic material, for example. In more detail, the arc extinguishing member 14 preferably may consist of a material for producing a gas such as hydrogen quickly in response to heat, such as phenolic resin, hydrogen absorbing metal (including hydrogen absorbing alloys or hydrogen storage alloys), titanium hydride, and boric acid. Note that, the material of the arc extinguishing member 14 is not limited to materials listed above. For example, it is sufficient that the arc extinguishing member 14 discharges the arc extinguishment gas when heated. For example, the arc extinguishing member 14 may discharge the arc extinguishment gas irrespective of whether heated or not.

The arc extinguisher 140 is situated in the space 13A inside the receptacle 13 so as to close to the fixed contact 10 and the movable contact 11. In more detail, the arc extinguisher 140 is fixed to an inner side face (a face facing the space 13A of the inside) of a part of the side wall 132 of the receptacle 13 on one side in a direction in which the pair of contact bases 100 and 101 are arranged. As shown in FIG. 22, the position in the upward and downward direction of the arc extinguisher 140 may be determined so that at least part of the arc extinguisher 140 is present in a region between the movable contact 11 in the open position and the fixed contact 10 in the upward and downward direction. Accordingly, when an arc occurs when the movable contact 11 separates from the fixed contact 10, the arc extinguishing member 14 can be heated quickly by the arc, thereby discharging the arc extinguishment gas.

Note that, in the present modification, the arc extinguisher 140 includes a heat transfer structure for improving an efficiency of transfer of heat from the space 13A to the arc extinguishing member 14. In summary, in the contact apparatus 1 of the present modification, the arc extinguishing member 14 is not the arc extinguisher 140 per se, and may be the arc extinguishing member 14 provided with the heat transfer structure by appropriate processing or treatment to improve the efficiency of transfer of heat from the space 13A to the arc extinguishing member 14. Consequently, the arc extinguisher 140 can transfer heat of the space 13A to the arc extinguishing member 14 efficiently, thereby facilitating production of the arc extinguishment gas. Therefore, improvement of the performance of extinguishment of an arc can be expected.

Figure 23A:
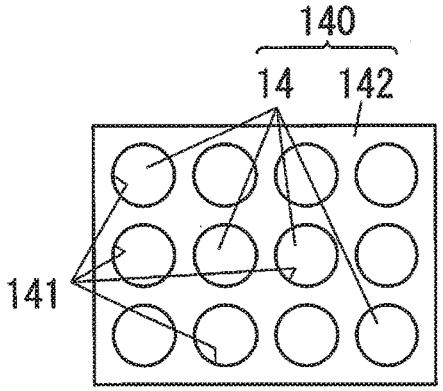
FIG. 23A is a front view of an arc extinguisher of the contact apparatus of Modification 9.
Figure 23B:
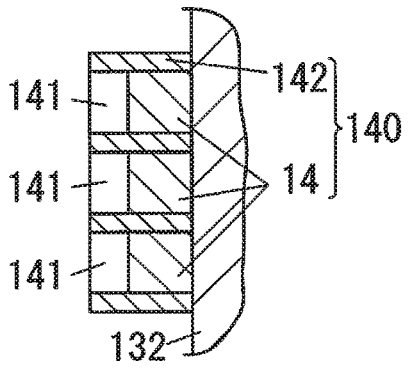
FIG. 23B is a section of an arc extinguisher of the contact apparatus of Modification 9.

In the present modification, the heat transfer structure of the arc extinguisher 140 includes a skeleton member 142 of a material higher in thermal conductivity than the arc extinguishing member 14. As shown in FIG. 23A and FIG. 23B, the skeleton member 142 includes at least one hole 141 receiving at least part of the arc extinguishing member 14. In other words, the arc extinguisher 140 has a structure in which the skeleton member 142 higher in thermal conductivity than the arc extinguishing member 14 is included as the heat transfer structure and at least part of the arc extinguishing member 14 is present in the hole 141 formed in the skeleton member 142.

In this regard, the skeleton member 142 includes multiple holes each serving as the hole 141, and parts of the arc extinguishing member 14 are in the respective holes 141. In the example shown in FIG. 23A, the holes 141 have a circular opening, and are arranged in a longitudinal direction and a lateral direction (in the example shown in FIG. 23A, the three holes are arranged in the longitudinal direction and the four holes are arranged in the lateral direction). As shown in FIG. 23B, the skeleton member 142 is fixed to the side wall 132 so that one face in the thickness direction thereof faces the side wall 132, and the holes 141 are formed to penetrate the skeleton member 142 in the thickness direction.

According to this configuration, the arc extinguishing member 14 can receive heat of the space 13A through the skeleton member 142. In other words, an apparent surface area of the arc extinguishing member 14 is increased compared to a case where the skeleton member 142 is absent, and thereby is heated efficiently when the space 13A is heated. Therefore, generation of the arc extinguishment gas is facilitated, and improvement of the performance of extinguishment of an arc can be expected.

Note that, as shown in FIG. 23B, the parts of the arc extinguishing member 14 are inserted in spaces of the respective holes 141 to only a predetermined depth from opening faces close to the side wall 132. Spaces of the respective holes 141 to a predetermined depth from opening faces close to the space 13A inside the receptacle 13 are not filled with parts of the arc extinguishing member 14 and thus are hollow. Therefore, the arc extinguishment gas discharged from the arc extinguishing member 14 blows into the space 13A through hollow parts of the holes 141. Consequently, the arc extinguisher 140 can make the arc extinguishment gas blow into the space 13A when heated. Thus, improvement of the performance of extinguishment of an arc can be expected.

Figure 24:
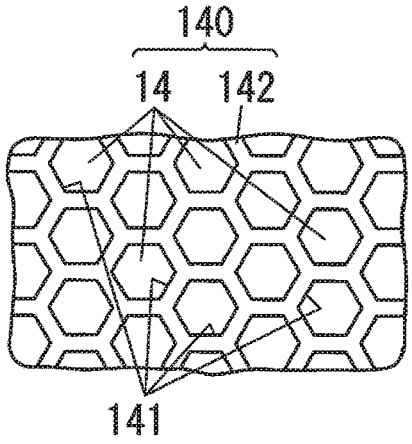
FIG. 24 is a front view of a modified arc extinguisher of the contact apparatus of Modification 9.

Note that, a shape of each hole 141 and arrangement of the multiple holes 141 are not limited to examples shown in FIG. 23A. For example, as shown in FIG. 24, a honeycomb structure where the holes 141 have a regular hexagonal opening and are arranged in a longitudinal direction and a lateral direction with no spaces therebetween may be available. The hole 141 may not penetrate the skeleton member 142 in the thickness direction, and may open only one face of the skeleton member 142 in the thickness direction.

For example, the skeleton member 142 may be made of a member including a large number of the holes 141 such as foam metal, perforated metal, and a ceramic honeycomb. Note that, in forming the arc extinguisher 140, the parts of the arc extinguishing member 14 may be inserted into the holes 141 of the skeleton member 142 or the skeleton member 142 may be embedded into the arc extinguishing member 14.

According to the contact apparatus 1 of the present modification described above, the arc extinguisher 140 has the heat transfer structure for improving an efficiency of transfer of heat from the space 13A to the arc extinguishing member 14, and therefore heat of the space 13A can be transferred to the arc extinguishing member 14 efficiently. Consequently, when an arc occurs when the movable contact 11 separates from the fixed contact 10, heat of the arc is transferred to the arc extinguishing member 14 efficiently, and thus the arc extinguishing member 14 easily produces the arc extinguishment gas, and this offers an advantage that improvement of the performance of extinguishment of an arc can be expected. As a result, depending on the energization condition, the contact apparatus 1 of the present modification can extinguish arcs more quickly than a configuration in which a hermetically enclosing structure is formed to enclose the fixed contact and the movable contact and a hermetically enclosed space is only filled with the arc extinguishment gas.

Optionally, the heat transfer structure of the arc extinguisher 140 may include a heat transfer substance (not shown) of material higher in thermal conductivity than the arc extinguishing member 14, in addition to the skeleton member 142 or instead of the skeleton member 142. The heat transfer substance may be mixed in the arc extinguishing member 14. The heat transfer substance may be made of a metal material such as copper (Cu), nickel (Ni), and aluminum (Al). The heat transfer substance may not be made of metal but may be made of oxide such as aluminum oxide (alumina) and zirconium oxide (zirconia), silicon carbide (SiC), or resin material with high electric resistivity.

Such a heat transfer substance may preferably be mixed in the arc extinguishing member 14, but may be provided to cover the surface of the arc extinguishing member 14. Optionally, a mixing ratio may be different in a surface side and an inside of the arc extinguishing member 14. A particle size of the heat transfer substance to be mixed in is not limited particularly, but may preferably be equal to or less than a particle size ten times larger than the particle size of the arc extinguishing member 14 in view of facilitation of mixing the heat transfer substance in the arc extinguishing member 14.

As described above, the heat transfer substance acting as the heat transfer structure is mixed in the arc extinguishing member 14, and thus material with high thermal conductivity is present between particles of material of the arc extinguishing member 14. Hence, transfer of heat of the space 13A to the inside of the arc extinguishing member 14 can be facilitated. Therefore, the arc extinguisher 140 can easily produce the arc extinguishment gas, and improvement of the performance of extinguishment of an arc can be expected.

Optionally, the arc extinguisher 140 may include a highly resistive substance (not shown) of a material higher in electric resistivity than the arc extinguishing member 14. The highly resistive substance is mixed in the arc extinguishing member 14. The highly resistive substance may be provided in addition to the heat transfer substance or instead of the heat transfer substance. Further, when the heat transfer substance is made of oxide or resin material which have high electric resistivity, the heat transfer substance also acts as a high resistive substance.

When the highly resistive substance is mixed in the arc extinguishing member 14, the contact apparatus 1 can suppress transfer of an arc to the arc extinguisher 140.

Figure 25:
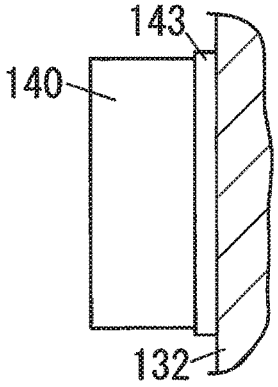
FIG. 25 is a front view of a further modified arc extinguisher of the contact apparatus of Modification 9.

In another example of the present modification, as shown in FIG. 25, the arc extinguisher 140 may be fixed to part of a structural object facing the space 13A. Optionally, the arc extinguisher 140 may include a thermal insulating plate 143 which has a thermally insulating property and is present between the structural object and the arc extinguishing member 14. In this example, the structural object is the side wall 132 of the receptacle 13 forming the space 13A. In this example, the arc extinguishing member 14 is not fixed to the receptacle 13 directly, but is fixed to the receptacle 13 with the thermal insulating plate 143 in-between.

The thermal insulating plate 143 may be preferably of a material lower in thermal conductivity than the arc extinguishing member 14, such as resin material, metal material and oxide, and for example may be made of resin material such as a polyimide resin and an epoxy resin. Additionally or alternatively, the thermal insulating plate 143 may be made of a material with highly thermally insulating structure, such as a ceramic honeycomb.

According to this configuration, the arc extinguisher 140 can suppress escape of heat transferred from the space 13A to the arc extinguishing member 14, to the structural object (the side wall 132). Thus, the arc extinguishing member 14 can be heated efficiently to thereby easily produce the arc extinguishment gas, and therefore improvement of the performance of extinguishment of an arc can be expected.

(Modification 10)

Figure 26A:
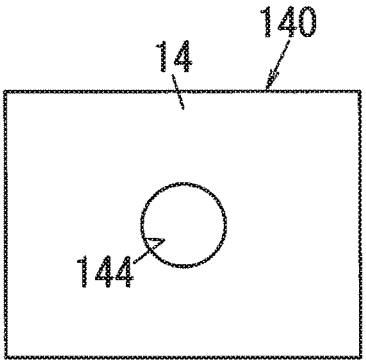
FIG. 26A is a front view of an arc extinguisher of a contact apparatus of Modification 10.
Figure 26B:
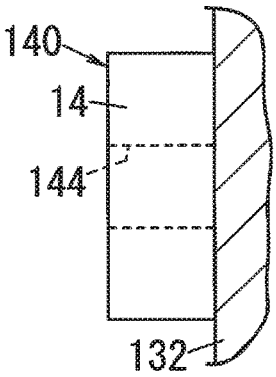
FIG. 26B is a bottom view of the arc extinguisher of the contact apparatus of Modification 10.

As shown in FIG. 26A and FIG. 26B, the contact apparatus 1 of Modification 10 of the present embodiment is different from the contact apparatus 1 of Modification 9 in that the heat transfer structure of the arc extinguisher 140 includes a ventilation hole 144 which is formed in the surface of the arc extinguishing member 14 in contact with the space 13A so as to be connected to the space 13A. Other components of the present modification are the same as those of Modification 9, and the same components as Modification 9 are designated by the same reference signs to avoid redundant explanations.

In more detail, the arc extinguisher 140 includes the ventilation hole 144 as the heat transfer structure, in addition to the skeleton member 142 (shown in FIG. 23A) and/or the heat transfer substance described in Modification 9 or instead of the skeleton member 142 and/or the heat transfer substance. In the example shown in FIG. 26A and FIG. 26B, there is one circular ventilation hole 144 penetrating the arc extinguishing member 14 in the thickness direction. Note that, the ventilation hole 144 is required to have at least one opening in the surface of the arc extinguishing member 14 in contact with the space 13A, but the at least one opening may not be circular, and the ventilation hole 144 may not penetrate the arc extinguishing member 14, and the arc extinguisher 140 may include two or more ventilation holes 144.

According to the configuration of the present modification described above, the arc extinguisher 140 includes the ventilation hole 144 serving as the heat transfer structure, and therefore heat of the space 13A inside the receptacle 13 can be transferred to the arc extinguishing member 14 efficiently. In other words, the space 13A is connected to an inside of the ventilation hole 144 formed in the arc extinguishing member 14, and therefore the arc extinguishing member 14 can receive heat of the space 13A at an inner face of the ventilation hole 144 in addition to the surface. Further, the configuration of the present modification can offer an advantage that the arc extinguishing member 14 is processed to have the ventilation hole 144 without providing an additional member such as the skeleton member 142 and the heat transfer substance which are separate from the arc extinguishing member 14 but nevertheless the arc extinguisher 140 can transfer heat to the arc extinguishing member 14.

Optionally, the ventilation hole 144 may be provided to a face other than faces in the thickness direction of the arc extinguishing member 14, and for example may be provided to a face opposite the upper wall 130, or a face opposite the lower wall 131, of the arc extinguishing member 14. Note that, in consideration of transfer of heat, as shown in FIG. 26A and FIG. 26B, it is preferable that the ventilation hole 144 be provided to a face of the arc extinguishing member 14 in the thickness direction which is opposite the fixed contact 10 and the movable contact 11.

Figure 27A:
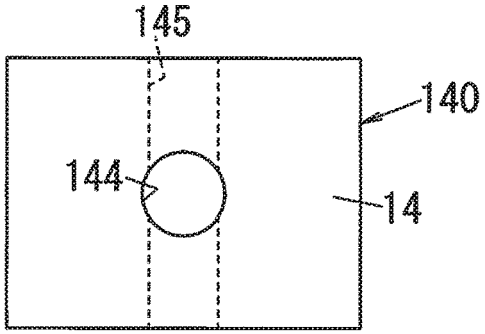
FIG. 27A is a front view of a modified arc extinguisher of the contact apparatus of Modification 10.
Figure 27B:
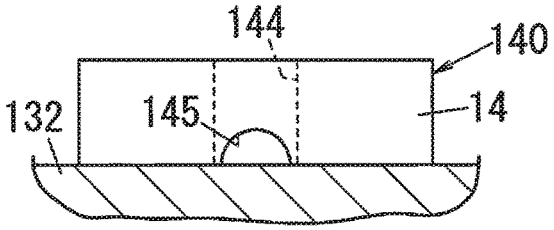
FIG. 27B is a side view of the modified arc extinguisher of the contact apparatus of Modification 10.

FIG. 27A and FIG. 27B show another example of the present modification in which the arc extinguisher 140 includes a connecting hole 145 which is formed in the arc extinguishing member 14 in a direction crossing the ventilation hole 144 so as to be connected to the ventilation hole 144. In the example shown in FIG. 27A and FIG. 27B, the connecting hole 145 has a solid half cylindrical shape and faces the side wall 132, and is formed to penetrate the arc extinguishing member 14 in the upward and downward direction (the direction in which the fixed contact 10 and the movable contact 11 face each other) and to be perpendicular to the ventilation hole 144. However, the connecting hole 145 is required to extend in a direction across the ventilation hole 144 to be connected to the ventilation hole 144, but may not have a solid half cylindrical shape, and may not penetrate the arc extinguishing member 14.

According to this example, the arc extinguisher 140 has a path for a gas constituted by the ventilation hole 144 and the connecting hole 145, and therefore a heated gas inside the space 13A can be easily guided to the inside of the ventilation hole 144 and heat of the space 13A can be transferred to the arc extinguishing member 14 efficiently.

Further, the configuration where the connecting hole 145 penetrates the arc extinguishing member 14 in the direction in which the fixed contact 10 and the movable contact 11 face each other (the upward and downward direction) as shown in FIG. 27A and FIG. 27B offers the following advantage. So, according to this configuration, the arc extinguisher 140 can guide an arc which will occur between the fixed contact 10 and the movable contact 11 to the inside of the connecting hole 145. Accordingly, the arc extinguisher 140 has a path for arcs inside the arc extinguishing member 14. Therefore, when an arc occurs, the arc extinguishing member 14 is heated by the arc drastically, and thus generation of the arc extinguishment gas is facilitated. Note that, for example, due to presence of a structure for laterally extending an arc occurring between the fixed contact 10 and the movable contact 11, such as a permanent magnet (not shown), the contact apparatus 1 can guide an arc to the inside of the arc extinguisher 140 positioned lateral to the fixed contact 10 and the movable contact 11.

Note that, other components and functions are the same as those of Modification 9.

(Modification 11)

Figure 28A:
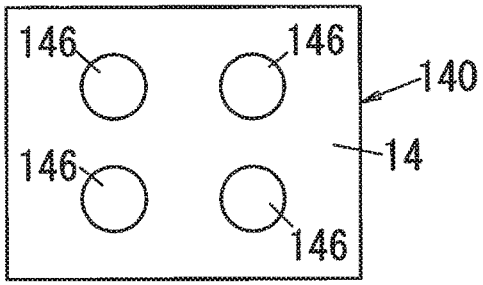
FIG. 28A is a front view of an arc extinguisher of a contact apparatus of Modification 11.
Figure 28B:
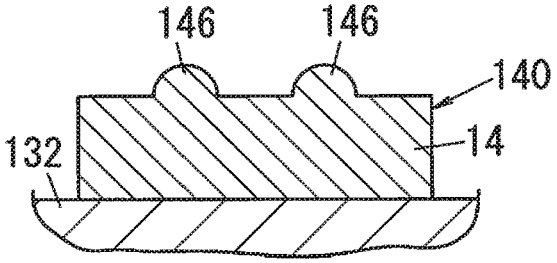
FIG. 28B is a section of the arc extinguisher of the contact apparatus of Modification 11.

As shown in FIG. 28A and FIG. 28B, the contact apparatus 1 of Modification 11 of the present embodiment is different from the contact apparatus 1 of Modification 9 in that the heat transfer structure of the arc extinguisher 140 includes an uneven structure provided to the surface of the arc extinguishing member 14 in contact with the space 13A.

Other components of the present modification are the same as those of Modification 9, and the same components as Modification 9 are designated by the same reference signs to avoid redundant explanations.

In the example shown in FIG. 28A and FIG. 28B, the arc extinguisher 140 has an uneven structure constituted by multiple protrusions 146 formed on a face of the arc extinguishing member 14 in the thickness direction which is opposite the fixed contact 10 and the movable contact 11. In this regard, the protrusions 146 are in a hemispherical shape, and are arranged in the longitudinal direction and the horizontal direction (in the example shown in FIG. 28A, two in the longitudinal direction and two in the horizontal direction).

According to the configuration of the present modification described above, the arc extinguisher 140 includes the uneven structure (the protrusions 146) serving as the heat transfer structure, and this leads to an increase in the surface area of the arc extinguishing member 14, and therefore heat of the space 13A inside the receptacle 13 can be transferred to the arc extinguishing member 14 efficiently. Further, the configuration of the present modification can offer an advantage that the arc extinguishing member 14 is processed to have an uneven structure without providing an additional member such as the skeleton member 142 (shown in FIG. 23A) and the heat transfer substance which are separate from the arc extinguishing member 14 but nevertheless the arc extinguisher 140 can transfer heat to the arc extinguishing member 14.

Optionally, the protrusions 146 may be provided to a face other than faces in the thickness direction of the arc extinguishing member 14, and for example may be provided to a face opposite the upper wall 130, or a face opposite the lower wall 131, of the arc extinguishing member 14. Note that, in consideration of transfer of heat, as shown in FIG. 28A and FIG. 28B, it is preferable that the protrusions 146 be provided to a face of the arc extinguishing member 14 in the thickness direction which is opposite the fixed contact 10 and the movable contact 11.

Note that, the uneven structure serving as the heat transfer structure is not limited to being constituted by the multiple protrusions 146 described above, but may be realized by surface treatment such as embossing to roughen the surface of the arc extinguishing member 14.

Note that, other components and functions are the same as those of Modification 9. Optionally, the configuration of the present modification may be combined with the configuration of Modification 10.

(Modification 12)

Hereinafter, the contact apparatus 1 of Modification 12 of the present embodiment is described with reference to drawings. Note that, other components of the present modification are the same as those of the embodiment, and the same components as the embodiment are designated by the same reference signs to avoid redundant explanations. When the movable contact 11 separates from the fixed contact 10, an arc is likely to occur between the fixed contact 10 and the movable contact 11. In view of this, the contact apparatus 1 of the present modification, the arc extinguishing member 14 which discharges the arc extinguishing gas with a capacity of extinguishment of an arc when heated is placed a same as a space including the contact unit 6 (the fixed contact 10 and the movable contact 11). In more detail, as shown in FIG. 1, the arc extinguishing member 14 is fixed to the inner face of the right wall of the receptacle 13 to be in a region between the fixed contact 10 and the movable contact 11 in the open position in the upward and downward direction, and thereby is close to the fixed contact 10 and the movable contact 11 on the right side. The arc extinguishing member 14 is made of a hydrogen absorbing alloy or hydrogen storage alloy absorbing hydrogen, and has a property of desorbing absorbed hydrogen (the arc extinguishing gas) quickly when heated.

When an arc occurs between the fixed contact 10 and the movable contact 11, the arc extinguishing member 14 is heated by the arc, and thus the arc extinguishing gas (hydrogen) is discharged from the arc extinguishing member 14. This arc extinguishing gas rapidly cools down the arc and therefore enables quick extinguishment of an arc. Further, in the present modification, the contact unit 6 (the fixed contact 10 and the movable contact 11) and the arc extinguishing member 14 are accommodated in the receptacle 13 with an inside space which is hermetically enclosed. In other words, the receptacle 13 hermetically encloses the inside space 13A including the contact unit 6 and the arc extinguishing member 14. Therefore, the receptacle 13 can be filled with the arc extinguishing gas to be discharged from the arc extinguishing member 14, and therefore the performance of extinguishment of an arc can be improved more. Note that, the receptacle 13 is required to enclose the contact unit 6 and the arc extinguishing member 14, but it is optional that the receptacle 13 has a hermetically enclosed space therein. For example, the receptacle 13 may have a hollow cylindrical shape with open upper and lower ends, thereby surrounding only sides of the contact unit 6 and the arc extinguishing member 14. Also in this case, when an arc occurs, the pressure of the arc extinguishing gas inside the receptacle 13 increases, and therefore the arc can be extinguished quickly.

Additionally, the arc extinguishing member 14 is situated close to the fixed contact 10 and the movable contact 11, and thus the arc extinguishing gas which is vigorously discharged from the arc extinguishing member 14 blows against the arc, and this may lead to facilitation of extinguishment of an arc.

As described above, the contact apparatus 1 of the present modification includes the contact unit 6 constituted by the fixed contact 10 and the movable contact 11, the arc extinguishing member 14, and the receptacle 13. The movable contact 11 is movable between the closed position in which the movable contact 11 is in contact with the fixed contact 10 and the open position in which the movable contact 11 is separate from the fixed contact 10. The arc extinguishing member 14 has a property of discharging the arc extinguishing gas with a capacity of extinguishment of an arc when heated. The receptacle 13 encloses the contact unit 6 and the arc extinguishing member 14.

According to the contact apparatus 1 of the present modification, when an arc occurs as a result of separation of the movable contact 11 from the fixed contact 10, the arc extinguishing gas is discharged from the arc extinguishing member 14 in the space 13A in the receptacle 13 including the contact unit 6 and the arc extinguishing member 14. Thus, the pressure of the arc extinguishing gas inside the receptacle 13 increases, and this can lead to quick extinguishment of an arc.

Note that, a component of the arc extinguishing gas discharged from the arc extinguishing member 14 may not be limited to hydrogen but may be nitrogen or the like. Further, material of the arc extinguishing member 14 may not be limited to a hydrogen absorbing alloy but may be material which discharges the arc extinguishing gas when heated. For example, the arc extinguishing member 14 may be made of a resin material such as a phenol resin, a metal material such as hydrogen absorbing metal and titanium hydride (TiH), or an inorganic material such as boric acid. Moreover, the arc extinguishing member 14 may not be limited so as to discharge the arc extinguishing gas when heated. In other words, the arc extinguishing member 14 may discharge the arc extinguishing gas even when not heated.

FIG. 1 shows the contact apparatus including the single arc extinguishing member 14, but the contact apparatus may be modified to include two or more arc extinguishing members 14. For example, another arc extinguishing member 14 may be situated close to the fixed contact 10 and the movable contact 11 on the left side. Further, the arc extinguishing member 14 may not be limited so as to have a size shown in FIG. 1.

Optionally, a gas higher in a capacity of extinguishment of an arc than air may be sealed in the receptacle 13 in advance. The air inside the receptacle 13 contains a gas with a relatively high capacity of extinguishment of an arc, and therefore, when an arc occurs, such an arc can be extinguished more quickly. Note that, a gas with a relatively high capacity of extinguishment of an arc may be exemplified by hydrogen and carbon dioxide. For example, in a case where hydrogen is sealed in the receptacle 13 in advance, it is preferable that a ratio in volume of hydrogen to air inside the receptacle 13 be equal to or greater than 50%, to ensure an effect of extinguishment of an arc achieved by hydrogen. Further, when hydrogen is preliminarily sealed in the receptacle 13, the arc extinguishing member 14 of a type suitable for use in a hydrogen atmosphere can be available.

Optionally, a gas higher in breakdown electric field strength than air may be sealed in the receptacle 13 in advance. The gas inside the receptacle 13 contains a gas with relatively high breakdown electric field strength, and therefore an electric insulating property between the fixed contact 10 and the movable contact 11 can be improved, and consequently occurrence of an arc per se can be suppressed. Note that, a gas with relatively high breakdown electric field strength may be exemplified by nitrogen ($N_2$). For example, in a case where nitrogen is sealed in the receptacle 13 in advance, an effect of extinguishment of an arc achieved by nitrogen can be obtained and occurrence of an arc per se can be suppressed. To ensure the above effect achieved by nitrogen, it is preferable that a ratio in volume of nitrogen to air inside the receptacle 13 be equal to or greater than 50%. Additionally, when nitrogen is sealed in the inside of the receptacle 13, the arc extinguishing member 14 of a type suitable for use in a nitrogen atmosphere can be available.

Optionally, a gas lower in activity than air may be sealed in the receptacle 13 in advance. By sealing a gas lower in activity than air in the receptacle 13, it is possible to use the arc extinguishing member 14 of a type which has high activity and is available only under an atmosphere of a gas lower in activity than air. Note that, a gas lower in activity than air may be exemplified by a noble gas such as helium (He), argon (Ar), neon (Ne), xenon (Xe), and krypton (Kr), or nitrogen.

(Modification 13)

Figure 29A:
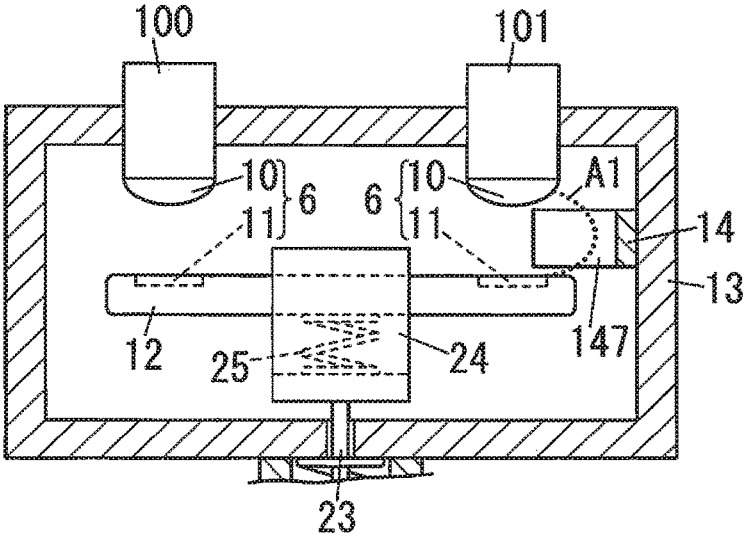
FIG. 29A and FIG. 29B are schematic configuration diagrams of a contact apparatus of Modification 13.
Figure 29B:
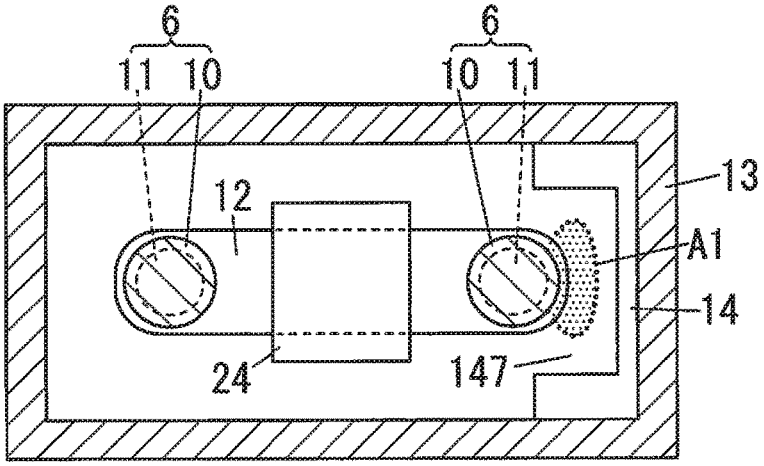

FIG. 29A and FIG. 29B are schematic configuration diagrams of the contact apparatus 1 of Modification 13 of the present embodiment. The contact apparatus 1 of the present modification includes the components of the contact apparatus 1 of Modification 12 but is different in that the arc extinguishing member 14 includes a recess 147. Note that, other components of the present modification are the same as those of Modification 12, and the same components as Modification 12 are designated by the same reference signs to avoid redundant explanations. Note that, FIG. 29B is a section of the contact apparatus 1 viewed from above, and the following description is made with the upward and downward direction in FIG. 29B being the forward and rearward direction of the contact apparatus 1. Further, in FIG. 29A and FIG. 29B, the reference sign 'A1' indicates an arc.

The arc extinguishing member 14 of the present modification continuously extends from a front end to a rear end of the inner face of the right wall of the receptacle 13. Further, the arc extinguishing member 14 includes the recess 147 in a face (left face) facing the contact unit 6 (the fixed contact 10 and the movable contact 11). When an arc occurs, the arc is covered with the arc extinguishing member 14 due to the presence of the recess 147, and therefore heat of the arc is transferred to the arc extinguishing member 14 efficiently. Additionally, the arc extinguishing gas blows against the arc in various directions, and thus the performance of extinguishment of an arc can be more improved.

Optionally, the arc extinguishing member 14 may be provided as part of the receptacle 13. Optionally, an additional structural object (e.g., an insulating plate) may be provided in a space close to the contact unit 6, and the arc extinguishing member 14 may be provided to this structural object. Or, the arc extinguishing member 14 may be provided as part of the structural object. Optionally, in a case of extending an arc by an external magnetic field or the like, the arc extinguishing member 14 may be provided to cover an extended arc.

Note that, other components and functions are the same as those of Modification 12.

(Modification 14)

Figure 30:
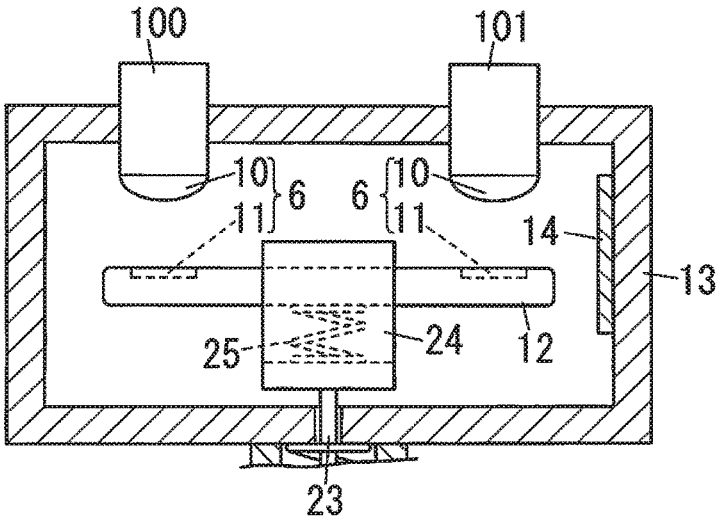
FIG. 30 is a schematic configuration diagram of a contact apparatus of Modification 14.

FIG. 30 is a schematic configuration diagram of the contact apparatus 1 of Modification 14 of the present embodiment. In the contact apparatus 1 of the present modification, the arc extinguishing member 14 has a film shape. Other components of the present modification are the same as those of Modification 12, and the same components as Modification 12 are designated by the same reference signs to avoid redundant explanations.

The arc extinguishing member 14 of the present modification is formed in a film shape, and is provided to the inner face of the right wall of the receptacle 13. A method for forming the arc extinguishing member 14 in a film shape, may be exemplified by plating, deposition, or sputtering for the arc extinguishing member 14 being made of metal material and coating for the arc extinguishing member 14 being made of resin material, for example.

When the arc extinguishing member 14 has a film shape, a whole of the arc extinguishing member 14 can be easily heated, and this can lead to a decrease in an amount of heat necessary for generating the arc extinguishing gas. Accordingly, when an arc occurs, the arc extinguishing member 14 can be heated more quickly, thereby discharging the arc extinguishing gas, and consequently it is possible to extinguish arcs more quickly.

Note that, other components and functions are the same as those of Modification 12. Optionally, the configuration of the present modification may be combined with the configuration of Modification 13.

(Modification 15)

Figure 31:
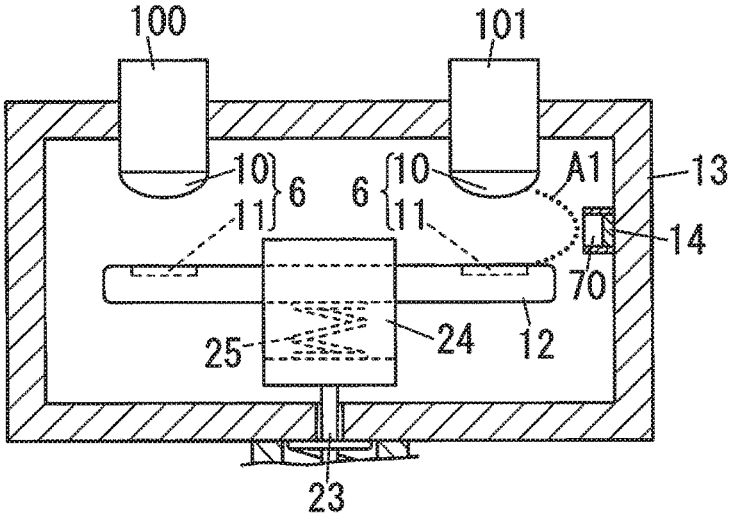
FIG. 31 is a schematic configuration diagram of a contact apparatus of Modification 15.

FIG. 31 is a schematic configuration diagram of the contact apparatus 1 of Modification 15 of the present embodiment. The contact apparatus 1 of the present modification includes the components of the contact apparatus 1 of Modification 12 and further includes a nozzle 70 for limiting a discharging direction of the arc extinguishing gas discharged from the arc extinguishing member 14 to a direction toward the contact unit 6. Other components of the present modification are the same as those of Modification 12, and the same components as Modification 12 are designated by the same reference signs to avoid redundant explanations. Further, in FIG. 31, the reference sign 'A1' indicates an arc.

The nozzle 70 is formed in a hollow cylindrical shape, and is provided to the inner face of the right wall of the receptacle 13 to surround the arc extinguishing member 14. The nozzle 70 has an opening opposite the contact unit 6 (the fixed contact 10 and the movable contact 11).

The nozzle 70 limits the discharging direction of the arc extinguishing gas discharged from the arc extinguishing member 14 and thereby the arc extinguishing gas blows against the contact unit 6 without spreading. Hence, this leads to an increase in a volume of the arc extinguishing gas to blow. When an arc occurs, the arc extinguishing gas blows so as to divide the arc, and therefore the performance of extinguishment of an arc can be improved. Additionally, the arc extinguishing gas blows against the contact unit 6, and therefore occurrence of an arc per se can be suppressed.

Note that, it is preferable that the nozzle 70 be close to the arc extinguishing member 14. For example, the nozzle 70 may be in contact with the arc extinguishing member 14. Optionally, the nozzle 70 may be formed integrally with the arc extinguishing member 14.

Note that, other components and functions are the same as those of Modification 12. Optionally, the configuration of the present modification may be combined with any one of the configurations of Modifications 13 and 14.

(Modification 16)

Figure 32:
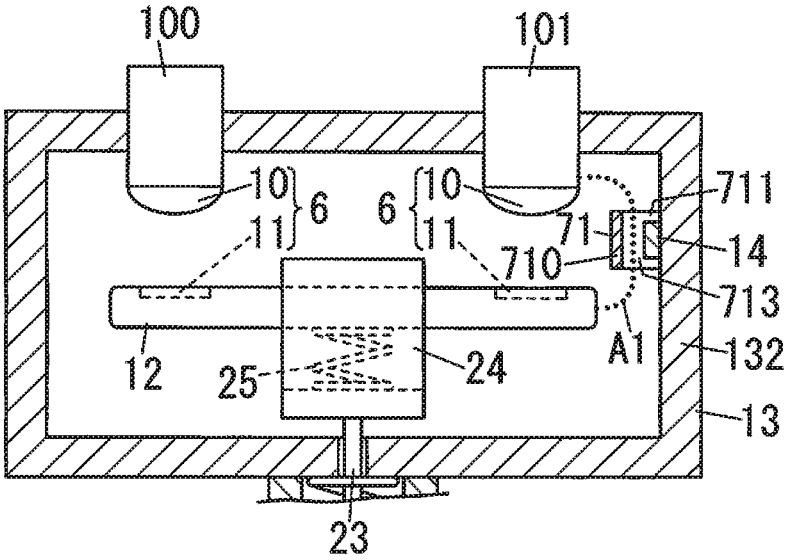
FIG. 32 is a schematic configuration diagram of a contact apparatus of Modification 16.

FIG. 32 is a schematic configuration diagram of the contact apparatus 1 of Modification 16 of the present embodiment. The contact apparatus 1 of the present modification includes the components of the contact apparatus 1 of Modification 12 and further includes a cover 71 for covering the arc extinguishing member 14. Other components of the present modification are the same as those of Modification 12, and the same components as Modification 12 are designated by the same reference signs to avoid redundant explanations. Further, in FIG. 32, the reference sign 'A1' indicates an arc.

Figure 33:
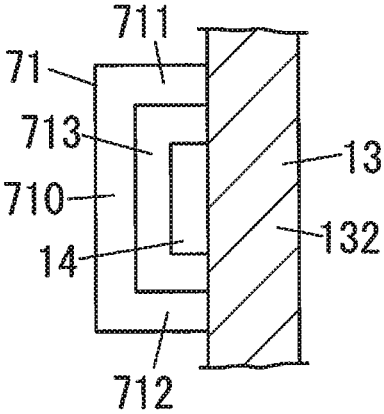
FIG. 33 is an enlarged top view of part, including a cover, of a contact apparatus of Modification 16.

FIG. 33 is a partially enlarged top view of the contact apparatus 1 including the cover 71. As shown in FIG. 32 and FIG. 33, the cover 71 is provided to the inner face of the right wall (side wall) 132 (second wall body) of the receptacle 13 so as to cover the arc extinguishing member 14 while being separate from the arc extinguishing member 14. In more detail, the cover 71 is present between the contact unit 6 and the arc extinguishing member 14, and includes a wall body 710 (first wall body) larger in an area than the arc extinguishing member 14, and the interconnecting pieces 711 and 712 respectively interconnecting front and rear ends of the wall body 710 to the inner face of the right wall 132. In other words, the cover 71 has a half hollow prism shape with an open upper end and an open lower end, and thereby forms a space enclosed by the cover 71 and the right wall 132 of the receptacle 13. The arc extinguishing member 14 is provided to the inner face of the right wall 132 so as to be in part of the space enclosed by the cover 71 and the right wall 132. Consequently, there is a gap 713 formed between the cover 71 and the arc extinguishing member 14. In summary, the contact apparatus 1 of the present modification includes the wall body 710 (first wall body) provided between the contact unit 6 and the arc extinguishing member 14, and the right wall 132 (second wall body) opposite the wall body 710 with the arc extinguishing member 14 in-between. The arc extinguishing member 14 is provided in part of the space formed between the wall body 710 and the right wall 132.

When an arc occurs, the arc extinguishing gas is discharged from the arc extinguishing member 14. In this case, the arc extinguishing member 14 is provided in the space enclosed by the cover 71 and the right wall 132, and therefore the pressure of the arc extinguishing gas in the gap 713 between the arc extinguishing member 14 and the cover 71 can be increased locally. Further, the cover 71 has a half hollow prism shape with open upper and lower ends, and therefore can cause an arc to pass through the gap 713. The arc is caused to pass through the gap 713 having the locally high pressure of the arc extinguishing gas, and therefore the performance of extinguishment of an arc can be improved. Note that, an arc may be extended toward the cover 71 with an external magnetic field, and this may facilitate passage of the arc through the gap 713.

Note that, in FIG. 32 and FIG. 33, the arc extinguishing member 14 is provided to the inner face of the right wall 132 of the receptacle 13, but may be provided to a right face of the wall body 710 of the cover 71.

Figure 34A:
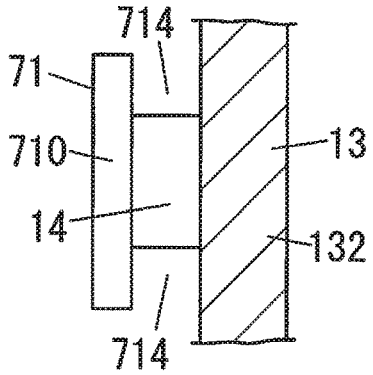
FIG. 34A and FIG. 34B are enlarged top views of part, including a modified cover, of the contact apparatus of Modification 16.

Note that, the shape of the cover 71 is not limited to the above shape, and the arc extinguishing member 14 may be provided in part of the space formed between the cover 71 and the right wall 132. For example, as shown in FIG. 34A, the cover 71 may include only the wall body 710, and the wall body 710 may be provided to the left face of the arc extinguishing member 14. In this case, the area of the wall body 710 is larger than the area of the arc extinguishing member 14, and the space between the wall body 710 and the right wall 132 includes a gap 714 where the arc extinguishing member 14 is not present. In this gap 714, the pressure of the arc extinguishing gas can be increased locally, and thus the same effect can be obtained.

Figure 34B:
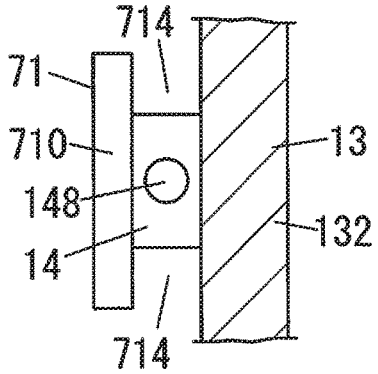

Optionally, as shown in FIG. 34B, it may be possible to form a through hole 148 penetrating the arc extinguishing member 14 in the upward and downward direction. The through hole 148 is formed in the arc extinguishing member 14, and the pressure of the arc extinguishing gas inside the through hole 148 can be more increased. Hence, the arc is caused to pass through the through hole 148, and therefore the performance of extinguishment of an arc can be more improved.

Note that, other components and functions are the same as those of Modification 12. Optionally, the configuration of the present modification may be combined with any one of the configurations of Modifications 13 to 15.

(Modification 17)

Figure 35:
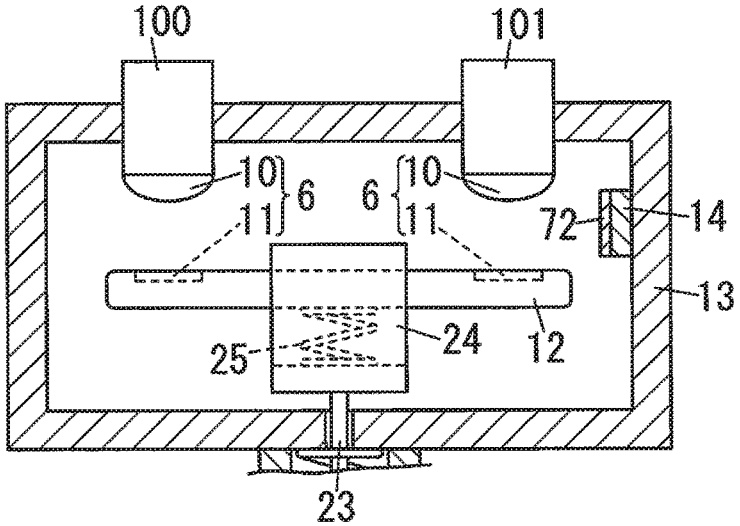
FIG. 35 is a schematic configuration diagram of a contact apparatus of Modification 17.

FIG. 35 is a schematic configuration diagram of the contact apparatus 1 of the present modification.

The contact apparatus 1 of the present modification includes the components of the contact apparatus 1 of Modification 12 and further includes a protective film 72 for protecting the arc extinguishing member 14. Other components of the present modification are the same as those of Modification 12, and the same components as Modification 12 are designated by the same reference signs to avoid redundant explanations.

The protective film 72 is made of a plate made of metal material and may be provided to the entire left face the arc extinguishing member 14 opposite the contact unit 6 (the fixed contact 10 and the movable contact 11). In summary, in the contact apparatus 1 of the present modification, the protective film 72 is provided to the face of the arc extinguishing member 14 opposite the contact unit 6. The protective film 72 prevents contact of an arc with (transfer of an arc to) the arc extinguishing member 14, and therefore deterioration of the arc extinguishing member 14 can be easily suppressed.

Note that, the protective film 72 may not be made of a plate, but may have a mesh shape. Further, the material of the protective film 72 is not limited to metal material. For example, the protective film 72 may be made of ceramic material, resin material such as epoxy resin, polyimide resin, and polytetrafluoroethylene resin, aluminum oxide, other oxide such as zirconium oxide, silicon carbide, or a mixture thereof. To transfer heat of an arc to the arc extinguishing member 14, it is preferable that the protective film 72 has high thermal conductivity and resistance to heat.

Note that, there may be need to ensure a discharging path for the arc extinguishing gas discharged from the arc extinguishing member 14. In the present modification, the protective film 72 is provided to only the left face of the arc extinguishing member 14. When the protective film 72 is made of a porous material or in a mesh shape to allow the arc extinguishing gas to pass therethrough, the protective film 72 may be provided to cover the whole of the arc extinguishing member 14.

Figure 36A:
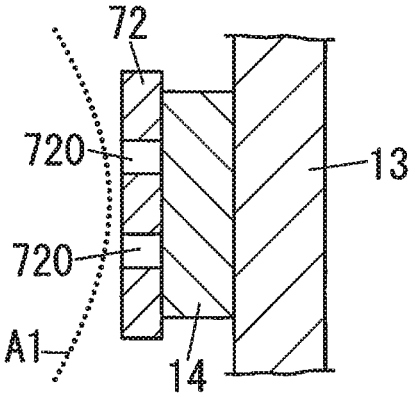
FIG. 36A is a schematic configuration diagram of a modified protective film of the contact apparatus of Modification 17.

Optionally, as shown in FIG. 36A, the protective film 72 may include one or more through holes 720. The through holes 720 extend in the thickness direction of the protective film 72. The arc extinguishing gas discharged from the arc extinguishing member 14 is allowed to blow against the contact unit 6 (the fixed contact 10 and the movable contact 11), i.e., arcs, through the through holes 720, and thereby arcs can be extinguished. Note that, to allow the arc extinguishing gas to blow against arcs to divide the arcs, it is preferable that the direction of the through holes 720 be perpendicular to the moving direction of the movable contact 11 (the upward and downward direction). Note that, the shape of the opening of the through holes 720 is not limited but may be circular or rectangular. Further, as shown in FIG. 36A, the area of the protective film 72 may be larger than the area of the arc extinguishing member 14.

Figure 36B:
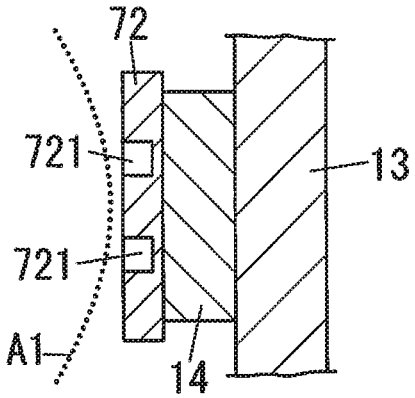
FIG. 36B is a schematic configuration diagram of a further modified protective film of the contact apparatus of Modification 17.

Note that, when the protective film 72 is made of a porous material to allow the arc extinguishing gas to pass therethrough, it may include recesses 721 in a surface thereof, as shown in FIG. 36B. In summary, in the contact apparatus 1 of the present modification, the protective film 72 may be made of a porous material and includes at least one recess 721 in its surface. In this case, bottoms of the recesses 721 are thin, and thus the arc extinguishing gas can easily pass through the bottoms. Hence, as with the configuration of including the through holes 720, the arc extinguishing gas can be allowed to blow against arcs through the recesses 721, and thereby the arcs can be extinguished.

Note that, other components and functions are the same as those of Modification 12. Optionally, the configuration of the present modification may be combined with any one of the configurations of Modifications 13 to 16.

(Modification 18)

Hereinafter, the contact apparatus 1 of Modification 18 of the present embodiment is described. Initially, the explanation is given to the background art for the contact apparatus 1 of the present modification.

In the past, there has been known an electromagnetic switch including a fixed contact, a movable contact, and an actuator for operating a movable contact to open and close a contact unit in accordance with an electric signal. In this electromagnetic switch, when the movable contact is separated from the fixed contact instantly, that is, when the contact unit is opened, an arc is likely to occur. As a method for extinguishing such an arc quickly, there has been known a method of producing a hermetically enclosed contact unit in which a space where a contact unit is placed is made to be a hermetically enclosed space and the hermetically enclosed space is filled with an arc extinguishing gas. For example, such a method is disclosed in Document 2.

In the conventional example disclosed in Document 2, a housing, a connector, a plate, and a plunger cap are hermetically bonded together so that an arc extinguishing unit including the fixed contact and the movable contact as well as a fixed core and a movable core are accommodated in the hermetically enclosed space. Thus, the housing forms the hermetically enclosed space to accommodate the fixed contact and the movable contact. The hermetically enclosed space is filled with an insulating gas (a gas with a capacity of extinguishment of an arc) mainly consisting of hydrogen.

In the conventional example, the arc extinguishment gas is sealed in the housing (receptacle) forming the hermetically enclosed space. However, even the hermetically enclosed space may allow the arc extinguishment gas to leak outside after a lapse of a long time period. This may lead to a decrease in a pressure of a gas inside the housing.

In view of the above insufficiency, the objective of the present modification is to propose a contact apparatus capable of extending the time period in which the pressure of the gas inside the receptacle is kept.

Figure 37:
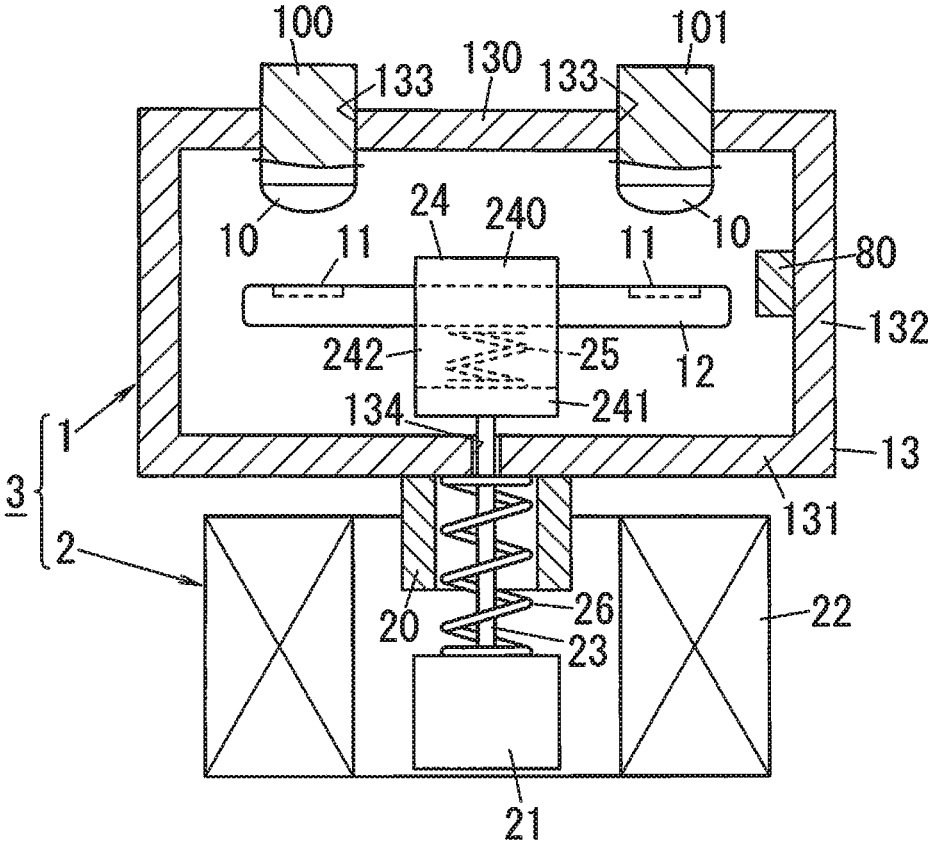
FIG. 37 is a cutaway diagram of an electromagnetic relay including a contact apparatus of Modification 18.

Hereinafter, the contact apparatus 1 of the present modification is described with reference to corresponding drawings. Note that, components common to the modification and the embodiment are designated by common reference signs to omit redundant explanations. The inside of the receptacle 13 is made to be the hermetically enclosed space, but nevertheless the arc extinguishment gas is likely to leak outside from the receptacle 13 with time. In view of this, in the contact apparatus 1 of the present modification, as shown in FIG. 37, a gas discharging member 80 to discharge a gas is provided to the side wall 132 of the receptacle 13 so as to be close to the fixed contact 10 and the movable contact 11, in order to suppress a decrease in the pressure of the gas inside the receptacle 13. The gas discharging member 80 may include ammonium dichromate capable of desorbing nitrogen, hydrogen absorbing metal capable of absorbing and desorbing hydrogen, or the like. Note that, the gas discharging member 80 may discharge a gas other than nitrogen and hydrogen. Hereinafter, the gas discharging member 80 including hydrogen absorbing metal is described.

The hydrogen absorbing metal may include metal with a relatively high affinity for hydrogen such as titanium (Ti), for example. The hydrogen absorbing metal may be selected from hydrogen absorbing alloys (hydrogen storage alloys) (described in JIS H 7003). The hydrogen absorbing alloy may be an alloy of metal with a high affinity for hydrogen and metal with a low affinity for hydrogen. The hydrogen absorbing alloy may include iron (Fe)-titanium (Ti) alloys and lanthanum (La)-nickel (Ni) alloys. Additionally, hydrogen absorbing metal may include metal hydride (MH) such as titanium hydride obtained by reaction of titanium and hydrogen.

The hydrogen absorbing metal can desorb hydrogen, and therefore can compensate for a leakage of a gas (in this case, hydrogen) from the receptacle 13 to the outside. In other words, the gas discharging member 80 including the hydrogen absorbing metal desorbs hydrogen to thereby keep the pressure of the gas inside the receptacle 13 constant. Especially, the hydrogen absorbing metal has a property of desorbing hydrogen in response to a decrease in the pressure of the hydrogen inside the receptacle 13 and of absorbing hydrogen in response to an increase in the pressure of the hydrogen inside the receptacle 13, and hence may be suitable for the gas discharging member 80.

The gas discharging member 80 may consist of hydrogen absorbing metal, or may be a mixture of hydrogen absorbing metal and a material different from hydrogen absorbing metal. Note that, a shape of the gas discharging member 80 is not limited to a plate shape shown in FIG. 37, but may be another shape. The gas discharging member 80 may be molded by metal injection molding (MIM) from a material obtained by mixing power of hydrogen absorbing metal or the like with a binder such as wax and thermoplastic resin. The gas discharging member 80 can be obtained by another method.

As described above, the contact apparatus 1 of the present modification includes: the fixed contact 10; the movable contact 11 movable between the close position in which the movable contact 11 is in contact with the fixed contact 10 and the open position in which the movable contact 11 is separate from the fixed contact 10; and the receptacle 13 which accommodates the fixed contact 10 and the movable contact 11 and form the hermetically enclosed space therein. Further, the contact apparatus 1 of the present modification includes the gas discharging member 80 for discharging a gas, and the gas discharging member 80 is accommodated in the receptacle 13 forming the hermetically enclosed space therein. Therefore, when a gas (the arc extinguishment gas) leaks outside from the receptacle 13, the contact apparatus 1 of the present modification supplies a gas discharged from the gas discharging member 80, and thereby can extend a time period in which the pressure of the gas inside the receptacle 13 is kept. Consequently, a time period in which the performance of extinguishment arcs is maintained can be extended, and thus the lifetime of the contact apparatus 1 of the present modification can be prolonged. Note that, an amount of a gas to be discharged from the gas discharging member 80 is finite, and a future decrease in the pressure of the gas inside the receptacle 13 is unavoidable. However, it is possible to keep the pressure of the gas in the receptacle 13 for a long time, compared with at least the conventional example.

The receptacle 13 may be preferably made of ceramic in order to suppress permeation of the gas from the inside to the outside. However, the gas discharging member 80 can supply a gas, and therefore limitations on designing the hermetically enclosed space can be eased. Accordingly, the hermetically enclosed space may be formed by the receptacle 13 made of material such as metal and resin other than ceramic, and hence the contact apparatus 1 of the present modification can offer an advantage of increasing the degree of freedom of the design.

Additionally, as already described above, it is preferable that the gas discharging member 80 include hydrogen absorbing metal capable of desorbing hydrogen. According to this configuration, the hydrogen absorbing metal can desorb a large amount of hydrogen, and thus the gas discharging member 80 can be downsized. Note that, the hydrogen absorbing metal can desorb hydrogen in amount 1000 times or more larger than the volume of the hydrogen absorbing metal.

Note that, it is preferable that the gas discharging member 80 discharge a gas in response to a decrease in a pressure of a gas inside the receptacle 13. To realize this configuration, it is preferable that the gas discharging member 80 include an element such as lanthanum (La), titanium (Ti), zirconium (Zr), vanadium (V), lithium (Li), and calcium (Ca) for example. According to this configuration, the gas discharging member 80 can discharge a gas when the pressure of the gas inside the receptacle 13 decreases. Therefore, this configuration can decrease ineffective discharge of a gas, and thereby prolong the lifetime of the gas discharging member 80. Further, it is preferable that the gas discharging member 80 include metal facilitating desorption of hydrogen such as chromium (Cr), manganese (Mn), iron (Fe), cobalt (Co), and nickel (Ni), for example. This configuration can offer an advantage of facilitating a reaction of desorbing hydrogen from hydrogen absorbing metal.

Note that, it is preferable that the hydrogen absorbing metal included in the gas discharging member 80 have the first range C1 (so-called plateau region) in the pressure composition isotherm shown in FIG. 19. It is preferable that B2 [MPa] of the hydrogen absorbing metal is almost equal to the pressure (predetermined pressure) of hydrogen initially sealed in the receptacle 13. In other words, it is preferable that the hydrogen absorbing metal discharge hydrogen when the pressure of the hydrogen inside the receptacle 13 falls below the predetermined pressure. According to this configuration, the hydrogen absorbing metal is suppressed from discharging hydrogen unless the pressure of the hydrogen inside the receptacle 13 falls below the predetermined pressure. Therefore, it is possible to suppress ineffective discharge of a gas, and thereby prolong the lifetime of the gas discharging member 80. Further, according to this configuration, hydrogen can be discharged easily in response to a decrease in the pressure of the gas inside the receptacle 13, and a sufficient amount of dischargeable hydrogen can be ensured.

Note that, it is preferable that the hydrogen absorbing metal have such a property that at a desired temperature the hydrogen storage capacity changes by 50% or greater of the maximum hydrogen storage capacity when the equilibrium hydrogen pressure changes by 1/50 or 50 times thereof. It is more preferable that the hydrogen absorbing metal have such a property that at a desired temperature the hydrogen storage capacity changes by 50% or greater of the maximum hydrogen storage capacity when the equilibrium hydrogen pressure changes by 1/5 or 5 times thereof.

It is preferable that the gas discharging member 80 may be mainly made of an element having an ionization tendency equal to or smaller than an ionization tendency of magnesium (Mg). According to this configuration, the gas discharging member 80 becomes unsusceptible to oxidation, and thus the hydrogen absorbing metal easily desorbs hydrogen and thereby the pressure of the gas inside the receptacle 13 can be easily kept. Further in this configuration, a reaction of absorbing hydrogen by hydrogen absorbing metal becomes faster. Therefore, time necessary for the hydrogen absorbing metal to absorb hydrogen becomes shorter, and it becomes easy to mass-produce the gas discharging member 80 storing hydrogen. Additionally, according to this configuration, the hydrogen absorbing metal is unsusceptible to oxidation even if repeating absorption and desorption, and therefore long term use can be ensured.

Note that, an oxidized film may be formed on the surface of the gas discharging member 80. In view of this, it is preferable to remove at least part of the oxidized film on the surface of the gas discharging member 80. The oxidized film on the surface of the gas discharging member 80 can be removed by a chemical method such as immersing in an acidic solution or an alkaline solution or a physical method such as polishing the surface, for example. According to this configuration, as with the above, oxidation of the gas discharging member 80 can be suppressed, and it is possible to offer an effect of easily keeping the pressure of the gas inside the receptacle 13, an effect of easily mass-production of the gas discharging member 80, and an effect of ensuring long term use of the gas discharging member 80. Further, according to this configuration, even if the gas discharging member 80 is made of an element with an ionization tendency larger than an ionization tendency of magnesium, the gas discharging member 80 can be unsusceptible to oxidation.

Preferably, the gas discharging member 80 may be under an atmosphere of at least one gas of hydrogen, nitrogen, an inactive gas, and a gas with a capacity of extinguishment of an arc. For example, preferably, the receptacle 13 may be filled with at least one gas of hydrogen, nitrogen, an inactive gas, and a gas with a capacity of extinguishment of an arc. In the contact apparatus 1 of the present modification, in view of the capacity of extinguishment of an arc, hydrogen is sealed in the receptacle 13. The inactive gas may be exemplified by a noble gas such as argon, for example. The inactive gas other than a noble gas may be available. According to this configuration, a ratio of oxygen in an atmosphere surrounding the gas discharging member 80 can be decreased, and therefore as with the above oxidation of the gas discharging member 80 can be suppressed. Consequently, according to this configuration, as with the above, it is possible to offer an effect of easily keeping the pressure of the gas inside the receptacle 13, an effect of easily mass-production of the gas discharging member 80, and an effect of ensuring long term use of the gas discharging member 80. Note that, it is preferable that a volume ratio of oxygen to the inside space of the receptacle 13 be small as possible. In view of practical use, it is preferable that the volume ratio be equal to or smaller than 5%.

Figure 38:
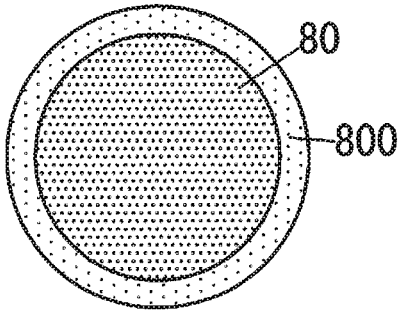
FIG. 38 is a diagram of a modified gas discharging member of the contact apparatus of Modification 18.

Note that, it is preferable that the surface of the gas discharging member 80 be covered with a layer 800 of material different from the hydrogen absorbing metal, as shown in FIG. 38. A method for forming the layer 800 may be plating or sputtering, for example. The layer 800 may be formed by another method. In this configuration, the gas discharging member 80 is protected by the layer 800 and therefore oxidation of the gas discharging member 80 can be suppressed as with the above. Consequently, according to this configuration, as with the above, it is possible to offer an effect of easily keeping the pressure of the gas inside the receptacle 13, an effect of easily mass-production of the gas discharging member 80, and an effect of ensuring long term use of the gas discharging member 80. Further, in this configuration, when the gas discharging member 80 is constituted by multiple particles, bond between the multiple particles is strong, and thus formation of the gas discharging member 80 can be facilitated. Note that, in FIG. 38, the layer 800 covers the entire surface of the gas discharging member 80, but the layer 800 may cover at least part of the surface of the gas discharging member 80. Note that, the thickness of the layer 800 may not be limited but may be preferably in a range of about 0.1 μm to 100 μm.

In this regard, preferably, the layer 800 may include a heat transfer substance which is higher in thermal conductivity than hydrogen absorbing metal. In other words, the contact apparatus 1 of the present modification may preferably include the layer 800 covering at least part of the surface of the gas discharging member 80. And, the layer 800 may preferably include a heat transfer substance higher in thermal conductivity than hydrogen absorbing metal. According to this configuration, in contrast to use of only hydrogen absorbing metal with relatively low thermal conductivity, an efficiency of heat transfer to the gas discharging member 80 can be improved. Further, the layer 800 may preferably include a catalyst substance acting as a catalyst for a reaction of desorption of hydrogen. In other words, the contact apparatus 1 of the present modification may preferably include the layer 800 covering at least part of the surface of the gas discharging member 80. And, the layer 800 may preferably include a catalyst substance acting as a catalyst for a reaction of desorption of hydrogen. According to this configuration, the catalyst activates the reaction of desorption of hydrogen by hydrogen absorbing metal. The hydrogen absorbing metal quickly desorbs hydrogen, and thereby the pressure of the gas inside the receptacle 13 can be easily kept.

The heat transfer substance and the catalyst substance may be exemplified by metal such as copper (Cu), nickel (Ni), palladium (Pd), gold (Au), silver (Ag), chromium (Cr), aluminum (Al), and zinc (Zn). Additionally, the heat transfer substance and the catalyst substance may be exemplified by resin such as epoxy resin and ceramic such as alumina. The layer 800 may be made of only one of these materials or a mixture of two or more of these materials.

Figure 39A:
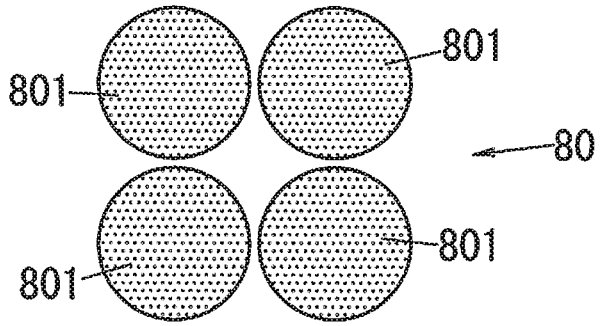
FIG. 39A is a diagram of the gas discharging member before sintering.
Figure 39B:
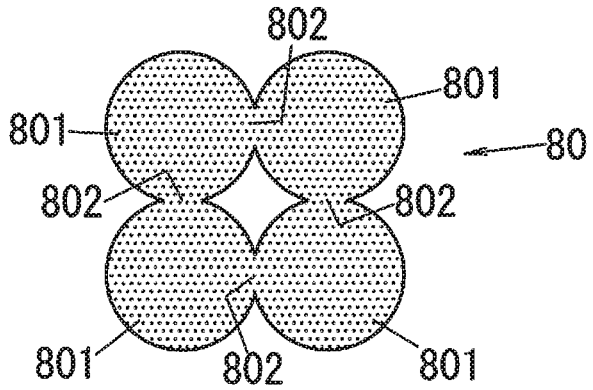
FIG. 39B is a diagram of the gas discharging member after sintering.

Optionally, the gas discharging member 80 may be subjected to treatment (so-called sintering) of heating at a temperature equal to or lower than a melting point of hydrogen absorbing metal. By subjecting the gas discharging member 80 to the treatment of heating, the shape of the gas discharging member 80 can be easily maintained for a long time. Note that, shaping of the gas discharging member 80 may be done prior to the treatment of heating. Further, the treatment of heating may be preferably made to proceed under an atmosphere of an inactive gas. Further, as shown in FIG. 39A and FIG. 39B, the treatment of heating may cause formation of cross-links 802 between particles 801 constituting the gas discharging member 80.

Figure 40A:
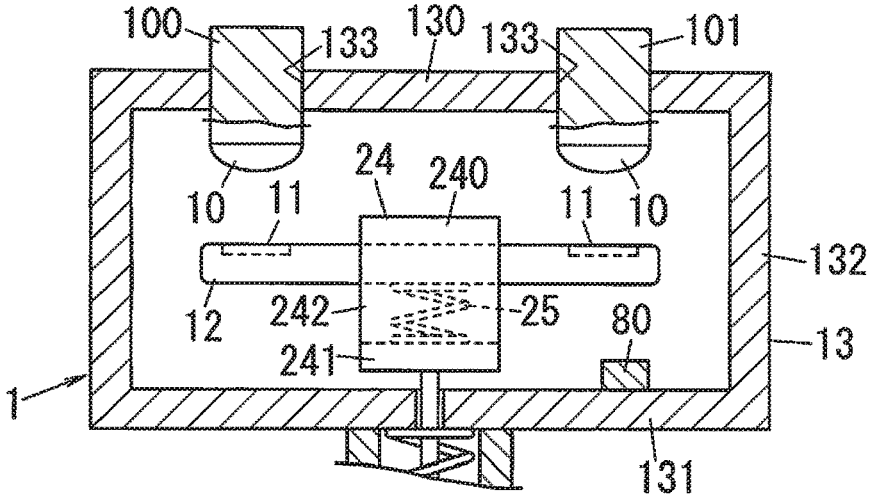
FIG. 40A, FIG. 40B, and FIG. 40C are diagrams of different arrangements of the gas discharging member in the contact apparatus of Modification 19.

Note that, the hydrogen absorbing metal may desorb hydrogen in response to reception of heat caused by energization to the excitation coil 22, heat of an arc, and the like. In practical use, it is preferable that the gas discharging member 80 desorbs a gas in response to a case of a decrease in the pressure of the gas inside the receptacle 13 and does not desorb a gas in other cases. In view of this, it is preferable that the gas discharging member 80 be provided outside the region between the fixed contact 10 and the movable contact 11 in the moving direction of the movable contact 11 (the upward and downward direction) inside the receptacle 13. For example, as shown in FIG. 40A, it is preferable to provide the gas discharging member 80 to the lower wall 131 of the receptacle 13. According to this configuration, transfer of heat caused by energization to the excitation coil 22, heat of an arc, and the like to the gas discharging member 80 can be suppressed, and thus an increase in the temperature of the gas discharging member 80 can be suppressed. Therefore, this configuration can suppress discharge of a gas caused by an increase in the temperature of the gas discharging member 80, and therefore ineffective discharge of a gas can be avoided and thus the lifetime of the gas discharging member 80 can be prolonged. Note that, in the example shown in FIG. 40A, the gas discharging member 80 is provided to the lower wall 131 of the receptacle 13, but the location of the gas discharging member 80 is not limited to this position.

Figure 40B:
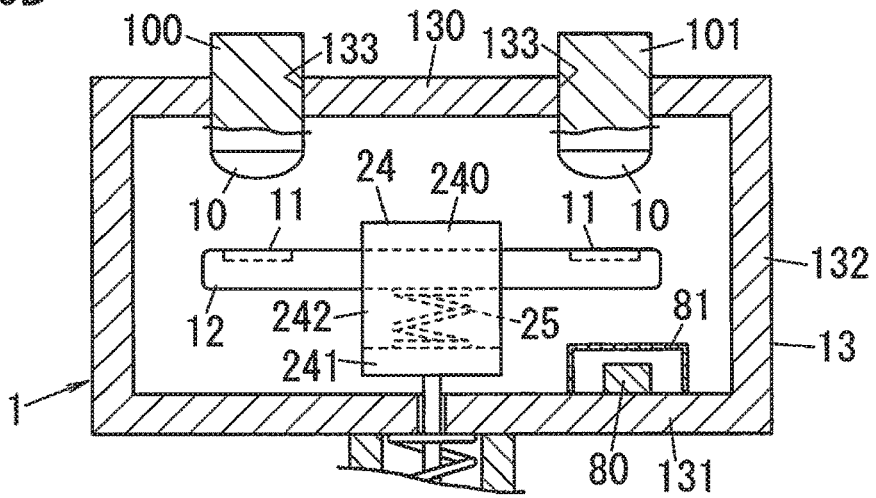

As shown in FIG. 40B, it is preferable that a shielding member 81 for preventing transfer of heat to the gas discharging member 80 be provided between a pair of the fixed contact 10 and the movable contact 11 and the gas discharging member 80. The shielding member 81 may be made of metal, resin, or oxide, for example. As shown in FIG. 40B, the shielding member 81 may be formed to surround the gas discharging member 80, but may be formed in another shape providing that the shielding member 81 can isolate the pair of the fixed contact 10 and the movable contact 11 from the gas discharging member 80. Further, the shielding member 81 may not be in close contact with the gas discharging member 80, and may be spaced from the gas discharging member 80. According to this configuration, as with the above, it is possible to suppress discharge of a gas caused by an increase in the temperature of the gas discharging member 80, and therefore ineffective discharge of a gas can be suppressed and then the lifetime of the gas discharging member 80 can be prolonged. Note that, in the example shown in FIG. 40B, the gas discharging member 80 and the shielding member 81 are provided to the lower wall 131 of the receptacle 13, but the location of the gas discharging member 80 is not limited to this position. For example, the gas discharging member 80 and the shielding member 81 may be provided in a region between the fixed contact 10 and the movable contact 11 in the moving direction of the movable contact 11 (the upward and downward direction) inside the receptacle 13.

Figure 40C:
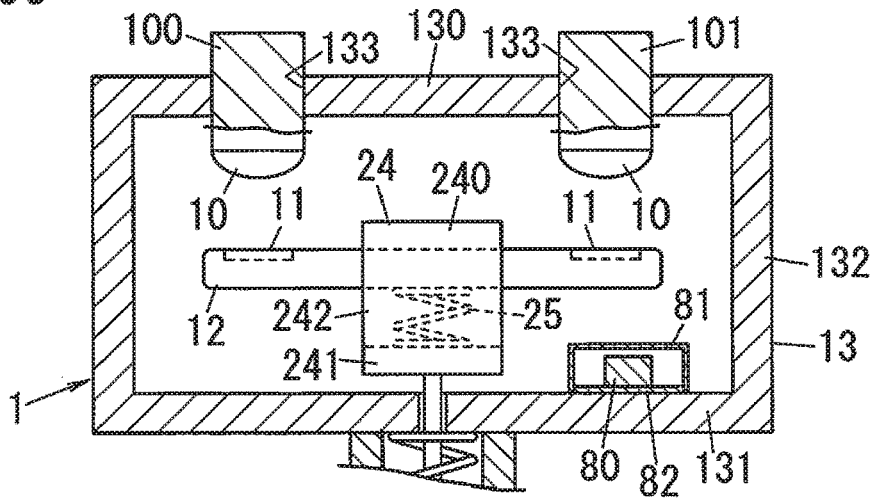

As shown in FIG. 40C, it is preferable to provide a thermally insulating member 82 between the gas discharging member 80 and the receptacle 13. The thermally insulating member 82 may be made of material, such as resin, metal, and oxide, lower in thermal conductivity than the gas discharging member 80. For example, such material may be exemplified by polyimide resin, epoxy resin, honeycomb ceramic, and the like. According to this configuration, transfer of heat to the gas discharging member 80 through the receptacle 13 can be suppressed, and thus an increase in the temperature of the gas discharging member 80 can be more suppressed. Note that, the thermally insulating member 82 may be provided together with the shielding member 81 while the gas discharging member 80 is provided in a position shown in FIG. 40C. However, the thermally insulating member 82 may be provided in another way. For example, the thermally insulating member 82 may be provided together with the shielding member 81 while the gas discharging member 80 is provided in a region between the fixed contact 10 and the movable contact 11 in the moving direction of the movable contact 11 (the upward and downward direction) inside the receptacle 13. Note that, the thermally insulating member 82 may or may not be provided together with the shielding member 81.

Note that, the gas discharging member 80 may discharge a gas spontaneously. In this regard, discharging a gas spontaneously means discharging a gas with time. For example, the gas discharging member 80 discharges a gas at a constant rate with time, even when a temperature and a pressure are constant. According to this configuration, the gas discharging member 80 discharges a gas independent from conditions such as the surrounding temperature and the pressure of the gas inside the receptacle 13. Therefore, according to this configuration, it is possible to design the gas discharging member 80 without considering the conditions for discharging a gas, and thus designing can be facilitated.

Note that, the contact apparatus 1 of the present modification is used in combination with the electromagnetic apparatus 2 of a so-called plunger type, but may be used in combination with the electromagnetic apparatus 4 of a so-called hinge type shown in FIG. 4A and FIG. 4B. In the electromagnetic relay 5, the gas discharging member 80 is provided, instead of the arc extinguishing member 14 shown in FIG. 4A and FIG. 4B, to the inner wall of the receptacle 13 to be close to the fixed contact 10 and the movable contact 11. Note that, a location of the gas discharging member 80 is not limited to the above position.

(Modification 19)

Hereinafter, the contact apparatus 1 of Modification 19 of the present embodiment is described. Initially, the explanation is given to the background art for the contact apparatus 1 of the present modification.

In the past, there has been known a contact apparatus including a fixed contact and a movable contact movable between a closed position in which the movable contact is in contact with the fixed contact and an open position in which the movable contact is separate from the fixed contact. Such a contact apparatus is disclosed in Document 3 (JP 2012-089487 A), for example. The conventional example disclosed in Document 3 includes a contact block including a sealed receptacle accommodating the fixed contact and the movable contact, and an arc extinguishment unit for extinguishing arcs occurring between the fixed contact and the movable contact.

The arc extinguishment unit includes a yoke attached to a periphery of the sealed receptacle, and permanent magnets attached to the yoke so that the fixed contact and the movable contact are positioned between the permanent magnets. The arc extinguishment unit causes a magnetic field to extend arcs occurring when the movable contact separates from the fixed contact, thereby extinguishing the arcs.

In the conventional example, the permanent magnets and the yoke constituting the arc extinguishment unit is situated outside the sealed receptacle, and therefore the permanent magnet and the yoke are far from the fixed contact and the movable contact. Therefore, to ensure a magnetic field necessary for extending arcs, it is necessary to increase sizes of the permanent magnets and the yoke, and this leads to a problem that downsizing and lowering cost are difficult.

In view of the above insufficiency, the objective of the present modification is to propose a contact apparatus capable of being downsized and manufactured at a lowered cost.

Figure 41:
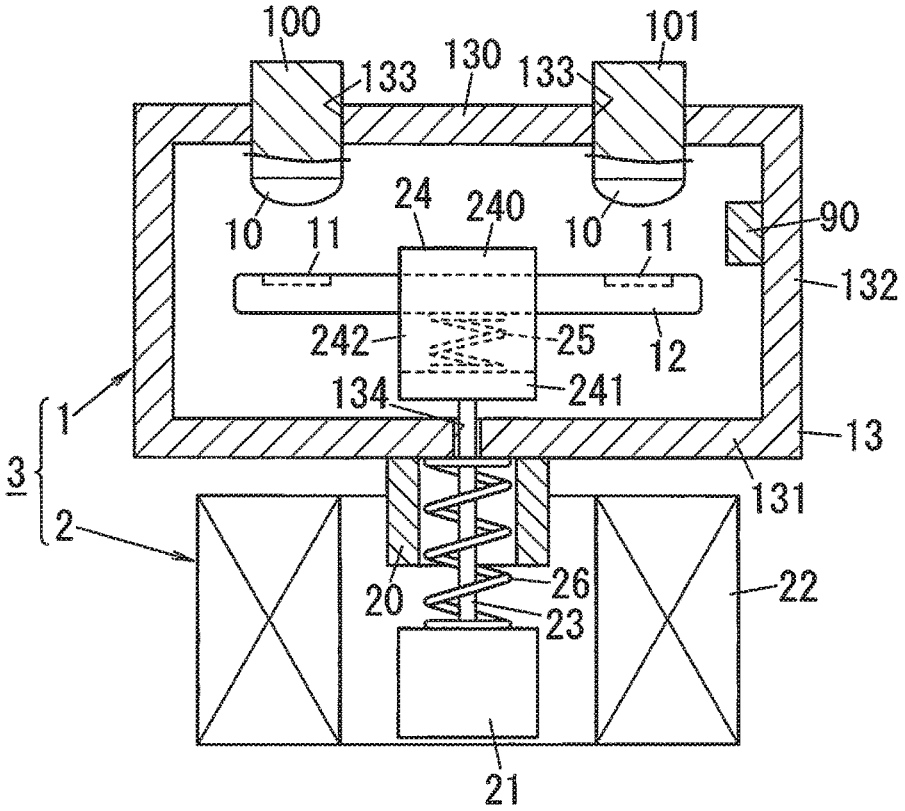
FIG. 41 is a cutaway diagram of an electromagnetic relay including a contact apparatus of Modification 19.

Hereinafter, the contact apparatus 1 of the present modification is described with reference to corresponding drawings. Note that, components common to the modification and the embodiment are designated by common reference signs to omit redundant explanations. The contact apparatus 1 of the present modification includes a first magnetic field generation source which is accommodated in the receptacle 13 and is for generating a magnetic field. The first magnetic field generation source may be constituted by a permanent magnet such as a ferrite magnet and an electromagnet consisting of a coil surrounding a body of a magnetic material, for example. Optionally, the first magnetic field generation source may be constituted by a magnetic member including a magnetic material. As shown in FIG. 41, in the contact apparatus 1 of the present modification, a magnetic member 90 serving as the first magnetic field generation source is provided to the side wall 132 of the receptacle 13 so as to be close to the fixed contact 10 and the movable contact 11. In the following explanation, the magnetic member 90 including hydrogen absorbing metal for absorbing and desorbing hydrogen is treated as the first magnetic field generation source. For example, the magnetic member 90 includes, as a magnetic material, hydrogen absorbing metal for desorbing hydrogen.

The hydrogen absorbing metal may include metal with a relatively high affinity for hydrogen such as titanium (Ti), for example. The hydrogen absorbing metal may be selected from hydrogen absorbing alloys (hydrogen storage alloys)

(described in JIS H 7003). The hydrogen absorbing alloy may be an alloy of metal with a high affinity for hydrogen and metal with a low affinity for hydrogen. The hydrogen absorbing alloy may include iron (Fe)-titanium (Ti) alloys and lanthanum (La)-nickel (Ni) alloys. Additionally, hydrogen absorbing metal may include metal hydride (MH) such as titanium hydride obtained by reaction of titanium and hydrogen.

The magnetic member 90 may consist of hydrogen absorbing metal, or may be a mixture of hydrogen absorbing metal and a material different from hydrogen absorbing metal. Note that, a shape of the magnetic member 90 is not limited to a plate shape shown in FIG. 41, but may be another shape. The magnetic member 90 may be molded by metal injection molding (MIM) from a material obtained by mixing power of hydrogen absorbing metal or the like with a binder such as wax and thermoplastic resin. The magnetic member 90 can be obtained by another method.

As described above, the contact apparatus 1 of the present modification includes the fixed contact 10, the movable contact 11 movable between the closed position in which the movable contact 11 is in contact with the fixed contact 10 and the open position in which the movable contact 11 is separate from the fixed contact 10, and the receptacle 13 which accommodates the fixed contact 10 and the movable contact 11 and forms the hermetically enclosed space therein. Further, the contact apparatus 1 of the present modification includes the magnetic member 90 (the first magnetic field generation source) for generating a magnetic field accommodated in the receptacle 13. Therefore, in contrast to a case where a magnetic field is applied from the outside of the receptacle 13, the contact apparatus 1 of the present modification can apply a magnetic field to an arc occurring between the fixed contact 10 and the movable contact 11 from a position closer to the arc. Accordingly, the contact apparatus 1 of the present modification is capable of ensuring a magnetic field necessary for extending arcs without increasing the size of the first magnetic field generation source, and thereby can be downsized and manufactured at a lowered cost.

The hydrogen absorbing metal has a property of desorbing hydrogen when the temperature thereof is increased by heat such as heat caused by energization to the excitation coil 22 and heat of an arc, for example. Therefore, when the first magnetic field generation source is the magnetic member 90 including the hydrogen absorbing metal, hydrogen desorbed from the hydrogen absorbing metal blows against arcs, and this can offer an advantage of extinguishing arcs quickly. Further, according to this configuration, hydrogen desorbed from the hydrogen absorbing metal blows off arcs, and therefore exposure of the magnetic member 90 to arcs can be suppressed. Consequently, this configuration can also offer an advantage of suppressing deterioration of the magnetic property of the magnetic member 90 which would otherwise be caused by exposure to arcs.

Figure 42:
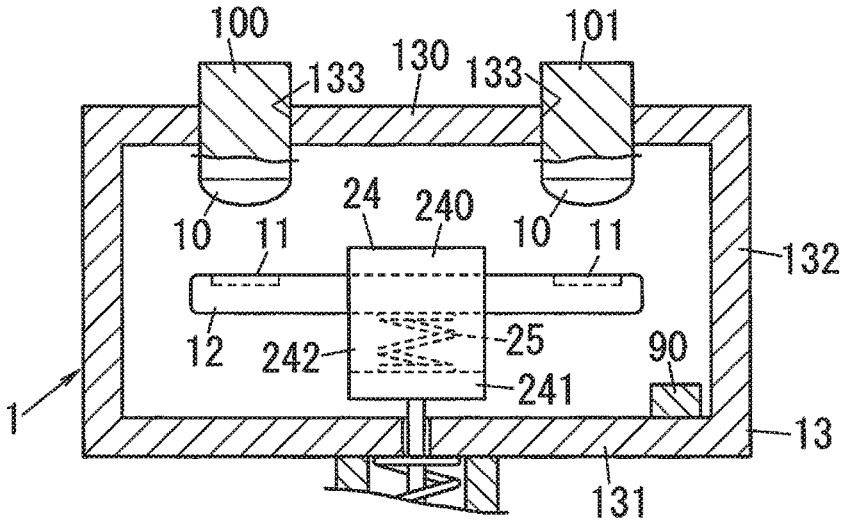
FIG. 42 is a diagram of the contact apparatus of Modification 19 in which the magnetic member is situated in another position.

It is preferable that, as shown in FIG. 41, the magnetic member 90 be provided in a region between the fixed contact 10 and the movable contact 11 in the moving direction of the movable contact 11 (the upward and downward direction) inside the receptacle 13. According to this configuration, the magnetic member 90 is provided close to the fixed contact 10 and the movable contact 11, and therefore it is possible to apply a magnetic field to arcs efficiently, and this can lead to improvement of the performance of extinguishment of an arc. Note that, the location of the magnetic member 90 is not limited to the position shown in FIG. 41. For example, as shown in FIG. 42, the magnetic member 90 may be situated on the lower wall 131 of the receptacle 13 not to overlap the movable contact member 12 in the upward and downward direction.

Figure 43:
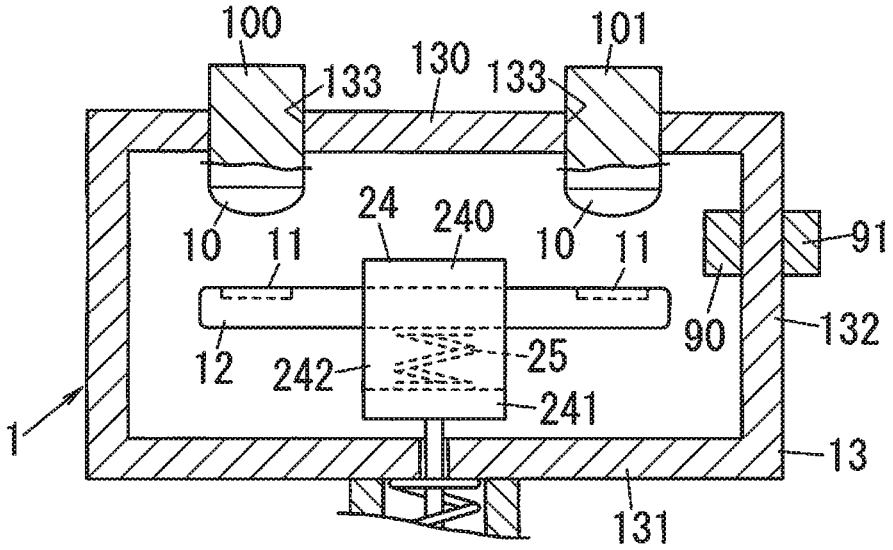
FIG. 43 is a diagram of the contact apparatus of Modification 19 in which the magnetic member is situated outside the receptacle.

Optionally, as shown in FIG. 43, the contact apparatus 1 of the present modification may be configured to include a second magnetic field generation source 91 which is provided outside the receptacle 13 and is for generating a magnetic field. For example, as with the first magnetic field generation source, the second magnetic field generation source 91 may be constituted by a permanent magnet, an electromagnet, a magnetic member, or the like. According to this configuration, the magnetic field generated by the magnetic member 90 serving as the first magnetic field generation source can be reinforced by the magnetic field generated by the second magnetic field generation source 91.

Figure 44:
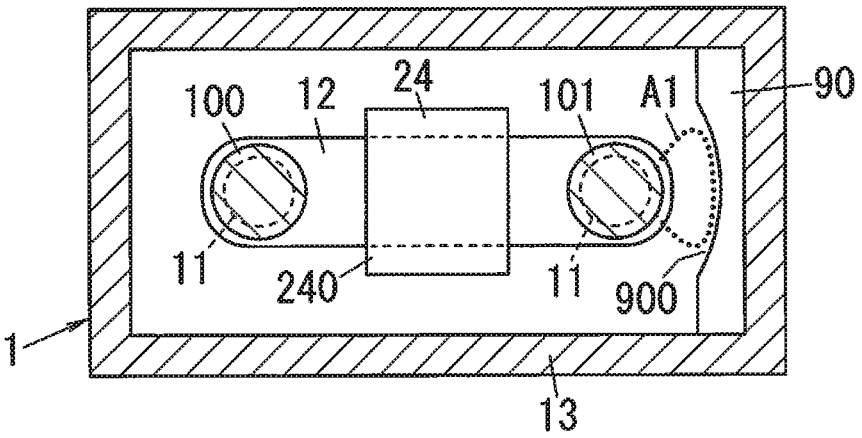
FIG. 44 is a diagram of a modified magnetic member of the contact apparatus of Modification 19.

Optionally, as shown in FIG. 44, the magnetic member 90 may include a recess 900 which is a curved recess so that a center of the magnetic member 90 in the lengthwise direction is set back to be farther from the fixed contact 10 and the movable contact 11 when viewed form the upper side of the magnetic member 90. According to this configuration, a magnetic field caused by arcs can extend the arcs quickly. In FIG. 44, a broken line of 'A1' indicates an arc extended to the recess 900. Therefore, this configuration can improve the performance of extinguishment of an arc. Note that, the shape of the recess 900 is not limited to the shape shown in FIG. 44, but may be such a shape that at least the center of the magnetic member 90 in the lengthwise direction is set back to be farther from the fixed contact 10 and the movable contact 11 when viewed form the upper side of the magnetic member 90.

It is preferable that the magnetic member 90 include the hydrogen absorbing metal and another magnetic material higher in magnetic permeability than the hydrogen absorbing metal. In more detail, it is preferable that the magnetic member 90 include a ferromagnetic material such as iron (Fe) and cobalt (Co) for example.

According to this configuration, the magnetic member 90 can generate a stronger magnetic field, and therefore the performance of extinguishment of an arc can be improved.

It is preferable that the magnetic member 90 may be mainly made of an element having an ionization tendency equal to or smaller than an ionization tendency of magnesium (Mg). According to this configuration, the magnetic member 90 becomes unsusceptible to oxidation, and thus deterioration of the magnetic property of the magnetic member 90 can be suppressed. Further in this configuration, it is possible to decrease the probability that the oxidized film inhibits absorption and desorption of hydrogen, and therefore a reaction of absorbing hydrogen by hydrogen absorbing metal becomes faster. Therefore, time necessary for the hydrogen absorbing metal to absorb hydrogen becomes shorter, and it becomes easy to mass-produce the magnetic member 90 storing hydrogen. Additionally, according to this configuration, the hydrogen absorbing metal is unsusceptible to oxidation even if repeating absorption and desorption, and therefore long term use can be ensured.

Note that, an oxidized film may be formed on the surface of the magnetic member 90. In view of this, it is preferable to remove at least part of the oxidized film on the surface of the magnetic member 90. The oxidized film on the surface of the magnetic member 90 can be removed by a chemical method such as immersing in an acidic solution or an alkaline solution or a physical method such as polishing the surface, for example. According to this configuration, as with the above, oxidation of the magnetic member 90 can be suppressed, and it is possible to offer an effect of suppressing deterioration of the magnetic property of the magnetic member 90, an effect of easily mass-production of the magnetic member 90, and an effect of ensuring long term use of the magnetic member 90. Further, according to this configuration, even if the magnetic member 90 is made of an element with an ionization tendency larger than an ionization tendency of magnesium, the magnetic member 90 can be unsusceptible to oxidation.

Preferably, the magnetic member 90 may be under an atmosphere of at least one gas of hydrogen, nitrogen, an inactive gas, and a gas with a capacity of extinguishment of an arc. For example, preferably, the receptacle 13 may be filled with at least one gas of hydrogen, nitrogen, an inactive gas, and a gas with a capacity of extinguishment of an arc. In the contact apparatus 1 of the present modification, in view of the capacity of extinguishment of an arc, hydrogen is sealed in the receptacle 13. The inactive gas may be exemplified by a noble gas such as argon, for example. The inactive gas other than a noble gas may be available. According to this configuration, a ratio of oxygen in an atmosphere surrounding the magnetic member 90 can be decreased, and therefore as with the above oxidation of the magnetic member 90 can be suppressed. Consequently, according to this configuration, as with the above, it is possible to offer an effect of suppressing deterioration of the magnetic property of the magnetic member 90, an effect of easily mass-production of the magnetic member 90, and an effect of ensuring long term use of the magnetic member 90. Note that, it is preferable that a volume ratio of oxygen to the inside space of the receptacle 13 be small as possible. In view of practical use, it is preferable that the volume ratio be equal to or smaller than 5%.

Figure 45:
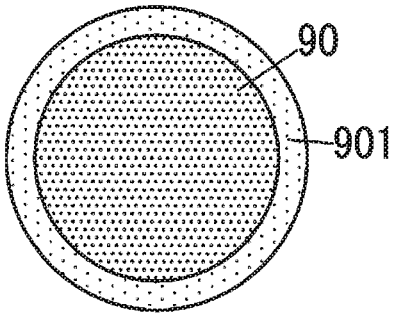
FIG. 45 is a diagram of the magnetic member provided with a layer, of the contact apparatus of Modification 19.

Note that, it is preferable that the surface of the magnetic member 90 be covered with a layer 901 of material different from the hydrogen absorbing metal, as shown in FIG. 45. A method for forming the layer 901 may be plating or sputtering, for example. The layer 901 may be formed by another method. In this configuration, the magnetic member 90 is protected by the layer 901 and therefore oxidation of the magnetic member 90 can be suppressed as with the above. Consequently, according to this configuration, as with the above, it is possible to offer an effect of suppressing deterioration of the magnetic property of the magnetic member 90, an effect of easily mass-production of the magnetic member 90, and an effect of ensuring long term use of the magnetic member 90. Further, in this configuration, when the magnetic member 90 is constituted by multiple particles, bond between the multiple particles is strong, and thus formation of the magnetic member 90 can be facilitated. Note that, in FIG. 45, the layer 901 covers the entire surface of the magnetic member 90, but the layer 901 may cover at least part of the surface of the magnetic member 90. Note that, the thickness of the layer 901 may not be limited but may be preferably in a range of about 0.1 to 100 μm.

In this regard, preferably, the layer 901 may include a heat transfer substance which is higher in thermal conductivity than hydrogen absorbing metal. In other words, the contact apparatus 1 of the present modification may preferably include the layer 901 covering at least part of the surface of the magnetic member 90. And, the layer 901 may preferably include a heat transfer substance higher in thermal conductivity than hydrogen absorbing metal. According to this configuration, in contrast to use of only hydrogen absorbing metal with relatively low thermal conductivity, an efficiency of heat transfer to the magnetic member 90 can be improved. Further, the layer 901 may preferably include a catalyst substance acting as a catalyst for a reaction of desorption of hydrogen. In other words, the contact apparatus 1 of the present modification may preferably include the layer 901 covering at least part of the surface of the magnetic member 90. And, the layer 901 may preferably include a catalyst substance acting as a catalyst for a reaction of desorption of hydrogen. According to this configuration, the catalyst activates the reaction of desorption of hydrogen by hydrogen absorbing metal. The hydrogen absorbing metal quickly desorbs hydrogen, and thereby arcs can be extinguished quickly.

The heat transfer substance and the catalyst substance may be exemplified by metal such as copper (Cu), nickel (Ni), palladium (Pd), gold (Au), silver (Ag), chromium (Cr), aluminum (Al), and zinc (Zn). Additionally, the heat transfer substance and the catalyst substance may be exemplified by resin such as epoxy resin and ceramic such as alumina. The layer 901 may be made of only one of these materials or a mixture of two or more of these materials.

Figure 46A:
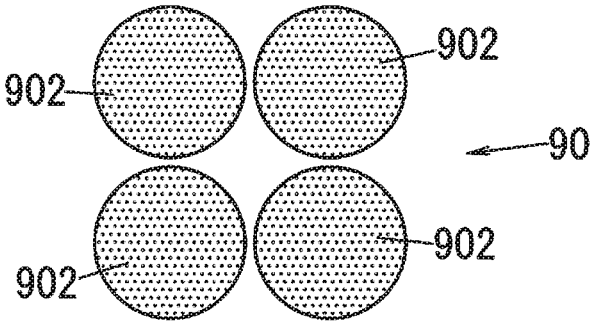
FIG. 46A is a diagram of the magnetic member before sintering.
Figure 46B:
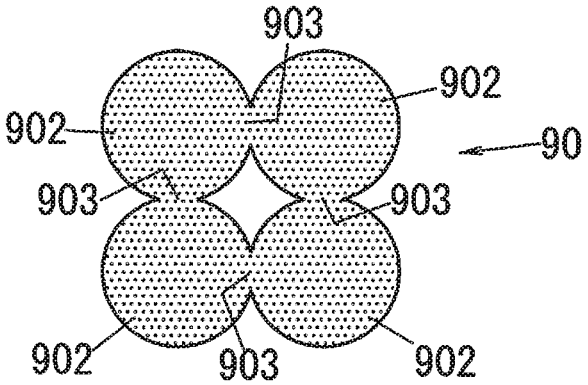
FIG. 46B is a diagram of the magnetic member after sintering.

Optionally, the magnetic member 90 may be subjected to treatment (so-called sintering) of heating at a temperature equal to or lower than a melting point of hydrogen absorbing metal. By subjecting the magnetic member 90 to the treatment of heating, the shape of the magnetic member 90 can be easily maintained for a long time. Note that, shaping of the magnetic member 90 may be done prior to the treatment of heating. Further, the treatment of heating may be preferably made to proceed under an atmosphere of an inactive gas. Further, as shown in FIG. 46A and FIG. 46B, the treatment of heating may cause formation of cross-links 903 between particles 902 constituting the magnetic member 90.

The magnetic member 90 described above includes the hydrogen absorbing metal. However, the magnetic member 90 may be made of a magnetic material other than the hydrogen absorbing metal. In this configuration, the hydrogen absorbing metal is not used, and this offers an advantage that hydrogen is not discharged when hydrogen is unnecessary. Further, this configuration offers an advantage that a magnetic material less expensive than the hydrogen absorbing metal can be used. Further, various magnetic materials other than the hydrogen absorbing metal are available, and therefore this configuration offers an advantage that the degree of freedom of the design the magnetic member 90 is increased. Note that, the magnetic member 90 may be required to be made of a magnetic material other than the hydrogen absorbing metal but may be part of a component constituting the contact apparatus 1.

Note that, the contact apparatus 1 of the present modification is used in combination with the electromagnetic apparatus 2 of a so-called plunger type, but may be used in combination with the electromagnetic apparatus 4 of a so-called hinge type shown in FIG. 4A and FIG. 4B. In the electromagnetic relay 5, the magnetic member 90 is provided, instead of the arc extinguishing member 14 shown in FIG. 4A and FIG. 4B, to the inner wall of the receptacle 13 to be close to the fixed contact 10 and the movable contact 11. Note that, a location of the magnetic member 90 is not limited to the above position.

As described above, the contact apparatus 1 of the present embodiment includes the following first feature.

In the first feature, the contact apparatus 1 includes a fixed contact 10, a movable contact 11, and an arc extinguishing member 14. The movable contact 11 is movable between a closed position where the movable contact 11 is in contact with the fixed contact 10 and an open position where the movable contact 11 is separate from the fixed contact 10. The arc extinguishing member 14 is for discharging an arc extinguishing gas offering a capacity for extinguishment of an arc, into a space 13A containing the fixed contact 10 and the movable contact 11.

Optionally, the contact apparatus 1 of the present embodiment may include the following second feature in combination with the first feature.

In the second feature, the arc extinguishing member 14 discharges the arc extinguishing gas when heated.

Optionally, the contact apparatus 1 of the present embodiment may include the following third feature in combination with the first or second feature.

In the third feature, the contact apparatus 1 further includes a gas flow generator 16 for causing a flow of gas inside the space 13A.

Optionally, the contact apparatus 1 of the present embodiment may include the following fourth feature in combination with any one of the first to third features.

In the fourth feature, the gas flow generator 16 causes the flow of gas by discharging a gas when heated.

Optionally, the contact apparatus 1 of the present embodiment may include the following fifth feature in combination with the first feature.

In the fifth feature, the arc extinguishing member 14 includes hydrogen absorbing metal for discharging hydrogen.

Optionally, the contact apparatus 1 of the present embodiment may include the following sixth feature in combination with the fifth feature.

In the sixth feature, the arc extinguishing member 14 discharges the hydrogen from the hydrogen absorbing metal when heated.

Optionally, the contact apparatus 1 of the present embodiment may include the following seventh feature in combination with the fifth or sixth feature.

In the seventh feature, the contact apparatus 1 further includes a layer 14A covering at least part of a surface of the arc extinguishing member 14. The layer 14A includes a heat transfer substance higher in thermal conductivity than the hydrogen absorbing metal.

Optionally, the contact apparatus 1 of the present embodiment may include the following eighth feature in combination with any one of the fifth to seventh features.

In the eighth feature, the contact apparatus 1 further includes a layer 14A covering at least part of a surface of the arc extinguishing member 14. The layer 14A includes a catalyst substance acting as a catalyst for a reaction in which the hydrogen absorbing metal desorbs the hydrogen.

Optionally, the contact apparatus 1 of the present embodiment may include the following ninth feature in combination with any one of the fifth to eighth features.

In the ninth feature, the arc extinguishing member 14 includes a catalyst material acting as a catalyst for a reaction in which the hydrogen absorbing metal desorbs the hydrogen.

Optionally, the contact apparatus 1 of the present embodiment may include the following tenth feature in combination with the second feature.

In the tenth feature, the contact apparatus 1 further includes an arc extinguisher 140 including the arc extinguishing member 14. The arc extinguisher 140 has a heat transfer structure for improving an efficiency of transfer of heat from the space 13A to the arc extinguishing member 14.

Optionally, the contact apparatus 1 of the present embodiment may include the following eleventh feature in combination with the tenth feature.

In the eleventh feature, the heat transfer structure includes a skeleton member 142 of a material higher in thermal conductivity than the arc extinguishing member 14. The skeleton member 142 includes a hole 141 receiving at least part of the arc extinguishing member 14.

Optionally, the contact apparatus 1 of the present embodiment may include the following twelfth feature in combination with the tenth or eleventh feature.

In the twelfth feature, the heat transfer structure includes a heat transfer substance of a material higher in thermal conductivity than the arc extinguishing member 14. The heat transfer substance is mixed in the arc extinguishing member 14.

Optionally, the contact apparatus 1 of the present embodiment may include the following thirteenth feature in combination with any one of the tenth to twelfth features.

In the thirteenth feature, the arc extinguisher 140 includes a highly resistive substance of a material higher in electric resistivity than the arc extinguishing member 14. The highly resistive substance is mixed in the arc extinguishing member 14.

Optionally, the contact apparatus 1 of the present embodiment may include the following fourteenth feature in combination with the second feature.

In the fourteenth feature, the contact apparatus 1 further includes a receptacle 13 enclosing a contact unit 6 constituted by the fixed contact 10 and the movable contact 11, and the arc extinguishing member 14. The arc extinguishing member 14 includes a recess 147 on a surface facing the contact unit 6.

Optionally, the contact apparatus 1 of the present embodiment may include the following fifteenth feature in combination with the fourteenth feature.

In the fifteenth feature, a protective film 72 is on a surface of the arc extinguishing member 14 facing the contact unit 6.

Optionally, the contact apparatus 1 of the present embodiment may include the following sixteenth feature in combination with the fifteenth feature.

In the sixteenth feature, the protective film 72 includes a through hole 720.

Optionally, the contact apparatus 1 of the present embodiment may include the following seventeenth feature in combination with the fifteenth or sixteenth feature.

In the seventeenth feature, the protective film 72 is made of a porous material and includes a recess in a surface.

The invention claimed is:

1. A contact apparatus, comprising:

a fixed contact;

a movable contact movable between a closed position where the movable contact is in contact with the fixed contact and an open position where the movable contact is separate from the fixed contact;

an arc extinguishing member for discharging an arc extinguishing gas offering a capacity for extinguishment of an arc, into a space containing the fixed contact and the movable contact; and a gas flow generator for causing a flow of gas, directed to a gap between the fixed contact and the movable contact in the open position, inside the space, and a receptacle having an inner face disposed at a position facing the gap, wherein the inner face is disposed at a position blown by the gas flow, the arc extinguishing member is made of a material different from a material of the inner face, the arc extinguishing member is held on the inner face so as to be in a position between the inner face and the gap, and the arc extinguishing member discharges the arc extinguishing gas when heated.

2. The contact apparatus of claim 1, wherein the gas flow generator causes the flow of gas by discharging a gas when heated.

3. A contact apparatus, comprising:

a fixed contact;

a movable contact movable between a closed position where the movable contact is in contact with the fixed contact and an open position where the movable contact is separate from the fixed contact;

an arc extinguishing member for discharging an arc extinguishing gas offering a capacity for extinguishment of an arc, into a space containing the fixed contact and the movable contact; and a layer covering at least part of a surface of the arc extinguishing member; and a receptacle having an inner face disposed at a position facing a gap between the fixed contact and the movable contact in the open position, wherein the arc extinguishing member is held on the inner face so as to be in a position between the inner face and the gap;

the arc extinguishing member includes hydrogen absorbing metal for discharging hydrogen, the hydrogen absorbing metal being a material different from a material of the inner face; and the layer includes a heat transfer substance higher in thermal conductivity than the hydrogen absorbing metal.

4. A contact apparatus, comprising:

a fixed contact;

a movable contact movable between a closed position where the movable contact is in contact with the fixed contact and an open position where the movable contact is separate from the fixed contact;

an arc extinguishing member for discharging an arc extinguishing gas offering a capacity for extinguishment of an arc, into a space containing the fixed contact and the movable contact; and a layer covering at least part of a surface of the arc extinguishing member; and a receptacle having an inner face disposed at a position facing a gap between the fixed contact and the movable contact in the open position, wherein the arc extinguishing member is held on the inner face so as to be in a position between the inner face and the gap;

the arc extinguishing member includes hydrogen absorbing metal for discharging hydrogen, the hydrogen absorbing metal being a material different from a material of the inner face; and the layer includes a catalyst substance acting as a catalyst for a reaction in which the hydrogen absorbing metal desorbs the hydrogen.

5. A contact apparatus, comprising:

a fixed contact;

a movable contact movable between a closed position where the movable contact is in contact with the fixed contact and an open position where the movable contact is separate from the fixed contact; and an arc extinguishing member for discharging an arc extinguishing gas offering a capacity for extinguishment of an arc, into a space containing the fixed contact and the movable contact, and a receptacle having an inner face disposed at a position facing a gap between the fixed contact and the movable contact in the open position, wherein the arc extinguishing member is held on the inner face so as to be in a position between the inner face and the gap;

the arc extinguishing member includes hydrogen absorbing metal for discharging hydrogen, the hydrogen absorbing metal being a material different from a material of the inner face; and the arc extinguishing member includes a catalyst material acting as a catalyst for a reaction in which the hydrogen absorbing metal desorbs the hydrogen.

6. A contact apparatus, comprising:

a fixed contact;

a movable contact movable between a closed position where the movable contact is in contact with the fixed contact and an open position where the movable contact is separate from the fixed contact;

an arc extinguisher for discharging an arc extinguishing gas offering a capacity for extinguishment of an arc, into a space containing the fixed contact and the movable contact; and a receptacle having an inner face disposed at a position facing a gap between the fixed contact and the movable contact in the open position, wherein the arc extinguisher is held on the inner face so as to be in a position between the inner face and the gap and has an arc extinguishing member for discharging the arc extinguishing gas and a heat transfer structure for improving an efficiency of transfer of heat from the space to the arc extinguishing member, the arc extinguishing member being made of a material different from a material of the inner face; and the heat transfer structure includes a material higher in thermal conductivity than the arc extinguishing member and includes a skeleton member including a hole receiving at least part of the arc extinguishing member.

7. A contact apparatus, comprising:

a fixed contact;

a movable contact movable between a closed position where the movable contact is in contact with the fixed contact and an open position where the movable contact is separate from the fixed contact;

an arc extinguisher for discharging an arc extinguishing gas offering a capacity for extinguishment of an arc, into a space containing the fixed contact and the movable contact; and a receptacle having an inner face disposed at a position facing a gap between the fixed contact and the movable contact in the open position, wherein the arc extinguisher is held on the inner face so as to be in a position between the inner face and the gap and has an arc extinguishing member for discharging the arc extinguishing gas and a heat transfer structure for improving an efficiency of transfer of heat from the space to the arc extinguishing member, the arc extinguishing member being made of a material different from a material of the inner face;

the heat transfer structure includes a heat transfer substance of a material higher in thermal conductivity than the arc extinguishing member; and the heat transfer substance is mixed in the arc extinguishing member.

8. A contact apparatus, comprising:

a fixed contact;

a movable contact movable between a closed position where the movable contact is in contact with the fixed contact and an open position where the movable contact is separate from the fixed contact;

an arc extinguisher for discharging an arc extinguishing gas offering a capacity for extinguishment of an arc, into a space containing the fixed contact and the movable contact; and a receptacle having an inner face disposed at a position facing a gap between the fixed contact and the movable contact in the open position, wherein the arc extinguisher is held on the inner face so as to be in a position between the inner face and the gap and has an arc extinguishing member for discharging the arc extinguishing gas and a heat transfer structure for improving an efficiency of transfer of heat from the space to the arc extinguishing member, the arc extinguishing member being made of a material different from a material of the inner face; and in the arc extinguishing member a highly resistive substance of a material higher in electric resistivity than the arc extinguishing member is mixed.

9. A contact apparatus, comprising:

a fixed contact;

a movable contact movable between a closed position where the movable contact is in contact with the fixed contact and an open position where the movable contact is separate from the fixed contact;

an arc extinguishing member for discharging an arc extinguishing gas offering a capacity for extinguishment of an arc, into a space containing the fixed contact and the movable contact; and a receptacle having an inner face enclosing a contact unit constituted by the fixed contact and the movable contact, and the arc extinguishing member, wherein the arc extinguishing member is made of a material different from a material of the inner face and is disposed on the inner face disposed at a position facing a gap between the fixed contact and the movable contact in the open position, so as to be in a position between the inner face and the gap;

the arc extinguishing member includes a recess on a surface facing the gap; and a protective film is on a surface of the arc extinguishing member facing the gap.

10. The contact apparatus of claim 9, wherein the protective film includes a through hole.

11. The contact apparatus of claim 9, wherein the protective film is made of a porous material and includes a recess in a surface.

* * * * *